US009964330B2

(12) United States Patent
Son et al.

(10) Patent No.: US 9,964,330 B2
(45) Date of Patent: May 8, 2018

(54) AIR HANDLER

(71) Applicant: LG ELECTRONICS INC., Seoul (KR)

(72) Inventors: Sangyuk Son, Seoul (KR); Kisuk Bang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 754 days.

(21) Appl. No.: 14/521,706

(22) Filed: Oct. 23, 2014

(65) Prior Publication Data

US 2015/0111488 A1 Apr. 23, 2015

(30) Foreign Application Priority Data

Oct. 23, 2013 (KR) ..... 10-2013-0126283
May 13, 2014 (KR) ..... 10-2014-0057395

(51) Int. Cl.

| | |
|---|---|
| ***F24F 7/00*** | (2006.01) |
| ***F24F 13/06*** | (2006.01) |
| ***F24F 13/20*** | (2006.01) |
| ***F24F 3/044*** | (2006.01) |

(52) U.S. Cl.

CPC ..... *F24F 13/20* (2013.01); *F24F 3/044* (2013.01); *F24F 2221/36* (2013.01)

(58) Field of Classification Search

CPC ..... F24F 13/20; F24F 3/044; F24F 7/02
See application file for complete search history.

(56) References Cited

U.S. PATENT DOCUMENTS 3,946,528 A 3/1976 Jacobson
4,072,187 A * 2/1978 Lodge ..... F24F 13/20 165/137

(Continued)

FOREIGN PATENT DOCUMENTS

CN 20-1168024 12/2008
CN 10-1821555 9/2010

(Continued)

OTHER PUBLICATIONS

Chinese Office Action dated Dec. 22, 2016 issued in Application No. 201410573067.4. (English Translation attached).

(Continued)

*Primary Examiner* — Steven B McAllister
*Assistant Examiner* — Jonathan Cotov
(74) *Attorney, Agent, or Firm* — KED & Associates LLP

(57) ABSTRACT

An air handler which allows modular assembly at a place of manufacture or outside of a building and modular transportation to a machine room of the building where the air handler will be installed, thereby achieving enhanced transportation convenience. In addition, in the air handler, a plurality of case panels may be assembled with a plurality of module frames via considerably simplified sliding coupling, providing excellent hermetic sealing. As such, manufacturing costs may be reduced due to a reduction in a number of components, and assembly time may be remarkably reduced due to a reduced number of assembly operations. This advantageously results in reduced labor costs and enhanced air conditioning efficiency.

31 Claims, 41 Drawing Sheets

(56) References Cited

U.S. PATENT DOCUMENTS 4,782,637 A * 11/1988 Eriksson ..... E04B 1/3483 312/111
4,891,923 A * 1/1990 Ericsson ..... E04B 1/34321 52/280
4,900,108 A 2/1990 Tischer
5,277,036 A * 1/1994 Dieckmann ..... F24F 3/044 165/76
5,516,225 A 5/1996 Kvols
5,522,768 A * 6/1996 Brodt ..... F24F 13/24 454/233
5,664,384 A 9/1997 Cullinan
5,848,500 A * 12/1998 Kirk ..... E04B 1/5831 160/135
6,076,739 A 6/2000 Littleford
6,205,738 B1 * 3/2001 Chen ..... E04C 3/28 312/265.4
6,221,120 B1 4/2001 Bennington
6,370,899 B1 4/2002 Hobbs et al.
6,374,571 B1 * 4/2002 Mann ..... E04C 2/292 52/404.4
6,430,954 B1 * 8/2002 Smith ..... F24F 1/58 135/913
6,497,256 B1 * 12/2002 Adams ..... F24F 13/20 138/149
6,530,630 B2 3/2003 Herbeck
6,626,017 B2 9/2003 Herbeck
6,658,904 B2 * 12/2003 Herbeck ..... F24F 3/0442 138/149
6,676,234 B2 * 1/2004 Herbeck ..... E04C 2/292 312/236
6,688,712 B2 * 2/2004 Adams ..... E04B 1/3483 211/191
6,792,722 B2 * 9/2004 Beser ..... F24F 3/0442 52/309.4
7,000,362 B1 * 2/2006 Cullinan ..... F24F 3/0442 52/506.06
7,332,011 B1 2/2008 Sandberg
7,334,377 B2 * 2/2008 Dubensky ..... E04B 1/3483 52/653.2
7,338,400 B2 * 3/2008 Pierjok ..... F16H 7/14 417/359
7,678,434 B2 * 3/2010 Phillips ..... F24F 13/20 428/210
8,127,566 B2 3/2012 Hammond
8,360,834 B1 * 1/2013 Semmes ..... F24F 13/20 454/242
9,578,772 B2 * 2/2017 Podemski ..... H05K 7/02
2003/0009969 A1 * 1/2003 Herbeck ..... E04C 2/292 52/474
2003/0011289 A1 * 1/2003 Adams ..... E04B 1/3483 312/265.1
2003/0111219 A1 6/2003 Edwards
2004/0063398 A1 4/2004 Beser
2005/0055917 A1 * 3/2005 Dubensky ..... E04B 1/3483 52/302.1
2005/0084324 A1 4/2005 Dubensky
2007/0052333 A1 3/2007 Freire
2007/0163295 A1 7/2007 Martin, Sr.
2007/0257585 A1 * 11/2007 Kenny ..... A47B 47/02 312/265.4
2008/0083239 A1 4/2008 Meyer
2009/0019789 A1 1/2009 Gephard
2010/0218534 A1 9/2010 Yabu
2011/0291533 A1 12/2011 McFarland
2011/0307102 A1 12/2011 Czamara
2012/0242206 A1 9/2012 Gasser
2013/0118830 A1 * 5/2013 Cursetjee ..... F24F 13/24 181/224

FOREIGN PATENT DOCUMENTS

| | | |
|---|---|---|
| CN | 20-1601998 | 10/2010 |
| DE | 1 604 310 | 10/1970 |
| DE | 197 10 526 | 9/1998 |
| DE | 19710526 | 9/1998 |
| DE | 101 55 631 | 7/2002 |
| EP | 0 387 166 B1 | 12/1993 |
| EP | 1 580 491 A1 | 9/2005 |
| EP | 2 208 945 | 7/2010 |
| GB | 2 280 951 | 2/1995 |
| JP | 2005-513359 A | 5/2005 |
| KR | 10-2011-0056109 | 5/2011 |
| KR | 10-1122247 | 3/2012 |
| KR | 10-1294097 | 8/2013 |
| WO | WO 88/02801 | 4/1988 |
| WO | WO 2005/043048 | 5/2005 |

OTHER PUBLICATIONS

Chinese Office Action dated Dec. 2, 2016 issued in Application No. 201410575011.2 (English Translation attached).
Chinese Office Action dated Nov. 22, 2016 issued in Application No. 201410573070.6.
European Search Report issued in Application No. 14189950.0 dated Apr. 5, 2016.
European Search Report dated Mar. 31, 2016.
European Search Report dated Dec. 9, 2015 (2884191).
European Search Report dated Dec. 9, 2015 (2884196).
Korean Search Report dated Mar. 9, 2016 issued in Application No. 10-2014-0057395.
Korean Notice of Allowance dated Sep. 23, 2016 issued in Application No. 10-2014-0057395.
United States Office Action dated Apr. 20, 2017 issued in co-pending related U.S. Appl. No. 14/520,708.
United States Office Action dated Apr. 20, 2017 issued in co-pending related U.S. Appl. No. 14/520,737.
United States Notice of Allowance dated Sep. 18, 2017 issued in U.S. Appl. No. 14/520,708.
United States Notice of Allowance dated Sep. 18, 2017 issued in U.S. Appl. No. 14/520,737.
U.S. Office Action issued in U.S. Appl. No. 14/521,115 dated Jan. 9, 2018.
Avallone et al.; Marks' Standard Handbook for Mechanical Engineers; 3 pages.

* cited by examiner

AIR HANDLER

CROSS-REFERENCE TO RELATED APPLICATION(S)

This application claims priority to Korean Patent Application No. 10-2013-0126283, filed in Korea on Oct. 23, 2013, and Korean Patent Application No. 10-2014-0057395, filed in Korea on May 13, 2014, the disclosures of which are incorporated herein by reference.

BACKGROUND

1. Field

An air hander is disclosed herein.

2. Background

Generally, an air conditioner is a system that cools, heats, or ventilates an air conditioning object space, such as a room or space, by repeating a series of processes including suctioning in of indoor air from the room or space, providing heat exchange between the suctioned in indoor air and a low-temperature or high-temperature refrigerant, and discharging of the heat-exchanged air into the room or space. The air conditioner employs a refrigerant cycle comprised of a compressor, an expander, a first heat exchanger, that is, a condenser or evaporator, and a second heat exchanger, that is, an evaporator or condenser.

Such an air conditioner may be divided into an outdoor unit or device, which is mainly installed outside (also referred to as "outdoor side" or "heat radiation side") and an indoor unit or device, which is mainly installed inside a building (also referred to as "indoor side" or "heat absorption side"). Usually, a condenser, that is, an outdoor heat exchanger, and a compressor are installed in the outdoor unit, and an evaporator, that is, an indoor heat exchanger, is installed in the indoor unit.

As is known in the art, air conditioners may be broadly classified into a discrete type air conditioner, in which an outdoor unit and an indoor unit are separately installed, and an integral type air conditioner, in which an outdoor unit and an indoor unit are integrated. Additionally, air conditioners may be classified, based on a magnitude of capacity, into a small capacity air conditioner and a large capacity air conditioner.

In particular, a large capacity air conditioner may include an indoor unit and an outdoor unit integrated with each other, and may be configured to supply conditioned air into a plurality of object spaces requiring air conditioning through ducts, for example. An "air handling unit" or "air handler" is one type of large capacity air conditioner, which mixes outdoor air (outside air) and indoor air at an appropriate ratio to suit a target load depending on temperature, humidity, and cleanliness conditions of an object space, thereby providing a user with optimal air conditioning.

The above-described air handling unit may consist of modules having differentiated functions to ensure efficient driving of a system based on a target load of an object space.

As representative examples, air handling units are described in Korean Registered Patent No. 10-1294097 and Korean Patent Laid-open Publication No. 10-2011-0056109. In these related art air handling units, an external appearance of the air handling unit is defined by a plurality of frames forming an overall framework of the air handling unit, and a plurality of panels coupled to the plurality of frames. The plurality of frames and the plurality of panels define flow passages for the flow of conditioned air.

However, the related art air handlers are greater in size than general upright air conditioners, and wall mounted air conditioners installed in respective object spaces of a building. Therefore, the air handlers cannot be completely assembled outside and transported to an installation place, such as a machine room of a building. Thus, it is necessary to accurately check spatial dimensions of the machine room of the building where the air handler will be installed, and thereafter, components of the air handler, for example, panels and frames forming a framework of the air handler, are transported from a place of manufacture, such as a parts factory, to the machine room so as to be completely assembled in the machine room.

The above-described system provides limited assembly and transportation of parts requires a lot of skilled assemblers for assembly of parts and has a risk of one or two parts going missing during transportation of numerous parts of one air handler, thus interrupting the entire assembly process. In addition, the related art air handlers suffer from a geometrical increase in number of assembly operations because, after the frames are coupled to one another to form the framework of the entire air handler, the panels must be coupled to the frames using thousands of screws to increase a coupling strength therebetween in order to prevent conditioned air from leaking from an interior of the air handler to the outside.

In addition, in the related art air handlers, to prevent conditioned air from leaking through gaps between the frames and the panels, it is necessary to primarily wrap electrical insulating tape around outer rim portions or rims of respective panels. Then, after coupling the panels to the frames via the above-described complicated process, it is necessary to secondarily apply a sealant, such as silicon, to regions where air leakage may occur based on a coupling strength between the frames and the panels. Operations to prevent leakage of conditioned air as described require a lot of skilled assemblers, and the complicated installation process and transportation problematically result in considerable delay of an installation time and a construction time, thus causing loss of installation cost.

BRIEF DESCRIPTION OF THE DRAWINGS

Embodiments will be described in detail with reference to the following drawings in which like reference numerals refer to like elements, and wherein.

DETAILED DESCRIPTION

Advantages and features and a method of achieving the same will be more clearly understood from embodiments described below in detail with reference to the accompanying drawings. However, embodiments are not limited to the following embodiments and may be implemented in various different forms. The embodiments are provided merely to complete disclosure and to provide those skilled in the art with the category of the embodiments. Wherever possible, the same or similar reference numbers have been used throughout the specification to refer to the same or similar elements, and repetitive disclosure has been omitted.

Hereinafter, an embodiment of an air handler will be described in detail with reference to the accompanying drawings.

Figure 1:
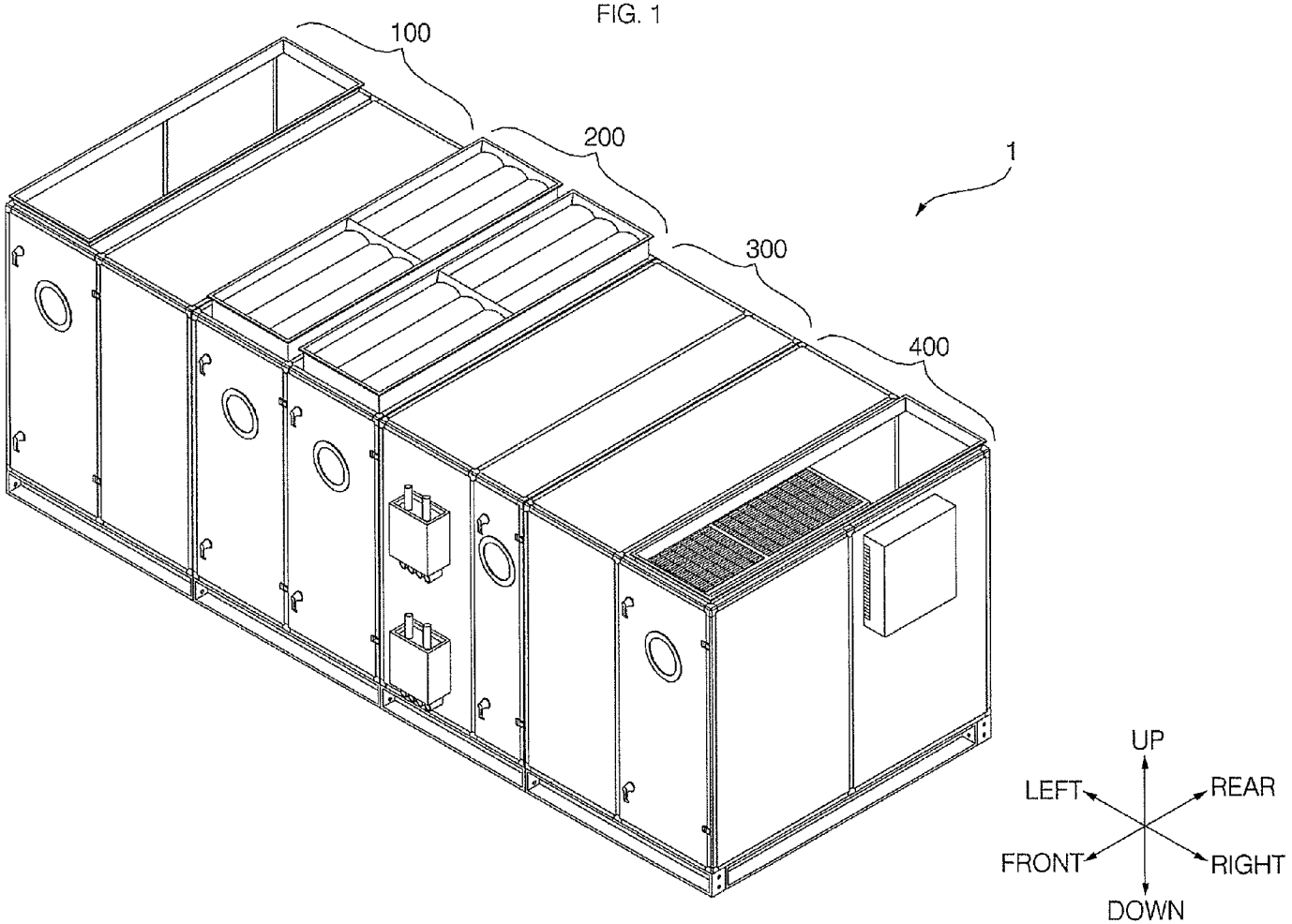
FIG. 1 is a perspective view of an air handler according to an embodiment.
Figure 2:
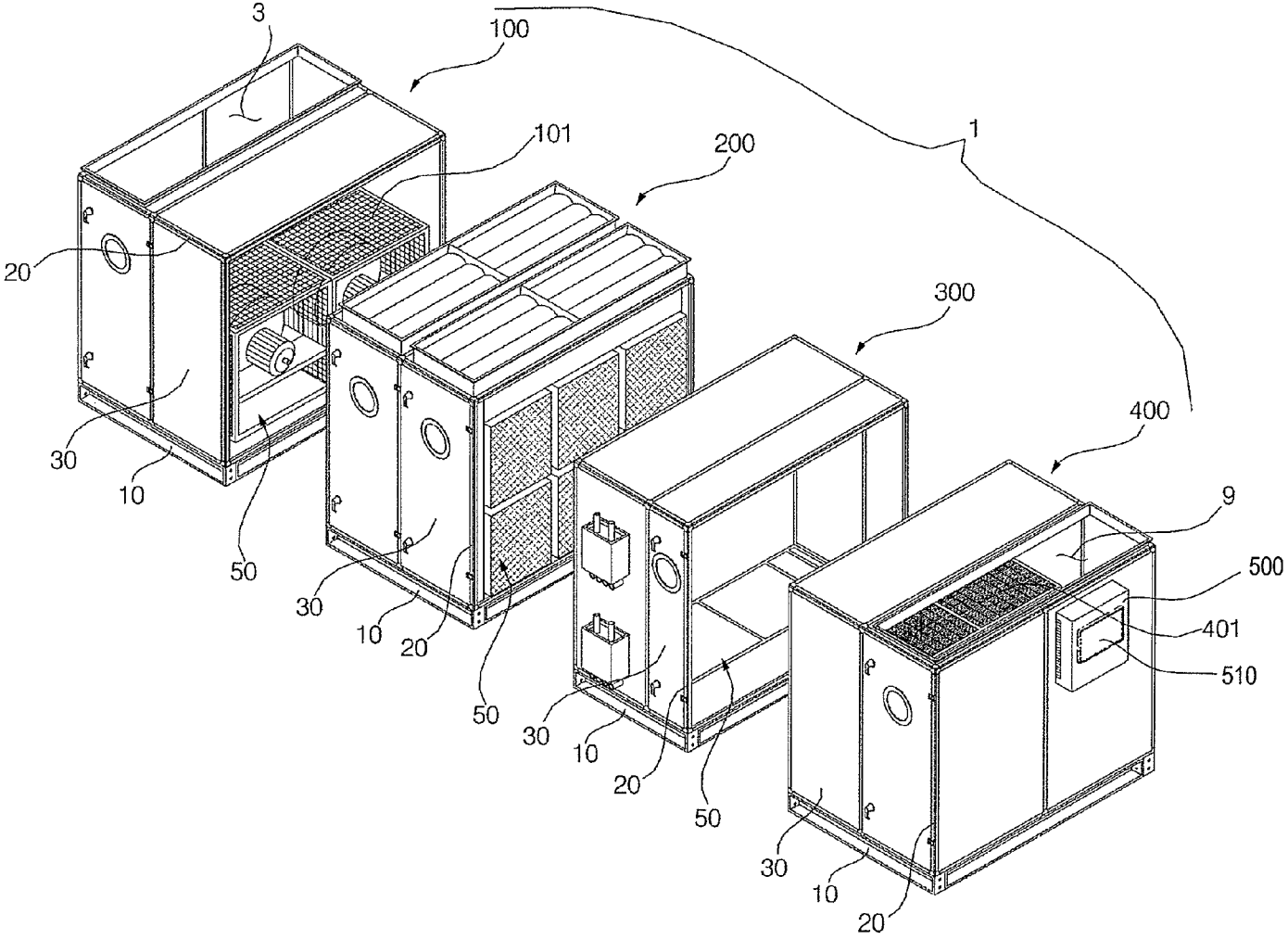
FIG. 2 is an exploded perspective view of the air handler of FIG. 1.
Figure 3:
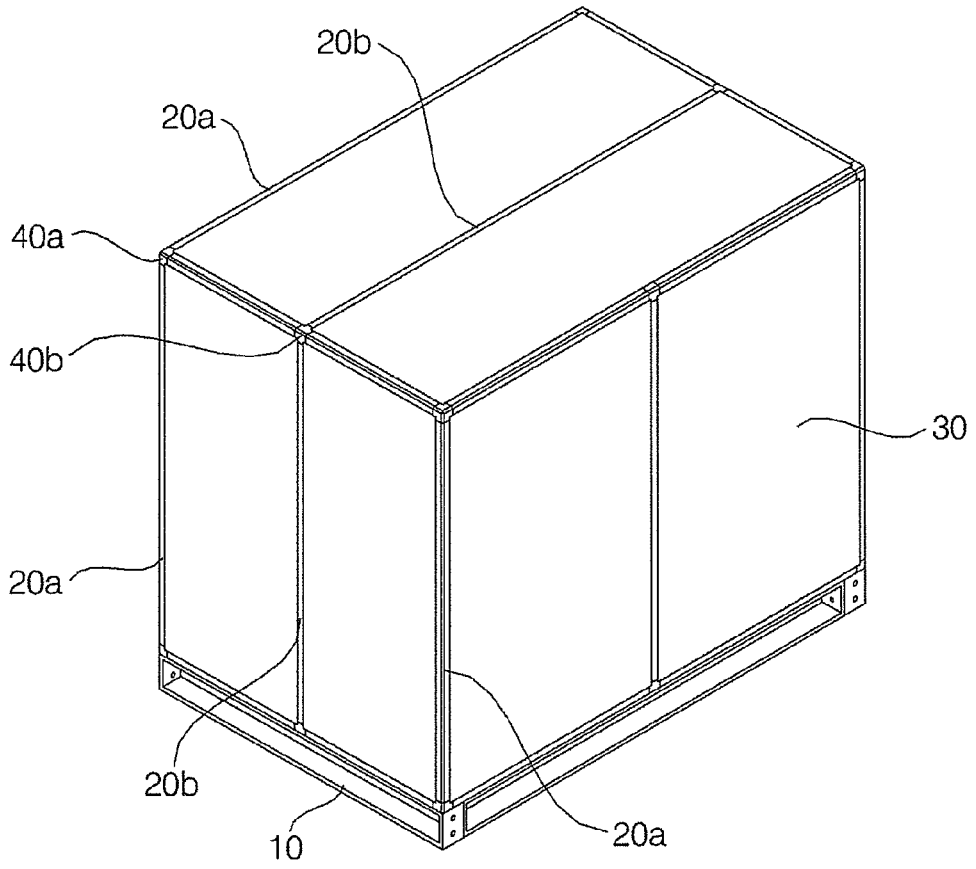
FIG. 3 is a perspective view illustrating a common assembled form of each module of the air handler of FIG. 1.
Figure 4:
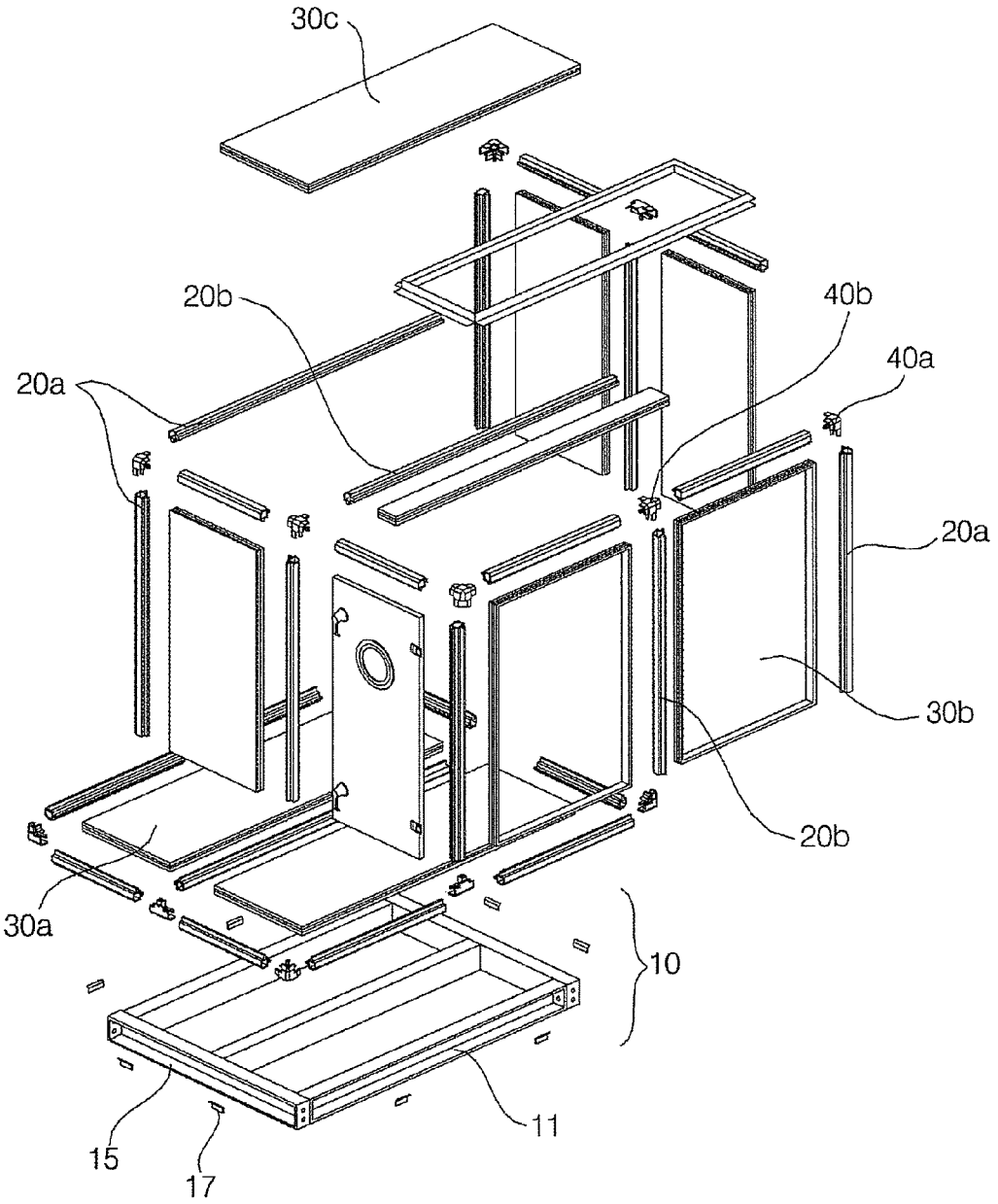
FIG. 4 is an exploded perspective view of the module of FIG. 3.
Figure 5:
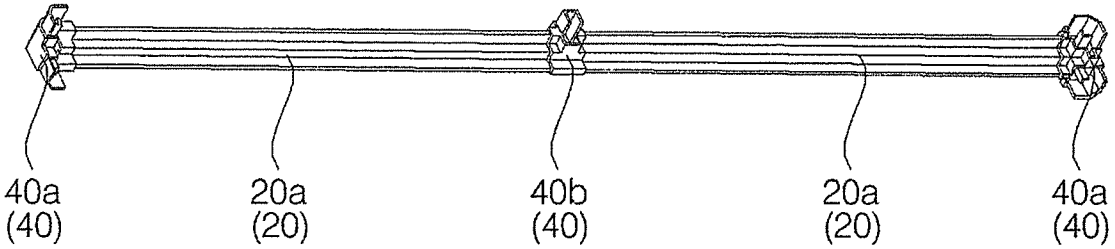
FIG. 5 is a perspective view showing a connected form of a plurality of module frames of the module of FIG. 3.
Figure 6A:
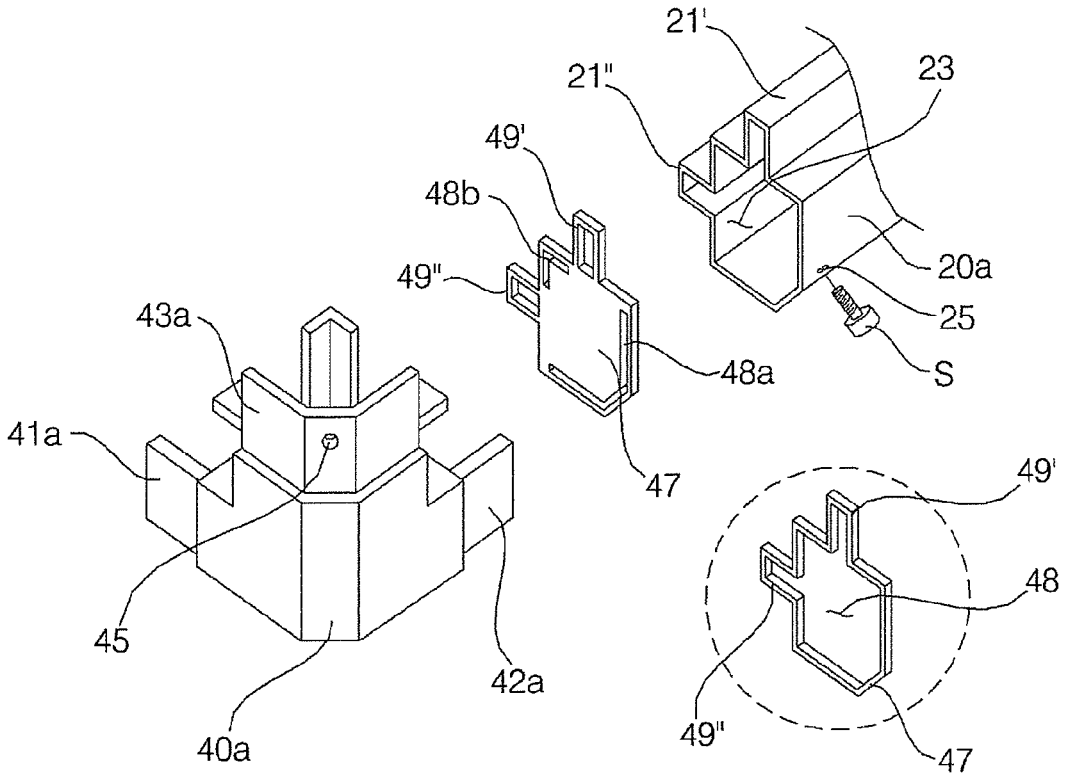
FIGS. 6A and 6B are exploded perspective views, respectively, showing a connection relationship between an edge frame and a corner connector, and a connection relationship between an edge frame and a middle connector, among the module frames of FIG. 5.
Figure 6B:
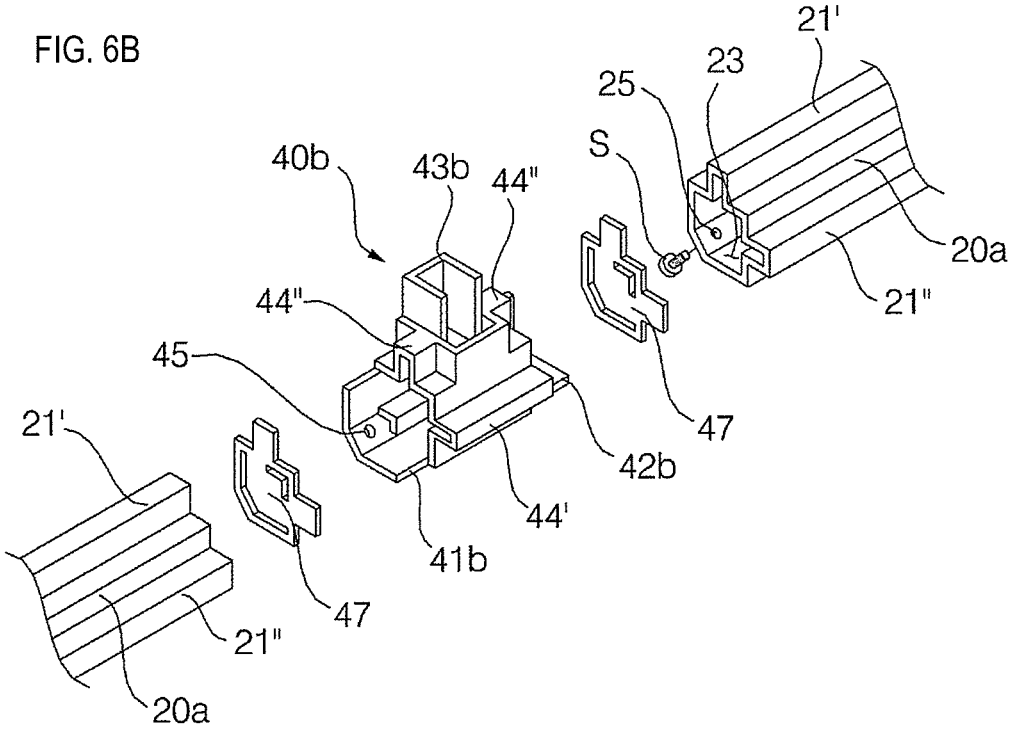
Figure 7A:
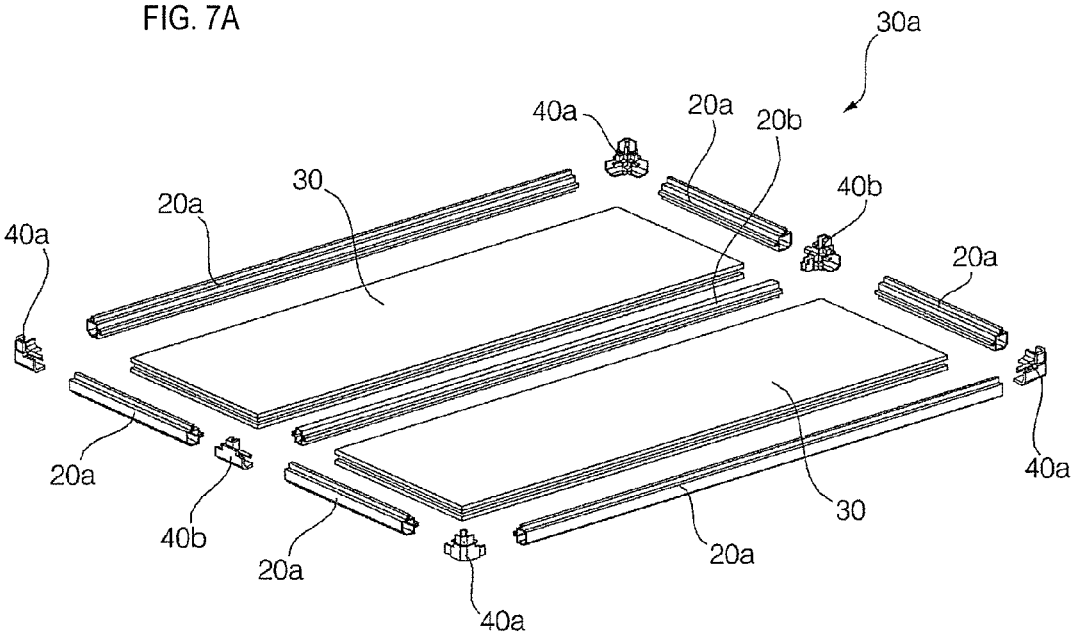
FIGS. 7A to 7F are views showing an example of a sequential modular assembly of the air handler according to an embodiment.
Figure 7B:
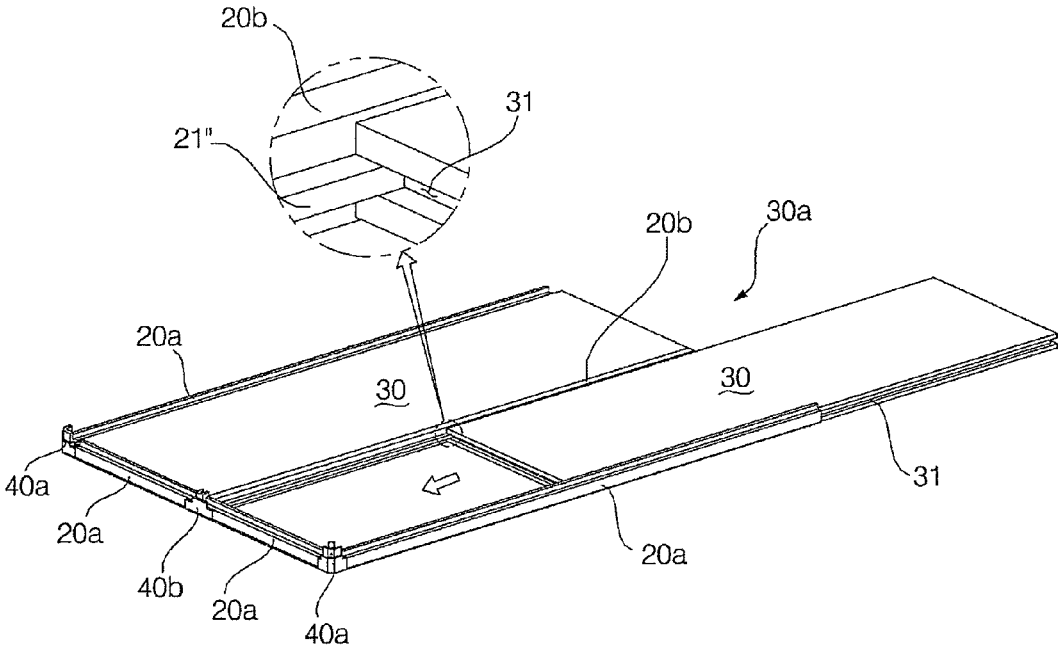
Figure 7C:
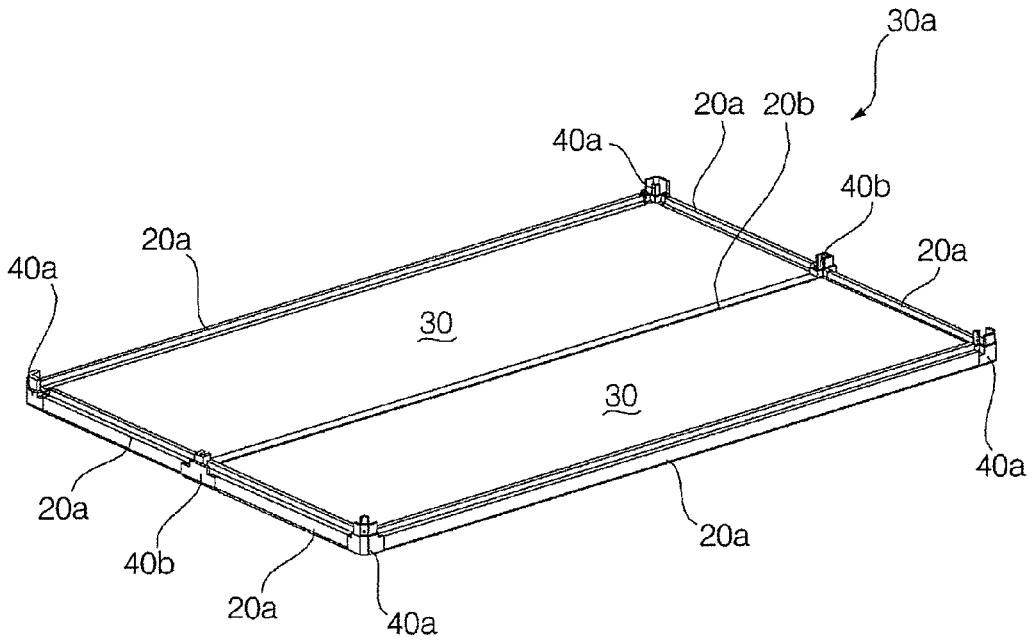
Figure 7D:
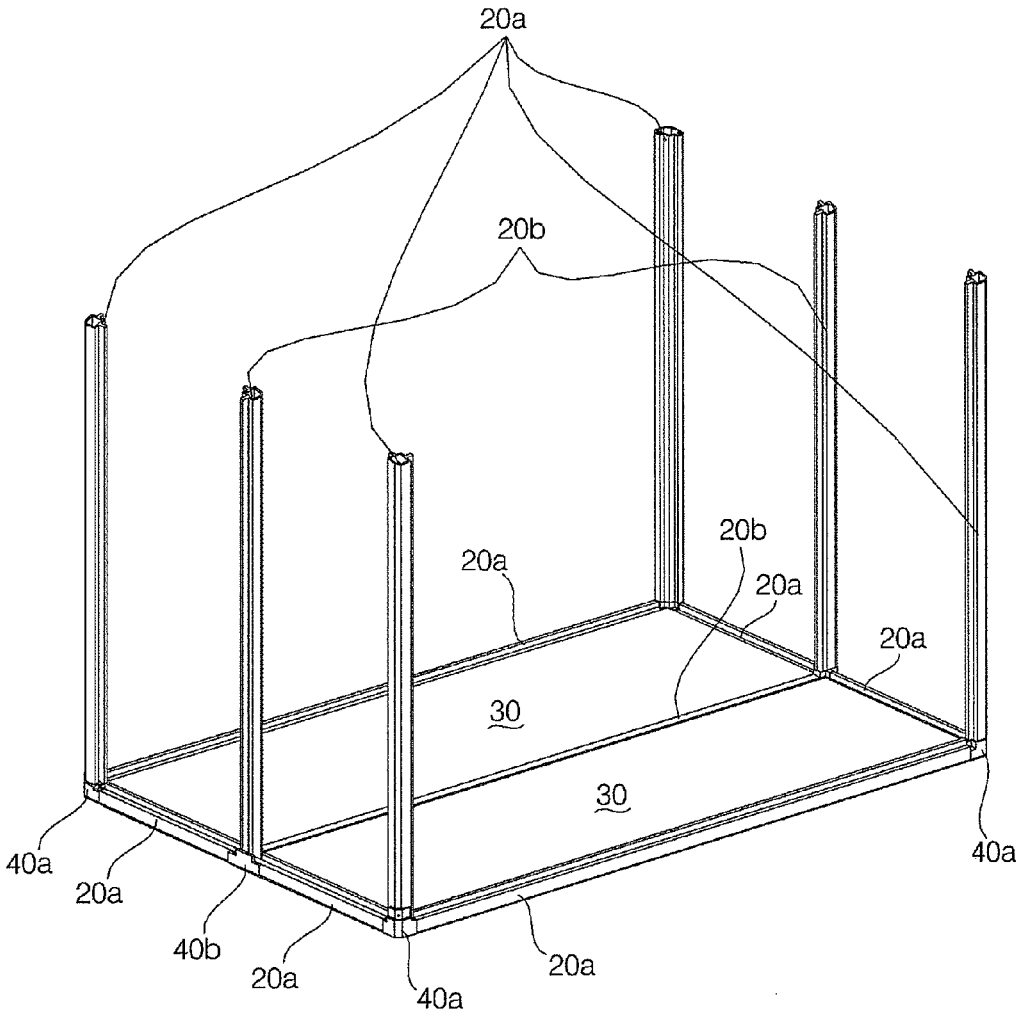
Figure 7E:
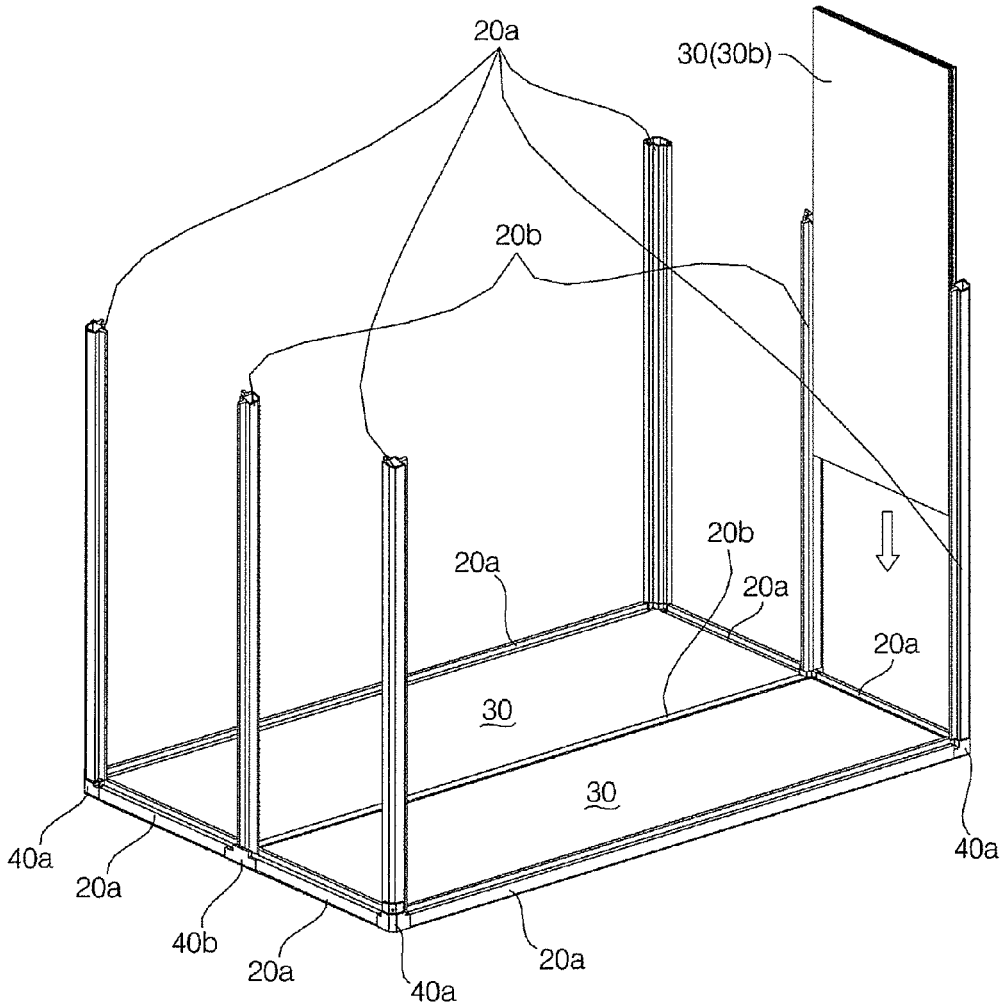

FIG. 1 is a perspective view of an air handler according to an embodiment. FIG. 2 is an exploded perspective view of the air handler of FIG. 1. FIG. 3 is a perspective view showing a common assembled form of each module of FIG. 1. FIG. 4 is an exploded perspective view of the module of FIG. 3. FIG. 5 is a perspective view showing a connected form of a plurality of module frames of the module of FIG. 3. FIGS. 6A and 6B are exploded perspective views, respectively, showing a connection relationship between an edge frame and a corner connector, and a connection relationship between an edge frame and a middle connector, among the module frames of FIG. 5. FIGS. 7A to 7F are views showing an example of a sequential modular assembly of the air handler according to an embodiment. FIG. 8 is an exploded perspective view showing modular transportation using short distance transportation.

In the following description of one embodiment of the air handler, the air handler, designated by reference numeral 1, will be described using an example one type of a large capacity air conditioner, and designed to suction in and mix indoor air and outside air so as to control the mixed air to a set or predetermined condition based on an air conditioning condition (a target load), such as, for example, temperature, humidity, and cleanliness of an object space, and thereafter, to discharge the controlled air into the object space for air conditioning. However, embodiments may be implemented in equivalent implementations of large capacity air conditioners and all other air conditioners, and thus, the scope should not be construed in a narrow sense.

With reference to FIGS. 1 and 2, according to one embodiment, the air handler 1 may include an air suction module 100, a mixing module 200, a heat exchange module 300, and an air discharge module 400. The modules 100 to 400 may be divided based on differentiated functions of an air conditioning cycle. More specifically, the air suction module 100 may have a suction opening 3 to suction in indoor air and accommodate a fan module 101 to move the suctioned in indoor air. The mixing module 200 may be coupled to and in communication with the air suction module 100 and serve to mix the indoor air supplied from the air suction module 100 with outside air suctioned in from the outside. The heat exchange module 300 may be coupled to and in communication with the mixing module 200 and serve to exchange thermal energy with the mixed air supplied from the mixing module 200. The air discharge module 400 may be coupled to and in communication with the heat exchange module 300, may have a discharge opening 9, and may accommodate a fan module 401 to discharge the heat-exchanged air supplied from the heat exchange module 300 to a room through the discharge opening 9.

The air suction module 100 may function to suction in indoor air through an air suction duct (not shown) that communicates the air suction module 100 with an air conditioning object space (not shown). As such, the air suction module 100 may suction in indoor air and supply the suctioned indoor air to the mixing module 200 located at one side thereof.

The mixing module 200 may receive the indoor air supplied from the air suction module 100, and simultaneously, suction in outside air from the outside, thereby serving to adjust a mixing ratio of the indoor air and the outside air based on cleanliness, for example, of the air conditioning object space. The mixing module 200 may discharge the indoor air supplied from the air suction module 100 within a range of about 0% to 100% and receive the outside air from the outside within a range of about 0% to 100%.

The mixing module 200 may receive air from the air suction module 100 by a same amount as air discharged therefrom to the outside. For example, when discharging about 30% of air to the outside, the mixing module 200 may receive about 30% of air from the air suction module 100. In this case, the mixing module 200 may mix air supplied from the air suction module 100 and air suctioned from the outside with each other at a mixing ratio of about 7:3. The mixing ratio may be appropriately changed and adjusted in consideration of cleanliness of air or energy efficiency.

The heat exchange module 300 may perform heat exchange between the mixed air supplied from the mixing module 200 and thermal energy to heat or cool the air to suit a target load of the air conditioning object space, thereby enabling implementation of a cooling operation or heating operation. The air discharge module 400 may function to receive the heat-exchanged air from the heat exchange module 300 and discharge the air to a room which is the air conditioning object space.

In an interior of the air suction module 100, the mixing module 200, the heat exchange module 300, and the air discharge module 400 as described above, internal components 50 (101, 250, 301, 401) to perform differentiated functions of the respective modules may be installed at appropriate positions. This will be described hereinbelow in detail.

The air handler 1 according to this embodiment, as described above and as exemplarily shown in FIG. 2, may be divided into four modules 100, 200, 300 and 400 on a per function basis. These modules may be assembled respectively via a combination of a plurality of module frames 20, a plurality of case panels 30, and the internal components 50, which will be described hereinbelow, and be delivered, respectively. Through coupling of the respective assembled modules, a single air handler 1, which is normally operable, may be formed.

In particular, according to one embodiment, provide the modular air handler 1, which may allow even a normal person rather than a skilled assembler, to simply assemble each module by reading only an installation manual and assemble the full air handler via a combination of the respective modules, and may enable assembly of the air handler with a minimum number of assembly operations by reducing the number of components, and consequently, prevent delay of overall assembly time due to the reduction in the number of components and a number of assembly operations.

With reference to FIG. 2, according to one embodiment of the air handler 1, each module may include a base 10 to support a weight of the module, a plurality of the module frames 20 installed on the base 10 to define an external appearance of the module having a predetermined shape, a plurality of the case panels 30 coupled to the plurality of module frames 20 to form surfaces of the module, and a plurality of connecting members or connectors 40 to interconnect the plurality of module frames 20. The plurality of module frames 20, as exemplarily shown in FIG. 4, form a framework of the module. More specifically, the plurality of module frames 20 may be assembled into a rectangular parallelepiped-shaped module as two or more module frames 20 are connected to one connecting member 40 to form the framework.

The plurality of modules frames 20 may include a plurality of edge frames 20*a* that forms edges of the module, and a plurality of middle frames 20*b* each having first and second ends connected to the edge frames 20*a*. The middle frames 20*b* may not be connected to angular points or corners of the module. The plurality of module frames 20 may be manufactured by aluminum extrusion or steel molding, for example, and may be formed of a thermal break material to achieve enhanced thermal barrier effects.

The plurality of edge frames 20*a*, as exemplarily shown in FIG. 4, may form respective edges of the rectangular parallelepiped module, or may respectively form a portion of each edge. In addition, as will be described hereinbelow, three edge frames 20*a* may be connected to one corner connector 40*a* to form each angular point or corner of the module.

Each of the middle frames 20*b* may be located between at least two case panels 30, including a lower cover 30*a* that forms a lower surface of the module, a side cover 30*b* that forms a side surface of the module, and an upper cover 30*c* that forms an upper surface of the module. In addition, the middle frame 20*b* may bisect the relatively long edge frame 20*a*, thereby serving to enhance rigidity of an entire module in comparison to a module assembled using only the relatively long edge frames 20*a*.

With reference to FIGS. 5 to 6B, the plurality of connecting members 40 may include corner connectors 40*a* and middle connectors 40*b*. Each of the corner connectors 40*a* may form an angular point or corner of the module as three inserting ends 41*a*, 42*a*, and 43*a* of the corner connector 40*a* arranged substantially perpendicular to one another are connected to the respective edge frames 20*a*. Each of the middle connectors 40*b* may be connected at two opposite ends thereof to the edge frames 20*a* and connected at at least one end substantially perpendicular to the two opposite ends to the middle frame 20*b* in a direction substantially perpendicular to the edge frames 20*a*.

The module frames 20, as described above, may be divided into the edge frames 20*a* and the middle frames 20*b* in every region forming the framework of the module.

With reference to FIGS. 5 to 6B, the edge frames 20*a* may be connected to one another by one or more corner connectors 40*a* and middle connectors 40*b* to form edges of the module. With reference to FIGS. 7A to 7C, the middle frames 20*b* may be, respectively, located between two case panels 30 and coupled at both ends thereof to the middle connectors 40*b*. Thereby, as described above, the middle frames 20*b* may, respectively, bisect the relatively long edge frame 20*a* or the relatively large case panel 30 to enhance rigidity of the module.

With reference to FIGS. 5 and 6A, each of the corner connectors 40*a* may have the three inserting ends 41*a*, 42*a*, and 43*a* arranged in such a way that any one inserting end 41*a* may protrude substantially perpendicular to two inserting ends 42*a* and 43*b*. The three inserting ends 41*a*, 42*a*, and 43*a* may be inserted into hollow ends 23 of the respective edge frames 20*a*, which may be coupled to the corner connector 40*a* to form edges of the module.

A first screw fastening hole 25 may be formed in the hollow end 23 of the edge frame 20*a*, and a second screw fastening hole 45 corresponding to the first screw fastening hole 25 may be formed in the inserting end 43*a* of the corner connector 40*a*. Thereby, as a screw S may be fastened through the first screw fastening hole 25 and the second screw fastening hole 45 in a state in which the inserting end 43*a* of the corner connector 40*a* is inserted into the hollow end 23 of the edge frame 20*a*, the framework of the module may be firmly assembled.

With reference to FIGS. 5 and 6B, each of the middle connectors 40*b* may have three inserting ends 41*b*, 42*b* and 43*b* arranged in such a way that any one inserting end 43*b* (hereinafter referred to as "third inserting end 43*b*") may protrude substantially perpendicular to two inserting ends 41*b* and 42*b* (hereinafter referred to as "first inserting end 41*b*" and "second inserting end 42*b*", respectively, and the first inserting end 41*b* and the second inserting end 42*b* may be linearly arranged to protrude in opposite directions. The third inserting end 43*b* may be inserted into a hollow end (not shown) of the middle frame 20*b*, and the first inserting end 41*b* and the second inserting end 42*b* may be, respectively, inserted into the hollow ends 23 of the edge frames 20*a*.

It should be understood that a screw fastening hole (not shown) corresponding to the first screw fastening hole 25 of the edge frame 20*a* may be formed in the third inserting end 43*b* of the middle connector 40*b*, a screw fastening hole (not shown) corresponding to the screw fastening hole of the middle connector 40*b* may be formed in the middle frame 20*b*, and the second screw fastening hole 45 corresponding to the first screw fastening hole 25 of the edge frame 20*a* may be formed in each of the first inserting end 41*b* and the second inserting end 42*b* of the middle connector 40*b*. The first inserting end 41*b* and the second inserting end 42*b* of the middle connector 40*b* may be, respectively, inserted into and coupled to the hollow ends 23 of the edge frames 20*a* arranged at opposite sides thereof, and the third inserting end 43*b* of the middle connector 40*b* may be inserted into and coupled to the hollow end (not shown) of the middle frame 20*b*.

Each of the module frames 20 may be provided with one or more sliding ribs 21' and 21" that protrude outward in a substantially longitudinal direction thereof. The sliding ribs 21' and 21", as will be described hereinbelow, may be fitted into sliding rail grooves 31 formed in a rim or at outer edges of the case panels 30. The sliding ribs 21' and 21" of each module frame 20 may be equal in number to a number of the case panels 30 to be connected to the module frame 20.

For example, with reference to FIG. 6A, the edge frame 20*a*, which may be disposed immediately above the base 10 among the module frames 20, may be provided with two sliding ribs 21' and 21". More specifically, the two sliding ribs 21' and 21" may include a first sliding rib 21" inserted into the sliding rail groove 31 formed in a rim of the case panel 30 that forms a lower surface of the module, that is, the lower cover 30*a*, and a second sliding rib 21' inserted into the sliding rail groove 31 formed in a lower end rim of the case panel 30 that forms a side surface of the module, that is, the side cover 30B.

A procedure of assembling the air suction module 100 using the module frames 20 and the case panels 30 will be described hereinbelow in brief by way of example.

First, with reference to FIG. 7A, to assemble the lower cover 30*a* of the module, more particularly, the rectangular lower cover 30*a*, it is necessary to prepare at least four edge frames 20*a* forming four sides, that is, edges of the module, and at least one case panel 30. As described above, one edge frame 20*a* may be divided into two members to increase rigidity of the entire module, or at least two edge frames 20*a* may be further provided so as to be, respectively, linearly added to corresponding two edge frames among the four edge frames 20*a* to increase a volume of the entire module. In this case, two middle connectors 40*b* for connection of the two edge frames 20*a* and one middle frame 20*b* may be further provided.

The edge frames 20*a* and the middle frame 20*b* may be assembled with one another using corner connectors 40*a* and middle connectors 40*b*, so as to configure a rectangular structure having one open side using the respective components 20 and 30 of the module having the above-described configuration.

Next, with reference to FIG. 7B, the case panel 30 may be coupled to the module frames 20 through the open side of the rectangular structure such that the sliding rail grooves 31 formed in a rim of the case panel 30 may be, respectively, engaged with the sliding rails 21' and 21" of the edge frames 20*a* and the middle frame 20*b*.

That is, assuming that the entire module 100, 200, 300, or 400 has a rectangular parallelepiped shape, the lower cover 30*a* may have a rectangular shape. The corner connectors 40*a* may be, respectively, arranged at angular points of a rectangle, and the edge frames 20*a* (hereinafter referred to as "lower edge frames") may be connected to the respective corner connectors 40*a* to define the rectangle. The case panel 30 (hereinafter referred to as a "lower case panel") may be slidably coupled to the connected lower edge frames 20*a* before connection of a last lower edge frame 20*a*.

Next, with reference to FIG. 7C, as the last lower edge frame 20*a* may be coupled to close the open side of the rectangular structure using the corner connectors 40*a* and the middle connector 40*b*, assembly of the lower cover 30*a* forming a lower surface of the module may be completed.

Once assembly of the lower cover 30*a* is completed as described above, with reference to FIG. 7D, a plurality of edge frames 20*a* (hereinafter referred to as "side edge frames") and middle frames 20*b* (hereinafter referred to as "side middle frames") may be coupled to upper ends of the respective corner connectors 40*a* and the middle connectors 40*b* so as to substantially vertically extend. Next, with reference to FIG. 7E, as one case panel 30 may be sequentially slidably coupled between neighboring side edge frames 20*a* or between the side edge frame 20*a* and the side middle frame 20*b* next to each other, one side cover 30*b* forming a side surface of the module may be completed.

Figure 7F:
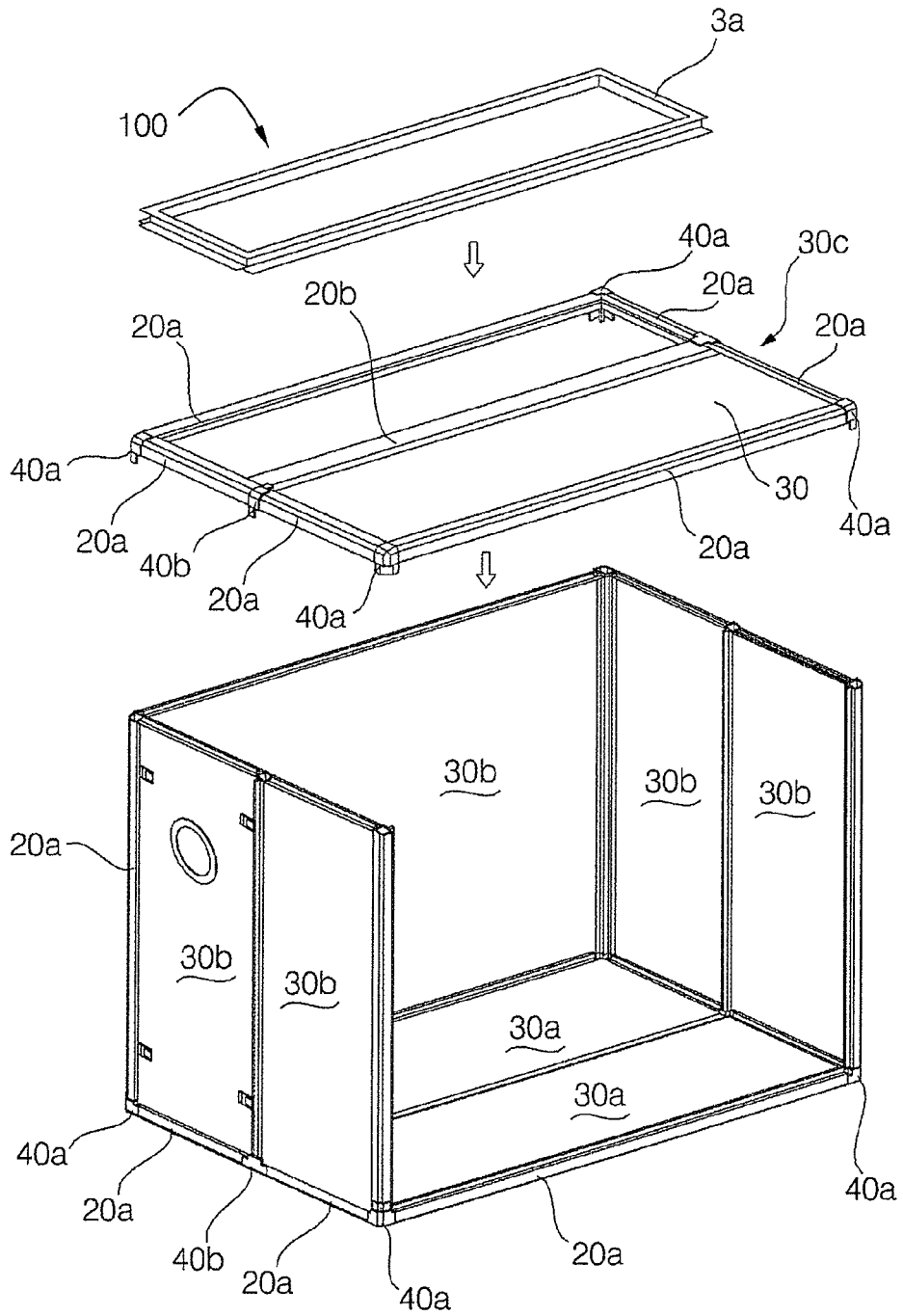
Figure 8:
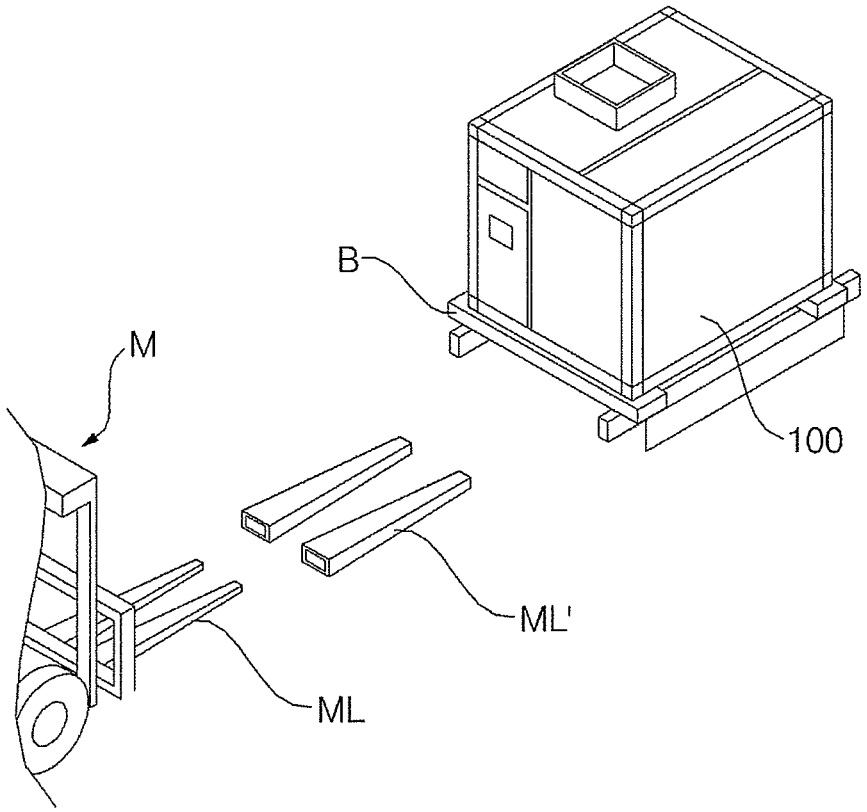
FIG. 8 is an exploded perspective view showing modular transportation using short distance transportation.

Next, with reference to FIG. 7F, the upper cover 30*c*, which may be preassembled in the same sequence as the assembly sequence of the above-described lower cover 30*a*, may be connected to the edge frames 20*a* and the middle frames 20*b* exposed from or at an upper end of the side cover 30*b* using the corner connectors 40*a* and the middle connectors 40*b*. More specifically, the corner connectors 40*a* may be arranged at upper ends of the respective side edge frames 20*a* so as to be located at angular points of a rectangle. Then, edge frames 20*a* (hereinafter referred to as "upper edge frames") may be connected to the respective corner connectors 40*a* to define a rectangle, such that the sliding ribs 21' and 21" of the edge frames 20*a* may be inserted into the sliding rail grooves 31 of the respective side case panels 30. In this case, one case panel 30 (hereinafter referred to as an "upper case panel") may be slidably coupled to the connected upper edge frames 20*a* before connection of a last upper edge frame 20*a*. Thereafter, as the last upper edge frame 20*a* is coupled, assembly of the upper cover 30C forming an upper surface of the module may be completed.

The upper cover 30*c* may be divided, on the basis of the middle frame 20*b*, into the slidably inserted case panel 30, and an air suction opening panel 3*a* having an opening, that is, the suction opening 3, to communicate with an air suction duct (not shown) provided for suction of indoor air from an air conditioning object space. The air suction opening panel 3*a* may be coupled in the same manner as coupling of the case panel 30, and a rim of the air suction opening panel 30*a* may be screwed to the upper cover 30*c*.

Although the above embodiment has explained the air suction module 100 by way of example, it should be understood that, in the case of the air discharge module 400, the air suction opening panel 3*a* may be replaced with an air discharge opening panel (not shown) having the same shape as the air suction opening panel 3*a*. In addition, although this embodiment has explained an assembly procedure of the air suction module 100 for clarity, it should be understood that the disclosure is not limited to assembly of the air suction module 100, and may be applied to assembly of all of the modules, including the mixing module 200, the heat exchange module 300, and the air discharge module 400.

In the case of the air handler 1 according to one embodiment, the above-described modular assembly procedure may be performed outside of a building where the air handler will be installed and constructed, or at a parts or components factory. For example, with reference to FIG. 8, the air handler 1 may be transported in a modular manner from a place where each module is assembled to a building where the air handler will be installed and constructed, or from the outside of a building to a machine room of the building where the air handler will be installed, using short distance transportation, such as a forklift M, or long distance transportation, such as a truck. As such, in the case of one embodiment, the air suction module 100, the mixing module 200, the heat exchange module 300, and the air discharge module 400, which may be provided to complete a single air conditioning cycle, may be assembled, respectively, outside of a building where the air handler 1 will be installed and constructed and then transported, respectively, to the building. This may ensure easy transportation, prevention of missing parts or components, and assembly convenience.

However, according to one embodiment, it should be understood that modular assembly and transportation of the air suction module 100, the mixing module 200, the heat exchange module 300, and the air discharge module 400 are not absolutely necessary, and at least two modules among the modules 100 to 400 may be separately assembled, and thereafter, transported together in a coupled state. In this case, it should be understood that the two modules may be neighboring modules for natural formation of flow paths of conditioned air for an air conditioning cycle.

Meanwhile, with reference to FIG. 8, assuming that the air suction module 100 is transported using short distance transportation, such as the forklift M, a support carrier B may be disposed below the air suction module 100 to assist the forklift M in easily vertically lifting the air suction module 100. In addition, it should be understood that auxiliary lifters ML' may be fitted to lifters ML of the forklift M when the lifters ML are shorter than an overall length of the air suction module 100.

Figure 9A:
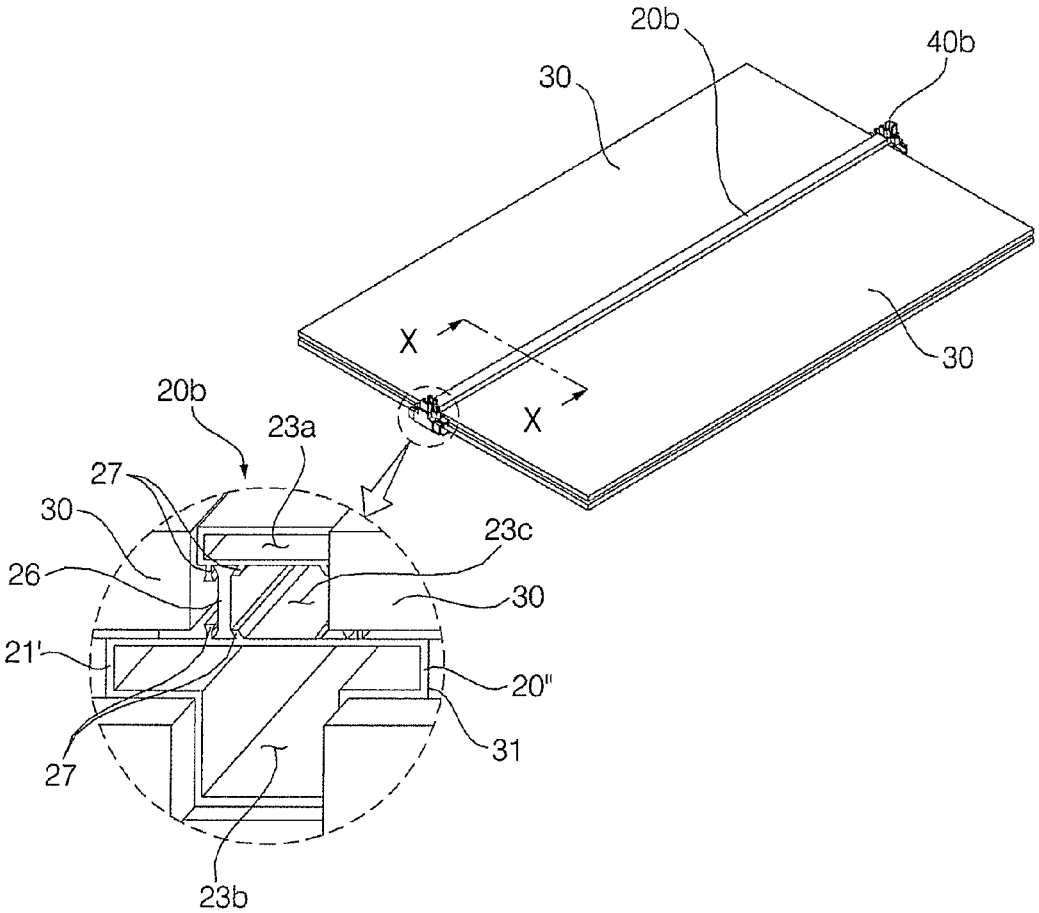
FIGS. 9A to 9C are exploded perspective views and partial enlarged perspective views showing a connected form of case panels to a middle frame, among the modules frames of FIG. 5.
Figure 9B:
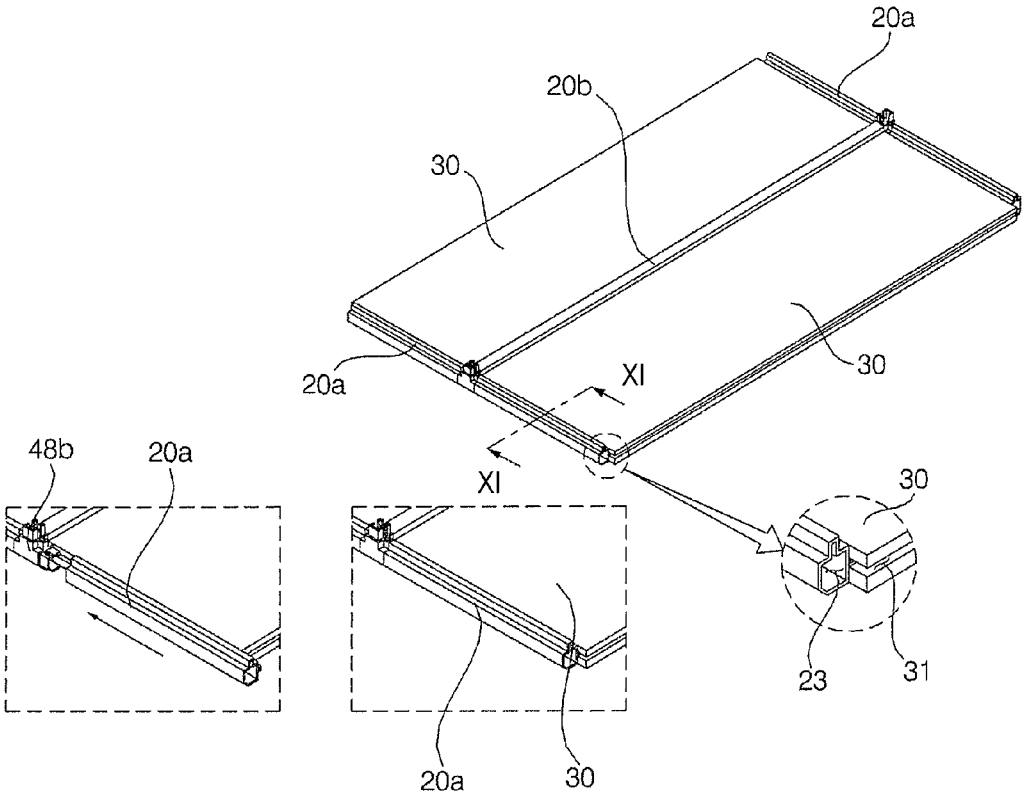
Figure 9C:
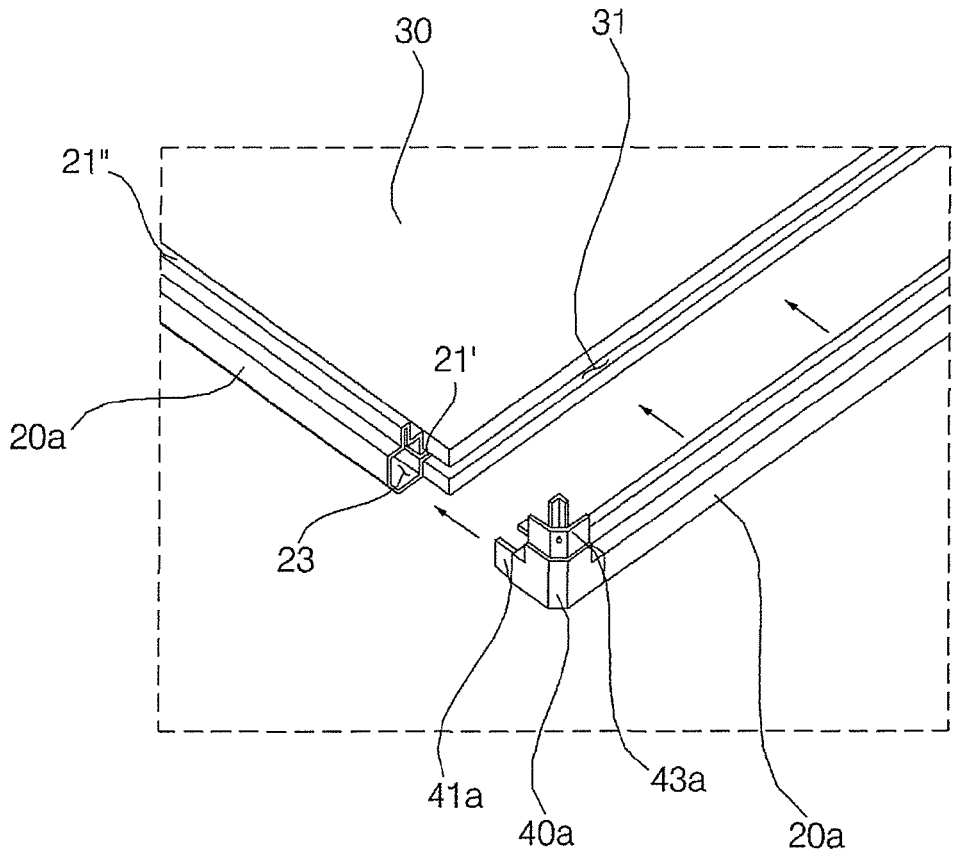
Figure 10:
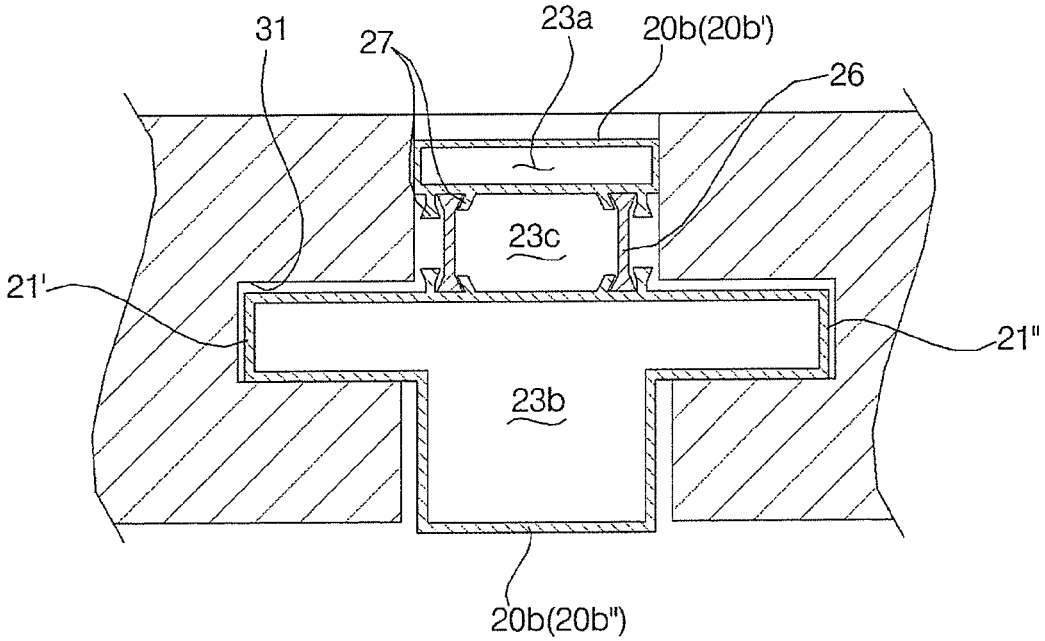
FIG. 10 is a sectional view taken along line X-X of FIG. 9A.
Figure 11A:
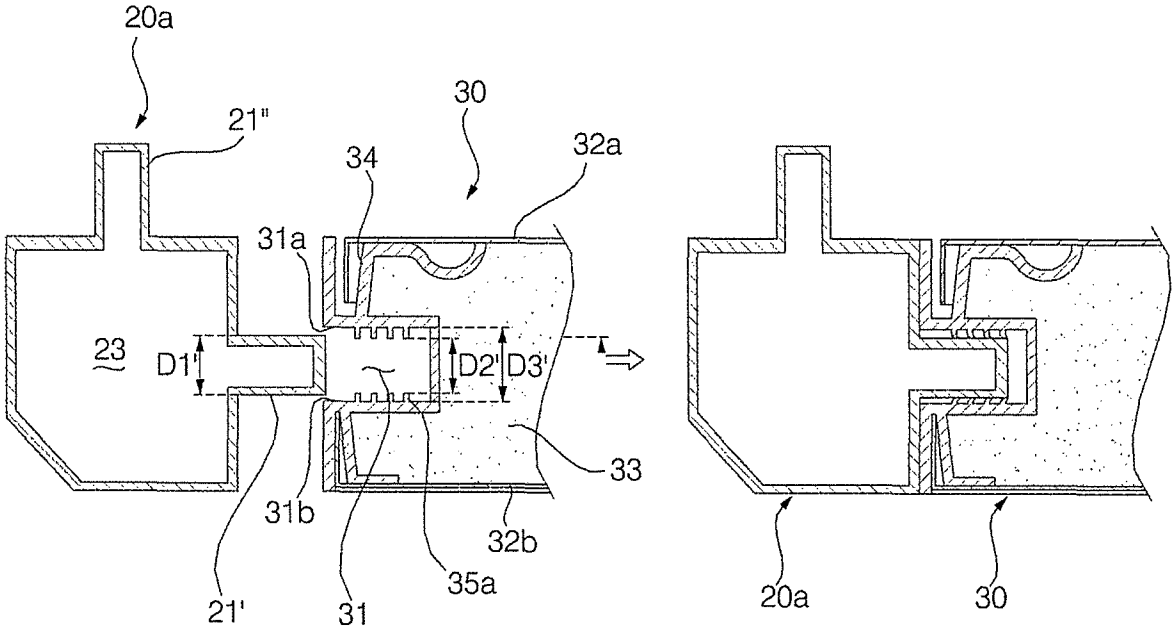
FIGS. 11A and 11B are sectional views, taken along line XI-XI of FIG. 9B, showing examples of various sealing portions between an edge frame among the module frames and a case panel.
Figure 11B:
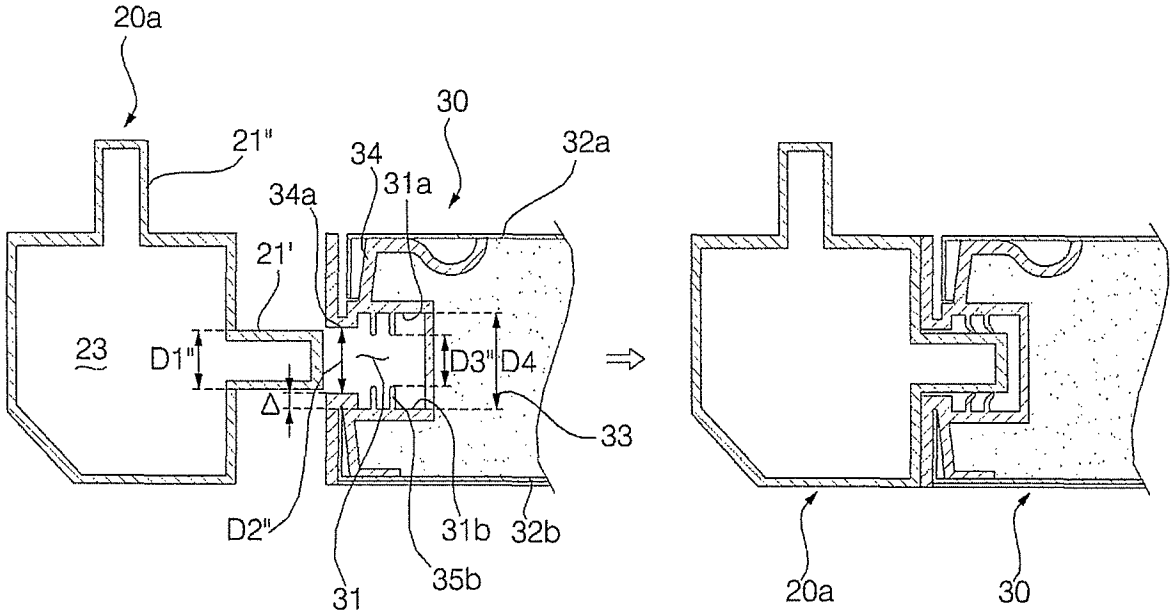

FIGS. 9A to 9C are exploded perspective views and partial enlarged perspective views showing a connected form of case panels to a middle frame, among the modules frames of FIG. 5. FIG. 10 is a sectional view taken along line X-X of FIG. 9A. FIGS. 11A and 11B are sectional views, taken along line XI-XI of FIG. 9B, showing examples of various sealing portions between an edge frame among the module frames and a case panel.

The assembly example of the module as described above with reference to FIGS. 7A to 7F is given by way of example, and the module frames 20 and the case panels 30 forming each module may be assembled in a form that will be described below with reference to FIGS. 9A to 9C. More specifically, a pair of case panels 30 may be arranged, respectively, at horizontal opposite sides of the middle frame 20*b* that extends along a middle portion of the lower cover 30*a* forming a lower surface of the module. The middle frame 20*b* may be provided at horizontal opposite sides thereof with a pair of sliding ribs 21' and 21" to be inserted into the sliding rail grooves 31 formed in rims of the case panels 30.

In consideration of a case in which one case panel 30 is vertically coupled to a top of the middle frame 20*b*, the middle frame 20*b* may be further provided with one sliding rib (not designated by reference numeral) to be inserted into the sliding rail groove 31 formed in a rim of the vertically coupled case panel 30. As such, the middle frame 20*b* may be provided with three sliding ribs 21' and 21".

Although the case of the lower cover 30*a* has been described above, it should be understood that the description may be equally applied even to a case in which the middle frame 20*b* is provided at the side cover 30*b* or the upper cover 30*c*.

Another example of an assembly method using the module frames 20, the case panels 30, and the connecting members 40 having the above-described configuration will be described hereinbelow.

First, with reference to FIGS. 9A to 9C, the module frames 20 and the connecting members 40 may be assembled with one another to form a framework of a rim of the lower cover 30*a*. Although the module frames 20, more particularly, the edge frames 20*a* may be assembled with one another using only the corner connectors 40*a* to form the simple rectangular framework, in some cases, the middle frames 20*b* and the middle connectors 40*b* may be additionally used to bisect the rectangular framework. In particular, according to one embodiment, rigidity of the entire module may be enhanced as the middle frame 20*b* may be used to divide the relatively long edge frame 20*a* into two members.

Among the module frames 20 forming the framework of the rim of the lower cover 30*a* as described above, any one edge frame 20*a* may be omitted to open one side of the framework as exemplarily shown in FIGS. 7A to 7F. This may serve to allow sliding coupling between the sliding ribs 21' and 21" of the module frames 20 and the sliding rail grooves 31 formed in the rim of the lower cover 30*a*. Thereby, as the lower cover 30*a* may horizontally slide through the open side of the framework, the sliding ribs 21' and 21" may be inserted into the sliding rail grooves 31. However, it should be understood that sliding coupling the case panel 30 to the module frames 20 may not be absolutely necessary, and conversely, with reference to FIGS. 9A to 9C, sliding coupling may be performed in such a way that the sliding ribs 21' and 21" of the module frames 20 may be fitted into the sliding rail grooves 31 of the case panel 30.

The air handler 1 according to one embodiment may be assembled by mixing the above-described two sliding coupling methods, and provide diversity of assembly to allow an assembler to select a best method to improve assembly efficiency in consideration of an assembly environment on site or propensity of the assembler.

In the related art, upon installation of an air handling unit or air handler, which is a relatively large structure installed in a building, to firmly install frames forming the overall framework of the air handler, it was essential to fasten a lot of screws between the frames and case panels. This screw fastening involves an excessive number of assembly operations for coupling of the respective screws, and results in reduction in rigidity of the entire unit and deterioration of sealing performance when the fastened screws work loose by variation in interior air pressure during operation of the air handler.

According to one embodiment of the air handler 1, except for screw fastening between the module frames 20 and the connecting members 40, coupling between the module frames 20 and the case panels 30 may be performed via sliding coupling without using screws, which may considerably reduce a number of assembly operations using screws and prevent deterioration of rigidity in screw fastening regions.

Meanwhile, in the air handler according to embodiments, it is very important to prevent leakage of air from the air handler to the outside. This is because leakage of conditioned air reduces an interior pressure of the air handler, thus causing pressure loss and deteriorating overall air conditioning performance.

In the related art, a plurality of frames is coupled to one another to form the framework of an air handler via screw fastening or welding, and an inconvenient sealing operation to isolate an interior of the air handler from the outside must be performed after fitting case panels into openings corresponding to a shape of the case panels. More specifically, in the related art, for primary sealing, a rim of each case panel is wrapped using electrical insulating tape prior to fitting the case panel into the opening. Then, for secondary sealing, a sealant, such as silicon, is applied to a gap between the case panel and the opening.

One embodiment of the air handler 1 proposes to provide a sliding coupling structure between the module frames 20 and the case panels 30 with a sealing structure capable of preventing leakage of conditioning air from the interior of the module to the outside and preventing heat transfer from the interior of the module to the outside.

First, as exemplarily shown in FIGS. 6A and 6B, sealing pads 47 may be interposed, respectively, between the inserting ends 41*a*, 42*a*, and 43*a* of the corner connector 40*a* and ends of the module frames 20. The sealing pads 47 may be configured to come into close contact with the module frames 20 and the corner connector 40*a* upon coupling of the module frames 20 and the corner connector 40*a*, thereby serving to block gaps between the module frames 20 and the corner connector 40*a* to prevent leakage of air from the module.

With reference to FIG. 6A, each of the sealing pads 47 may have an end penetration hole 48*a* for penetration of the inserting end 41*a*, 42*a*, or 43*a* of the corner connector 40*a*. As such, the sealing pad 47 may completely seal a gap between the module frame 20 and the corner connector 40*a* except for a space for penetration of the inserting end 41*a*, 42*a*, or 43*a*. In addition, the sealing pad 47 may have a through hole 48 having a same shape as the hollow end 23 of the module frame 20 to prevent the end of the module frame 20 from coming into contact with the corner connector 40*a*. In a case in which the module frame 20 and the corner connector 40*a* are formed, respectively, of a metallic material having high thermal conductivity, the sealing pad 47 may also serve to prevent leakage of energy by reducing high metal-to-metal thermal conductivity.

It should be understood that, in addition to the corner connector 40*a*, the sealing pad 47 may be interposed between the middle connector 40*b* and the middle frame 20*b*, or between the middle connector 40*b* and the edge frame 20*a*. The sealing pad 47 may be fitted to each inserting end 41*a*, 42*a*, or 43*a* (41*b*, 42*b*, or 43*b*) of the connecting member 40, thereby assisting the inserting end 41*a*, 42*a*, or 43*a* (41*b*, 42*b*, or 43*b*) of the connecting member 40 in being sealed upon insertion into the end of the module frame 20.

Through one embodiment of the air handler 1, additional sealing operation except for sliding coupling between the module frames 20 and the case panels 30 may be unnecessary.

With reference to FIG. 10, the middle frame 20*b* may have a heat transfer barrier 26 to prevent transfer of heat from an interior of the module to the outside. The heat transfer barrier 26 may have not only a heat transfer prevention function, but also a general sealing function to prevent leakage of air by coming into close contact with an outer end surface of the sliding rail groove 31 of the case panel 30. More specifically, with reference to FIG. 10, the middle frame 20*b* may include a first frame 20*b*' arranged close to an inner space of the module, the first frame 20*b*' forming a first hollow region 23*a* having a closed cross section, and a second frame 20*b*" spaced from the first frame part 20*b*' by a predetermined distance and arranged close to the outside of the module, the second frame 20*b*" forming a second hollow region 23*b* having a closed cross section. The heat transfer barrier 26 may be a connector that interconnects the first frame 20*b*' and the second frame 20*b*".

The sliding ribs 21' and 21" may be formed at the second frame 20*b*" having the second hollow region 23*b*, and the first frame 20*b*' may have a sliding rib (not shown) corresponding to the above-described sliding rib, so as to be fitted into the sliding rail groove 31 of the case panel 30, which may be provided to cross the inner space of the module as needed.

The heat transfer barrier 26 may include a pair of connectors that interconnect the first frame 20*b*' and the second frame 20*b*" to form a third hollow region 23*c* having a closed cross section between the first frame 20*b*' and the second frame 20*b*". The first frame 20*b*' and the second frame 20*b*" of the middle frame 20*b* may be formed of a metallic material including aluminum or steel in consideration of rigidity of the framework of the module. The heat transfer barrier 26 may be formed of polyamide. As is well known in the art, polyamide is an electrical insulating material and may serve to minimize a heat transfer structure by preventing the metallic case panel 30 from coming into contact with the metallic middle frame 20*b* upon sliding coupling of the case panel 30 and the middle frame 20*b*.

Generally, a thin air layer not causing convection is well known as a highly excellent heat insulating layer. The first to third hollow regions 23*a*, 23*b*, and 23*c* formed in the middle frame 20*b* may serve as heat insulating layers that cause minimum air convection as long as there are no special circumstances. In addition, the first to third hollow regions 23*a*, 23*b*, and 23*c* may serve not only to reduce a weight of the middle frame 20*b*, but also to provide the middle frame 20*b* with protruding portions to increase a perimeter of the entire middle frame 20*b*, which may increase transverse rigidity of the middle frame 20*b*.

In particular, the first to third hollow regions 23*a*, 23*b*, and 23*c* may be arranged in sequence from an inner side to an outer side of one middle frame 20*b*, thereby serving to extremely minimize transfer of heat from the interior of the module to the outside. The heat transfer barrier 26 may be interposed between the metallic first frame 20*b*' and the metallic second frame 20*b*", respectively, located close to the inner space of the module and the outside of the module, thereby serving to interconnect the frames 20*b*' and 20*b*" and to minimize heat transfer.

The first frame 20*b*' and the second frame 20*b*" may have retaining portions 27 by which ends of the heat transfer barrier 26 may be caught. More specifically, both ends of the heat transfer barrier 26 may be arranged to come into contact with facing surfaces of the first frame 20*b*' and the second frame 20*b*" and have a triangular cross section, one side of which may come into surface contact with the corresponding retaining portion. The retaining portions 27 may be arranged at both sides of each end of the heat transfer barrier 26 to surround the end of the heat transfer barrier 26, thereby serving to firmly grip and secure the end of the heat transfer barrier 26. Although the heat transfer barrier 26 may be coupled to the first frame 20*b*' and the second frame 20*b*" via, for example, fitting or welding, embodiments are not limited by the aforementioned coupling method.

Meanwhile, with reference to FIGS. 11A and 11B, each of the case panels 30 may include an inner plate 32*a* forming an inner surface of the module, an outer plate 32*b* outwardly spaced substantially in parallel from the inner plate 32*a* by a predetermined distance to form an outer surface of the module, a joint member 34 to finish of ends of the inner plate 32*a* and the outer plate 32*b* along rims thereof, and a heat insulating material 33 filled between the inner plate 32*a* and the outer plate 32*b*.

The inner plate 32*a* and the outer plate 32*b* may be formed of a metallic material in consideration of rigidity of the entire module. The heat insulating material 33 filled between the inner plate 32*a* and the outer plate 32*b* may serve to prevent conditioned air from radiating heat to the outside. The heat insulating material 33 may be polyurethane (PU) foam.

A thickness of the case panel 30 corresponding to a distance between the inner plate 32*a* and the outer plate 32*b* may be set to an appropriate value in consideration of a volume of the entire air handler 1 and heat insulation effects of the heat insulating material 33.

According to one embodiment of the air handler 1, assembly of each module may be completed in a simplified manner using only sliding coupling between the module frames 20 and the case panels 30 without requiring complicated screw fastening and welding of the related art, and the above-described additional sealing operation may be unnecessary. Accordingly, assembly of the air handler 1 may be accomplished in a simplified manner by a few assemblers and with a reduced number of assembly operations.

According to one embodiment of the air handler 1, the case panel 30, as described above, may include the metallic inner plate 32*a* forming an inner surface of the module, the metallic outer plate 32*b* substantially outwardly spaced in parallel from the inner plate 32*a* by a predetermined distance to form an outer surface of the module, the joint member 34 for finishing of ends of the inner plate 32*a* and the outer plate 32*b* along rims thereof, and the heat insulating material 33 filled between the inner plate 32*a* and the outer plate 32*b*. The sliding rail groove 31, into which the sliding rib 21' or 21" of each of the module frames 20 may be slidably fitted, may be formed in the joint member 34 of the case panel 30. The joint member 34 may be formed of a non-metallic material having low thermal conductivity, and may be formed of an easily moldable synthetic resin material, such as plastic. The sliding rail groove 31 may be formed throughout the rim of the case panel 30, and may have an approximately "⊂"-shaped cross section so as to be indented to allow insertion of the sliding rib 21' or 21" therein.

In addition, with reference to FIGS. 11A and 11B, the case panel 30 may further include sealing portions 35*a* and 35*b* to prevent leakage of air from a gap between the module frame 20, more particularly, the edge frame 20*a*, and the case panel 30 upon sliding coupling of the case panel 30 and the edge frame 20*a*. The sealing portions 35*a* and 35*b* may be formed in the sliding rail groove 31 and may be integrally formed with the joint member 34 by, for example, injection molding.

More specifically, with reference to FIG. 11A, the sliding rail groove 31, as described above, may have a "⊂"-shaped cross section, one end of which may be open for insertion of the sliding rib 21' or 21" of the edge frame 20*a* thereinto, and the sealing portions 35*a*, 35*b* may, respectively, protrude from a first surface 31*a* and a second surface 31*b*, adjacent to the open end of the sliding rail groove 31, toward opposite surfaces by a predetermined consistent length.

A thickness D1' of the sliding rib 21' or 21" of the edge frame 20*a* may be less than a width D3' of the sliding rail groove 31 of the case panel 30 and greater than at least a distance D2' between tip ends of the sealing portions 35*a* that protrude from the opposite surfaces of the sliding rail groove 31. In such a state, when the sliding rib 21' or 21" of the edge frame 20*a* is inserted into the sliding rail groove 31 of the case panel 30, the sliding rib 21' or 21" may be inserted into the sliding rail groove 31 so as not to come into contact with the sliding rail groove 31, and the sealing portions 35*a* may hermetically come into close contact with an outer surface of the sliding rib 21 or 21", resulting in enhanced sealing performance. That is, the sealing portions 35*a* may, respectively, protrude from the first surface 31*a* and the second surface 31*b* of the sliding rail groove 31 in opposite directions by the predetermined consistent length, and the distance D2' between the tip ends of the respective sealing portions 35*a* may be less than the thickness D1' of the sliding rib 21 or 21" inserted into the sliding rail groove 31.

Alternatively, with reference to FIG. 11B, the sliding rail groove 31 may have a "⊂"-shaped cross section, one end of which may be open for insertion of the sliding rib 21' or 21" of the edge frame 20*a*, a length D2" of the open end 34*a* may be less than a distance D4 between the first surface 31*a* and the second surface 31*b* of the sliding rail groove 31 (see reference letter "Δ" of FIG. 11B), the sealing portions 35*b* may, respectively, protrude from the first surface 31*a* and the second surface 31*b*, adjacent to the open end 34*a* of the sliding rail groove 31, toward the opposite surfaces by a predetermined consistent length, and a distance D3" between the protruding sealing portions 35*b* may be less than the length D2" of the open end 34*a*. That is, the sealing portions 35*b* may, respectively, protrude from the first surface 31*a* and the second surface 31*b* of the sliding rail groove 31 in opposite directions by the predetermined consistent length, and the distance D3" between the tip ends of the respective protruding sealing portions 35*b* may be less than the length D2" of the open end 34*a* of the sliding rail groove 31. The sealing portions 35*b* may protrude, respectively, from the first surface 31*a* and the second surface 31*b* of the sliding rail groove 31 by the predetermined consistent length, and the distance D3" between the tip ends of the respective protruding sealing portions 35*b* may be less than a thickness D1" of the sliding rib 21' or 21" inserted into the sliding rail groove 31.

The sealing portions 35*a* and 35*b* may be integrally formed in the sliding rail groove 31 of the joint member 34 by, for example, injection molding. A portion of the joint member 34, in which the sliding rail groove 31 may be formed, may be formed of a hard material to maintain rigidity of the module. The sealing portions 35*a* and 35*b* may be formed of a soft material, and thus, may be deformed to some extent upon insertion of the sliding rib 21' or 21" of the edge frame 20*a*, thereby coming into close contact with the sliding rib 21' or 21".

According to one embodiment of the air handler 1, as described above, upon sliding coupling of the module frame 20 and the case panel 30, heat insulation performance may be primarily enhanced by the heat insulating material 33 between the metallic inner plate 32*a* and the metallic outer plate 32*b* of the case panel 30, and hermetic sealing performance to prevent leakage of air may be secondarily enhanced by the sealing portions 35*a* and 35*b* of the case panel 30.

Figure 12:
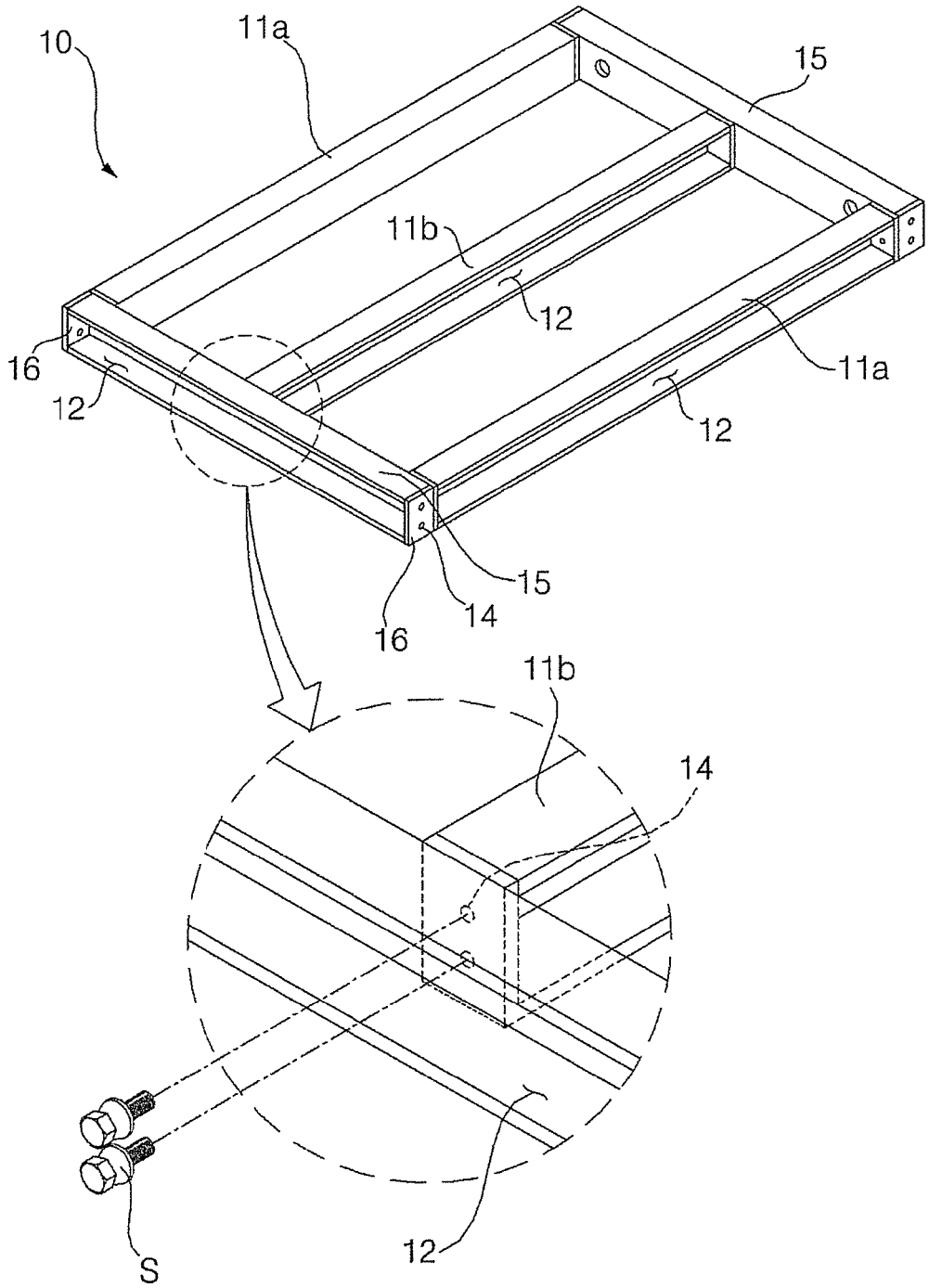
FIG. 12 is a perspective view showing a common base included in each module of FIG. 1.
Figure 13:
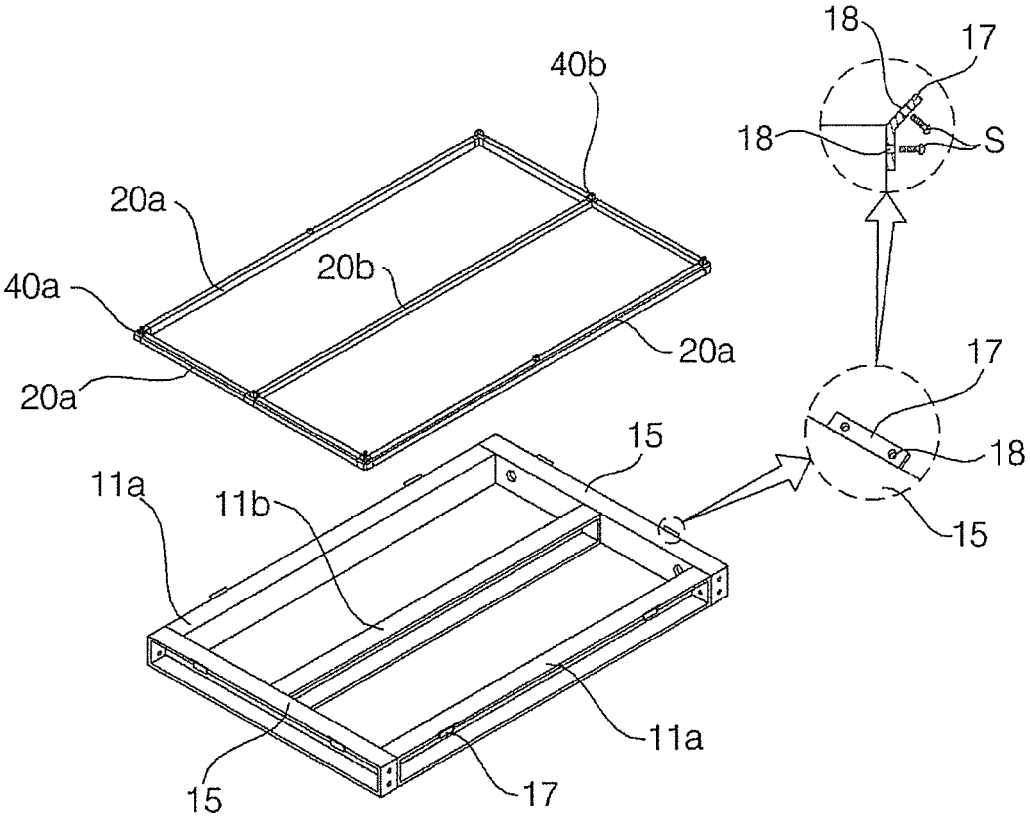
FIG. 13 is an exploded perspective view showing a coupled form of the base of FIG. 12 and a lower cover.
Figure 14:
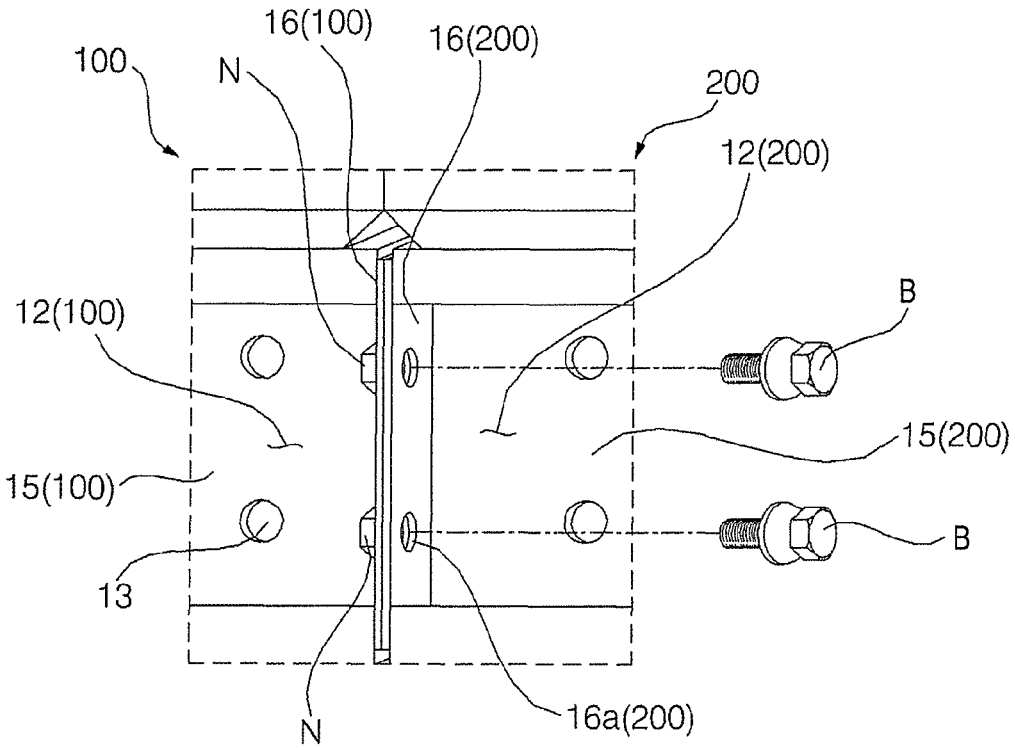
FIG. 14 is a partial perspective view showing a coupled form of modules of FIG. 1 using bases thereof.

FIG. 12 is a perspective view showing a common base included in each module of FIG. 1. FIG. 13 is an exploded perspective view showing a coupled form of the base of FIG. 12 and a lower cover. FIG. 14 is a partial perspective view showing a coupled form of modules of FIG. 1 using bases thereof. FIG. 13 is a partial front view showing a coupled form of modules of FIG. 1 using module frames thereof.

The base 10 may be a lowermost element of the module, and serve to support a weight of the entire module. The base 10 may be a combination of a plurality of base frames 11*a*, 11*b*, and 15. With reference to FIG. 10, the base frames 11*a*, 11*b*, and 15 may be elongated in a longitudinal direction thereof and have a "⊂"-shaped cross section, one longitudinal side of which is open. The base frames 11*a*, 11*b*, and 15 may be arranged such that the open side 12 of each base frame is oriented outward and may be assembled with one another using screws S. The base 10 may have an approximately rectangular shape to allow the rectangular parallelepiped module to be stably disposed thereon, and the one or more base frames 11*a*, 11*b*, and 15 may be arranged substantially in parallel at a center of the base 10 as needed to effectively support any one of modules having various sizes and weights thereon.

The base 10, with reference to FIG. 12, may be assembled such that the open sides 12 of all of the base frames 11*a*, 11*b*, and 15 are oriented outward. This serves to facilitate assembly between the modules, as will be described hereinbelow.

More specifically, the base frames 11*a*, 11*b*, and 15 may have first screw fastening holes 14 formed in both ends thereof for fastening of the screws S. In addition, second screw fastening holes (13, see FIG. 14) corresponding to the first screw fastening holes 14 formed in both ends of the base frames 11*a*, 11*b*, and 15 may be formed in ends of the open sides 12 of the base frames 11*a*, 11*b*, and 15. When the base frames 11*a*, 11*b*, and 15 are assembled with one another to form the rectangular base 10, one side of which may be longer, the base frames 11*a*, 11*b*, and 15 may include first base frames 11*a* forming longer sides, second base frames 15 forming shorter sides, and a middle base frame 11*b* that interconnects the second base frames 15 for rigidity enhancement.

With reference to FIG. 13, the base 10, which may have a rectangular shape via a combination of the base frames 11*a*, 11*b*, and 15, may be provided at an upper end rim thereof with a plurality of mounting brackets 17 spaced apart from one another by a predetermined distance. The plurality of mounting brackets 17 may serve to assist coupling of screws S and the rim of the lower cover 30*a* of the module. It should be understood that the respective mounting brackets 17 may have screw fastening holes 18 to couple the screws S through the lower cover 30*a* and the base 10. Upper ends of the plurality of mounting brackets 17 may be bent to come into surface contact with a slope, which may be formed at a rim of the lower cover 30*a*.

According to one embodiment of the air handler, as described above, after modules for differentiated functions of an air conditioning cycle are completed, respectively, via simplified sliding coupling between the module frames 20 and the case panels 30, as exemplarily shown in FIGS. 1 and 2, the air suction module 100, the mixing module 200, the heat exchange module 300, and the air discharge module 400 may be hermetically coupled to one another to prevent leakage of air while being in communication with one another.

More specifically, with reference to FIG. 14, the base frames 11*a*, 11*b*, and 15 forming the base 10 may have a "⊏"-shaped cross section to form the open side 12, and connection flanges 16 for interconnection of the bases 10 of the respective modules may be formed at both ends of the base frames 11*a*, 11*b*, and 15. The connection flanges 16 of each module may be provided with bolt fastening holes 16*a* that communicates with the open side 12 of each of the base frames 11*a*, 11*b*, and 15. In a state in which the connection flanges 16 of the respective modules come into surface contact with one another, bolts B may penetrate the bolt fastening holes 16*a* and nuts N may be fastened to the bolts B to interconnect the respective modules. Although the bolt fastening holes 16*a* may be replaced with the above-described screw fastening holes 14, the bolt fastening holes 16*a* may be formed separately from the screw fastening holes 14. In this way, as the modules 100, 200, 300, and 400, which may be respectively assembled on a per function basis, may be arranged in sequence, and the bases 10 of the respective modules interconnected, the air handler 1 according to embodiments capable of forming a single air conditioning cycle may be completed.

Figure 15A:
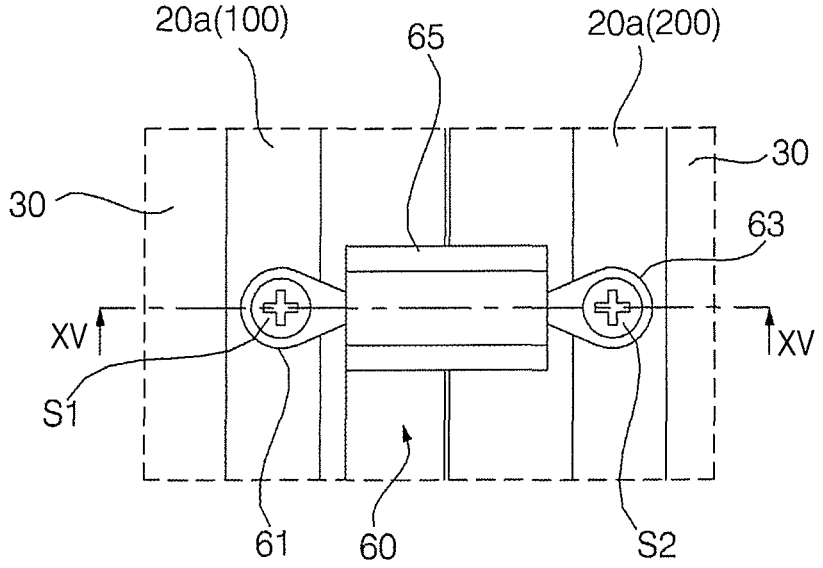
FIG. 15A is a partial front view showing a coupled form of modules of FIG. 1 using module frames thereof.
Figure 15B:
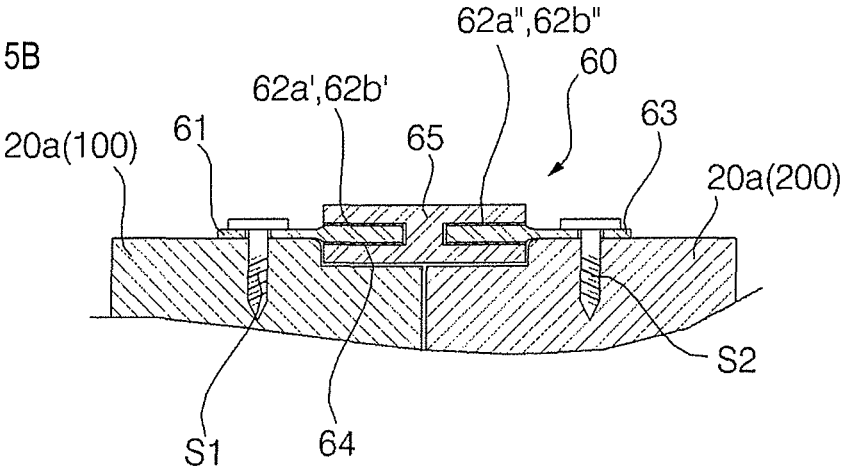
FIG. 15B is a cross-sectional view, taken along line XV-XV of FIG. 15A.

The air handler 1 according to embodiments, as described above, has a risk of leakage of air through gaps between the modules because the modules are individually assembled and then connected to one another. To prevent this, the air handler 1 according to embodiments, with reference to FIGS. 15A-15B, may further include connecting clamps 60. A first module connection end 61 of each connecting clamp 60 may be connected to the module frame (for example, the edge frame 20*a*) of one side module 100 (hereinafter referred to as a "first module" for convenience of description), and a second module connection end 63 of the connecting clamp 60 may be connected to the module frame (for example, the edge frame 20*a*) of the other side module 200 (hereinafter referred to as a "second module" for convenience of description). The connecting clamp 60 may include an adjusting nut 65 located between a first end of the first module connection end 61 and a first end of the second module connection end 63. The adjusting nut 65 may have connection holes 64 axially formed in first and second sides thereof such that the end of the first module connection end 61 and the end of the second module connection end 63 may be, respectively, inserted into the connection holes 64. The connecting clamp 60 may serve to prevent generation of a gap between the first module 100 and the second module 200 by the rotatable adjusting nut 65.

The first module connection end 61 and the second module connection end 63 of the connecting clamp 60 may be secured to the respective module frames 20, that is, the edge frame 20*a* of the first module 100 and the edge frame

20*a* of the second module 200. The adjusting nut 65 of the connecting clamp 60, which connects the first module connection end 61 and the second module connection end 63 to each other and is rotatable, may be selectively rotated in a given direction or in an opposite direction to adjust a distance between the first module connection end 61 and the second module connection end 63. As such, the connecting clamp 60 may prevent a gap between the modules 100 and 200.

More specifically, the first module connection end 61 of the connecting clamp 60 may be secured to the edge frame 20*a* of the first module 100 via screw S1 and the second module connection end 63 of the connecting clamp 60 may be secured to the edge frame 20*a* of the second module 200 via screw S2.

The first module connection end 61 and the second module connection end 63 of the connecting clamp 60 may be provided at the second ends thereof with machined male threads 62*a*' and 62*a*", and the second ends of the end 61 and 63 provided with the male threads 62*a*' and 62*a*" may be inserted into the side connection holes 64 of the adjusting nut 65, respectively. The connection holes 64 of the adjusting nut 65 may be provided with female threads 62*b*' and 62*b*" for screwing with the first module connection end 61 and the second module connection end 63 of the connecting clamp 60.

The male threads 62*a*' and 62*a*" formed on the first module connection end 61 and the second module connection end 63 of the connecting clamp 60, and the female threads 62*b*' and 62*b*" formed in the adjusting nut 65 may have a given helical direction to cause the first module connection end 61 and the second module connection end 63 of the connecting clamp 60 to approach each other when the adjusting nut 65 is rotated in a given direction and to move away from each other when the adjusting nut 65 is rotated in an opposite direction.

The first module connection end 61 and the second module connection end 63 may be flat to come into surface contact with the edge frame 20*a* of the first module 100 and the edge frame 20*a* of the second module 200. In addition, although the first module connection end 61 and the second module connection end 63 have been described above as being coupled using the screws S1 and S2, coupling is not absolutely limited to this screwing and the first module connection end portion 61 and the second module connection end portion 63 may be coupled by, for example, bolting.

The adjusting nut 65 may have at least two parallel faces so as to be easily fastened by a fastening tool, such as a spanner, or a monkey driver, and may have a hexagonal cross sectional shape.

The connecting clamps 60 may be installed in an inner space of each module 100 or 200 and spaced apart from one another along rims of the neighboring modules 100 and 200, thereby exerting uniform tightening force to prevent leakage of air.

Figure 16A:
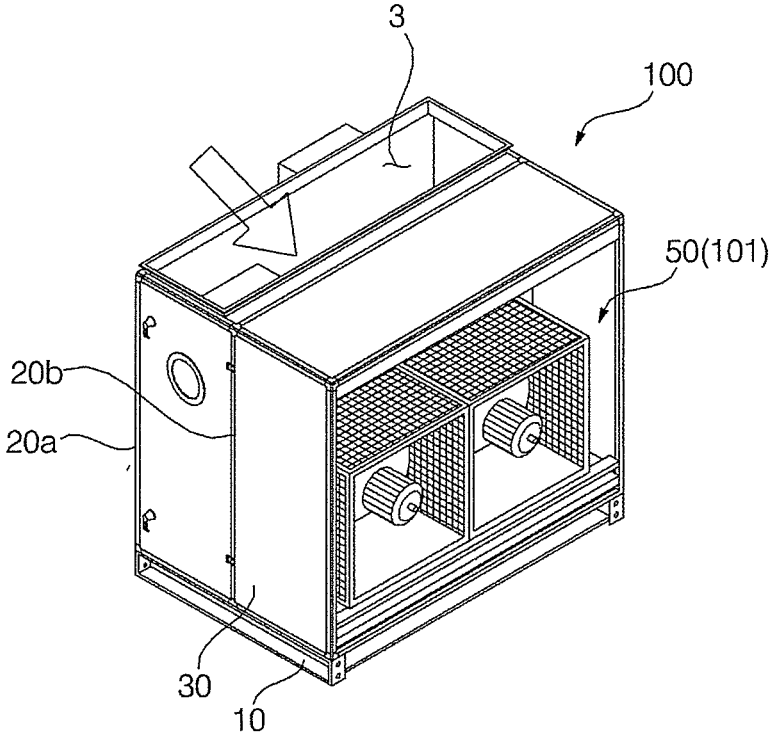
FIGS. 16A-16B are perspective views showing an air suction module and an air discharge module of FIG. 1, both of which are configured to receive a fan module.
Figure 16B:
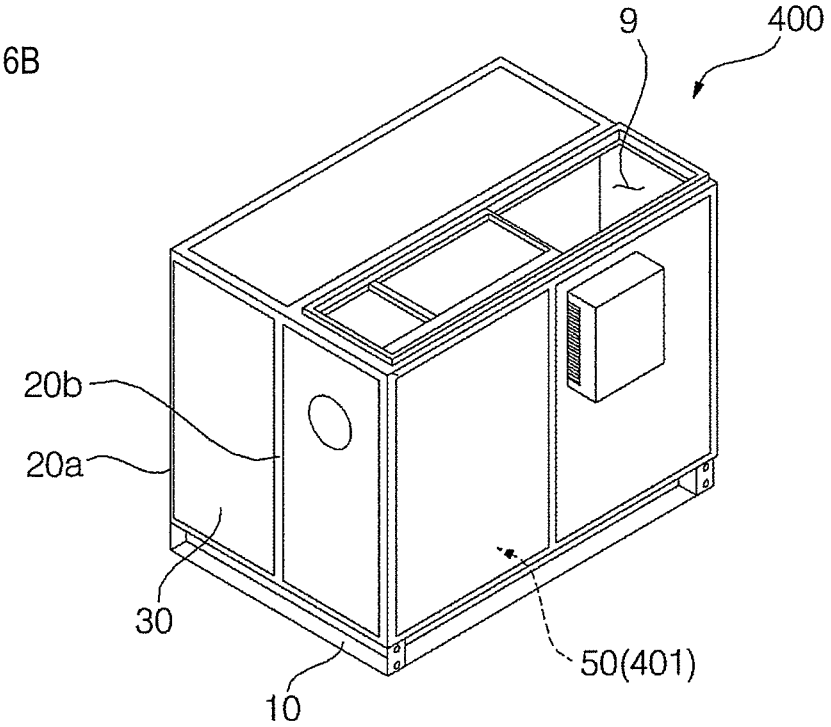
Figure 17A:
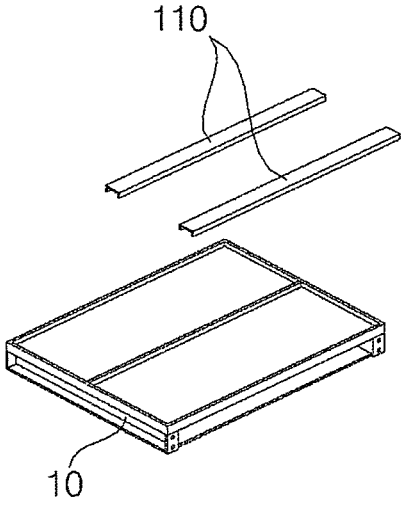
FIGS. 17A-17B are perspective views showing a preparation operation to install a fan module to a base.
Figure 17B:
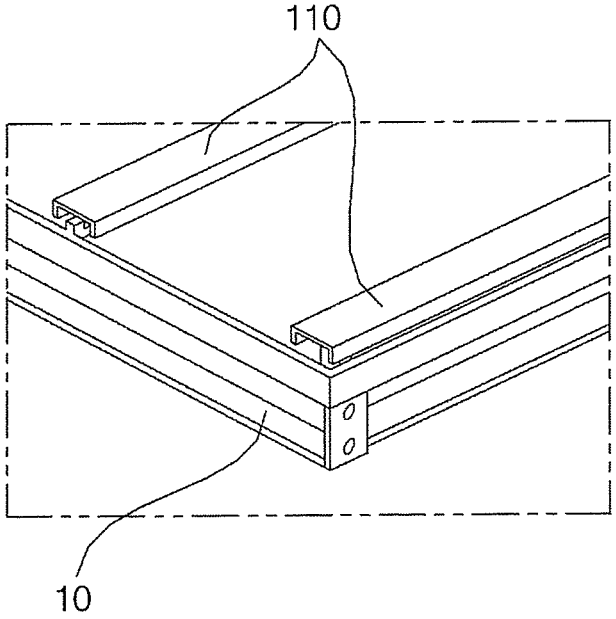
Figure 18:
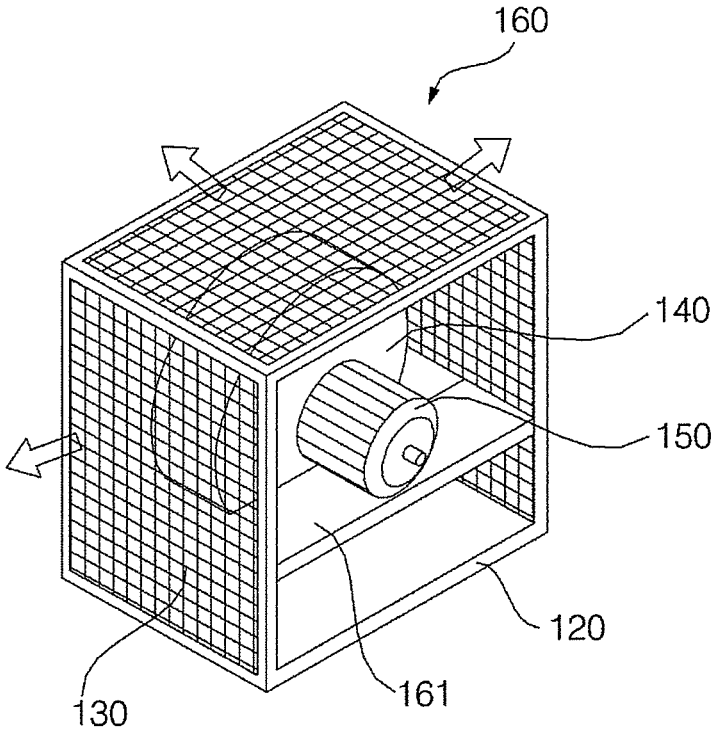
FIG. 18 is a perspective view of the fan module of FIGS. 16A-16B.
Figure 19:
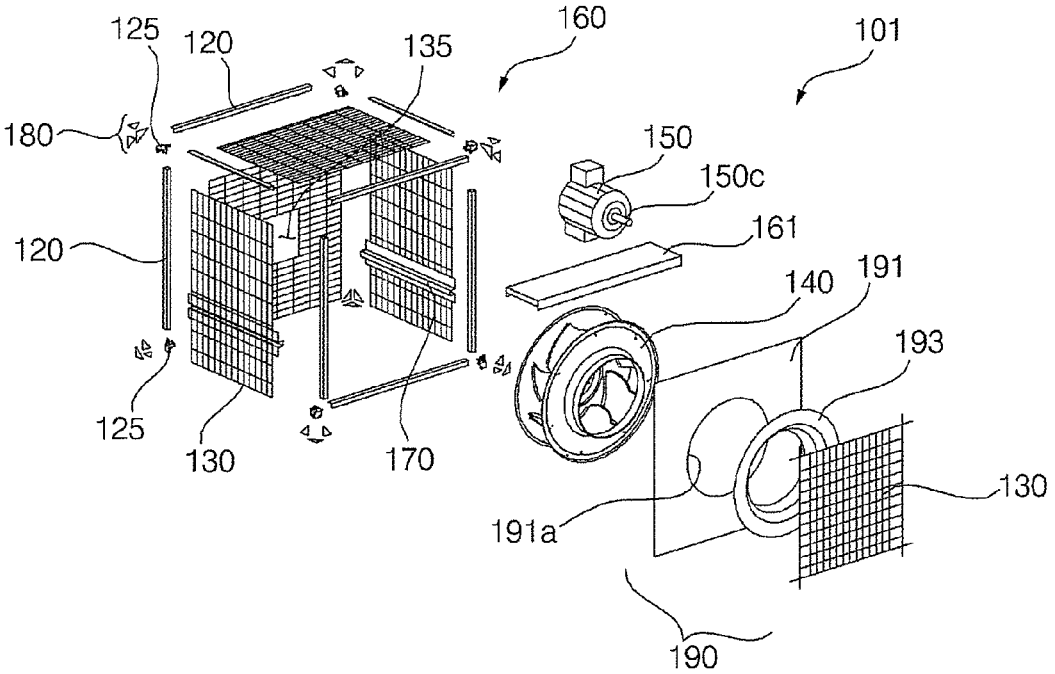
FIG. 19 is an exploded perspective view of the fan module of FIG. 18.
Figure 20:
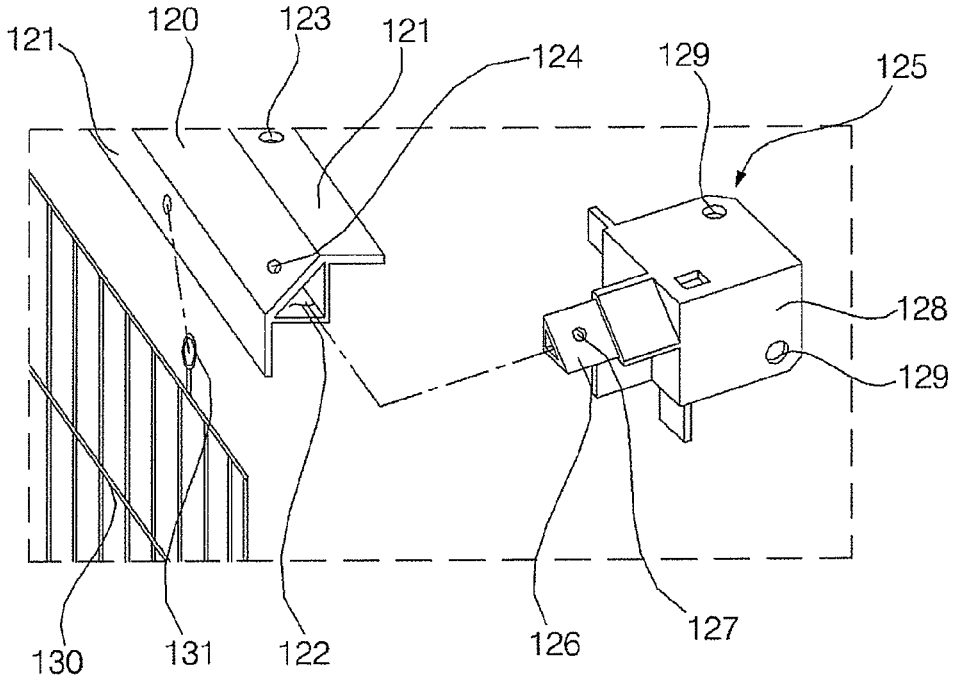
FIG. 20 is an exploded perspective view showing an installation relationship between a box frame, a box frame connector, and a safety net of the fan module of FIG. 18.
Figure 21:
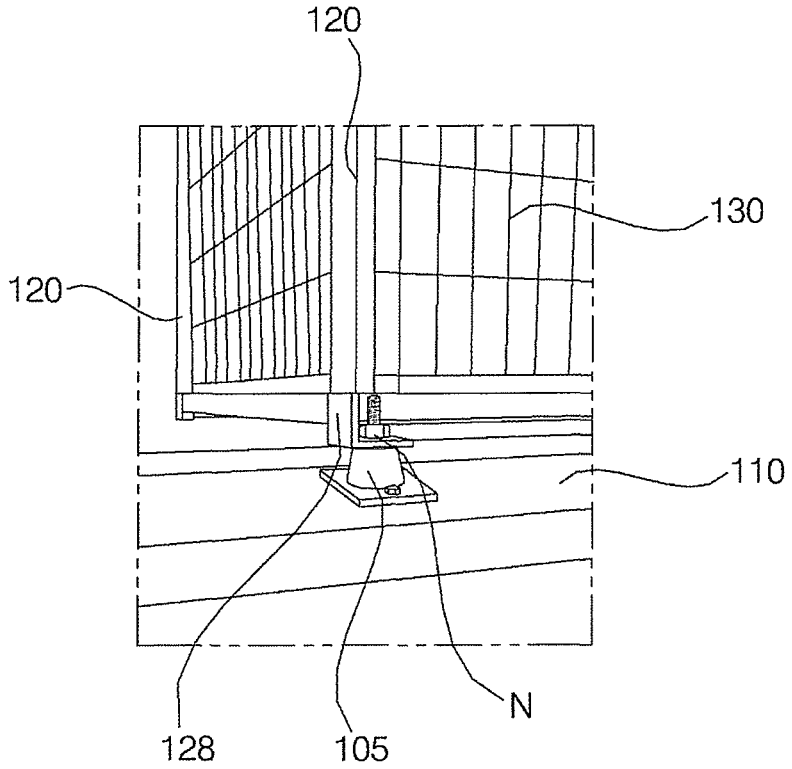
FIG. 21 is a perspective view showing a coupled form of the fan module of FIG. 18 and a lower cover.
Figure 22:
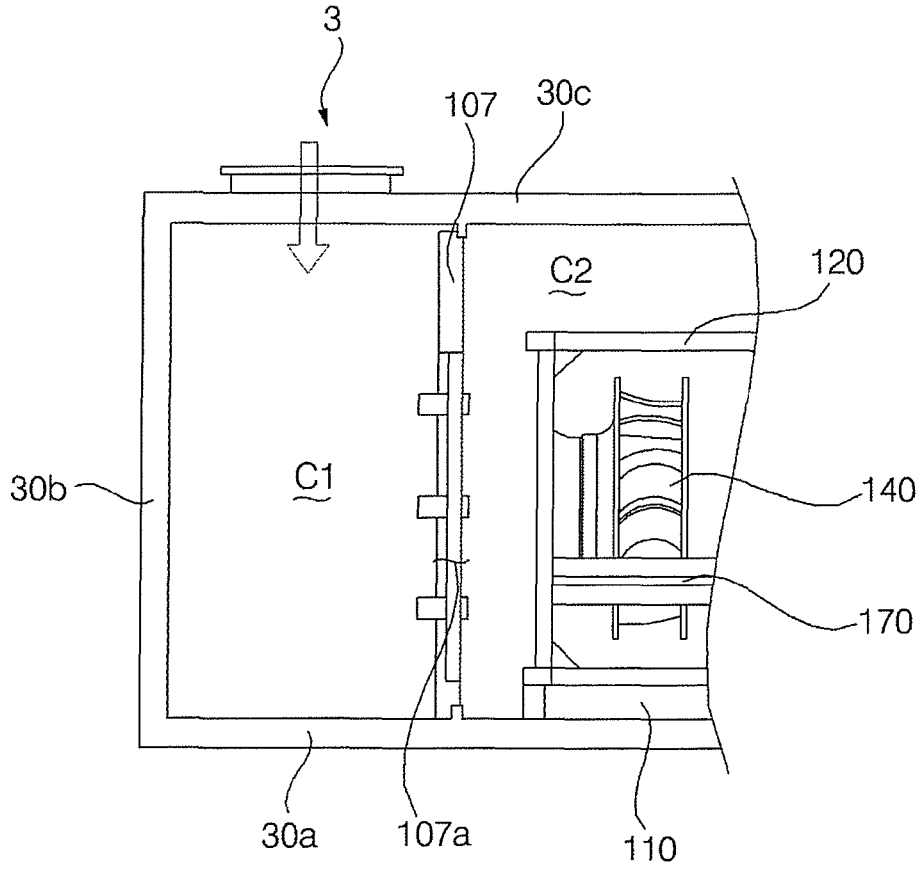
FIG. 22 is a partial sectional view showing an interior of the air suction module or the air discharge module according to embodiments, which may be divided into an air suction chamber and a centrifugal chamber by a separation partition.
Figure 23:
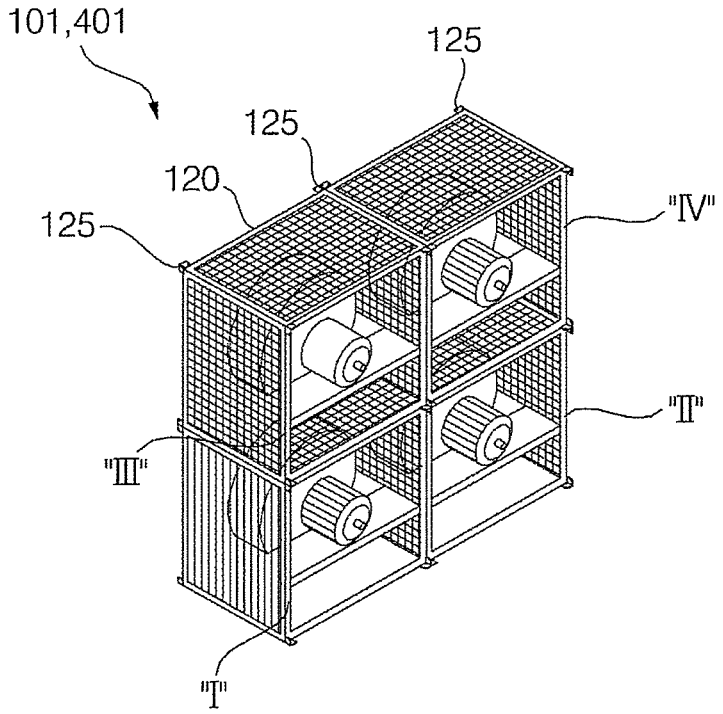
FIG. 23 is a perspective view showing a stacked installation form of fan modules according to embodiments.

FIGS. 16A-16B are perspective views showing an air suction module and an air discharge module of FIG. 1, both of which are configured to receive a fan module. FIGS. 17A-17B are perspective views showing a preparation operation to install a fan module to a base. FIG. 18 is a perspective view of the fan module of FIGS. 16A-16B. FIG. 19 is an exploded perspective view of the fan module of FIG. 18. FIG. 20 is an exploded perspective view showing an installation relationship between a box frame, a box frame connector, and a safety net of the fan module of FIG. 18. FIG. 21 is a perspective view showing a coupled form of the fan module of FIG. 18 and a lower cover. FIG. 22 is a partial sectional view showing an interior of the air suction module or the air discharge module according to embodiments, which may be divided into an air suction chamber and a centrifugal chamber by a separation partition. FIG. 23 is a perspective view showing a stacked installation form of fan modules according to embodiments.

According to one embodiment, the air handler 1, as described above, which may include the air suction module 100 having the suction opening 3 for suction of indoor air and accommodating fan module 101 to move the suctioned indoor air, the mixing module 200 coupled to and in communication with the air suction module 100 and mixing the indoor air supplied from the air suction module 100 and outside air suctioned from the outside, the heat exchange module 300 coupled to and in communication with the mixing module 200 and exchanging thermal energy with the mixed air supplied from the mixing module 200, and the air discharge module 400 coupled to and in communication with the heat exchange module 300 and accommodating the fan module 401 to discharge the heat-exchanged air supplied from the heat exchange module 300 to a room through the discharge opening 9. The components 50 for differentiated functions may be incorporated in inner spaces of the respective modules. The components 50 for differentiated functions may be installed in the most efficient manner in the inner spaces of the respective modules having a standardized shape.

First, the air suction module 100 and the air discharge module 400 will be described hereinbelow in detail with reference to FIGS. 16A to 22.

The air suction module 100 and the air discharge module 400, with reference to FIGS. 16A-16B, may respectively include a suction chamber C1 for suctioning in of air and a centrifugal chamber C2 separated from the suction chamber C1 by a separation partition 107, the fan module 101 or 401 being installed in the centrifugal chamber C2 (see FIG. 22).

The separation partition 107 may be one of the case panels 30 slidably coupled to the middle frame 20*b* in the same manner as the other case panels 30. More specifically, the separation partition 107 may be one of the case panels 30, both ends of which may be vertically slidably inserted into and coupled to the module frames 20 forming the framework of the module. As such, the separation partition 107 may separate the suction chamber C1 and the centrifugal chamber C2 from each other in a direction substantially perpendicular to a flow direction of conditioned air.

The separation partition 107 may be slidably coupled to the module frames 20 located, respectively, between two case panels 30, that is, the middle frames 20*b*. More specifically, the separation partition 107 may be slidably coupled to the middle frame 20*b* on the lower cover 30*a* formed by dividing a lower surface of the module into two sections and may also be slidably coupled between the middle frames 20*b* vertically extending upward from the middle connectors 41*b* located at both ends of the middle frame 20*b* on the lower cover 30*a*.

The separation partition 107 may have a rectangular communication opening 107*a* for communication between the suction chamber C1 at a first side of the separation partition 107 and the centrifugal chamber C2 at a second side of the separation partition 107. The communication opening 107*a* may not be limited to the rectangular shape and may have any of various other shapes.

The separation partition 107 may be mounted on the lower cover 30*a* forming a lower surface of the air suction module 100 or the air discharge module 400. More specifically, the lower cover 30*a* may be formed by two case panels 30 horizontally coupled, respectively, to a first side and a second side of the middle frame 20*b* that crosses a middle portion of the lower cover 30*a* in a direction substantially perpendicular to a flow direction of conditioned air, and the separation partition 107 may be coupled to the lower cover 30*a* such that the sliding rib 21' or 21" protruding upward from the middle frame 20*b* on the lower cover 30*a* may be inserted into the sliding rail groove 31 formed in a lower end of the separation partition 107. In addition, the separation partition 107 may be further provided at both lateral ends thereof with the sliding rail grooves 31, such that the sliding ribs 21' or 21" of the middle frames 20*b* vertically connected to the middle connectors 40*b* at both ends of the middle frame 20*b* on the lower cover 30*a*, may be inserted into the respective sliding rail grooves 31 to allow the separation partition 107 to be slidably coupled to the middle frames 20*b*.

The fan module 101 or 401 accommodated in the centrifugal chamber C2 may be connected to the separation partition 107 through the communication opening 107*a*. The fan module 101 or 401, which may be connected to the separation partition 107 and accommodated in the centrifugal chamber C2, may serve to create centrifugal force by suctioning in air from the suction chamber C1 to the centrifugal chamber C2 and discharging the air to another neighboring module (for example, the mixing module 200) or to the outside.

The fan module 101 or 401, with reference to FIGS. 18 and 19, may include a centrifugal fan 140 to create the aforementioned suction force and centrifugal force, a fan motor 150 to apply torque to the centrifugal fan 140, and a fan box 160 having an installation space for the centrifugal fan 140 and the fan motor 150. The fan box 160 may be located in the centrifugal chamber C2 at one side of the separation partition 107 so as to be spaced from the separation partition 107. The fan box 160 may include a plurality of box frames 120 that form the framework of the fan box 160, and safety nets 130 installed on the box frames 120 to form surfaces of the fan box 160, the safety nets 130 serving to protect rotation of the centrifugal fan 140.

The separation partition 107 and the fan box 160 may be connected to each other to allow air suctioned through the communication opening 107*a* to move to the centrifugal fan 140. That is, the fan box 160 may be coupled to the communication opening 107*a* of the separation partition 107 to allow interior air of the suction chamber C1 to wholly pass through the centrifugal fan 140 installed in the fan box 160 of the centrifugal chamber C2. This will be described hereinbelow in detail.

The fan box 160 may be assembled into a predetermined external appearance of a framework using a box frame connector 125 that interconnects two or more box frames 120 at each corner of the box frame 160. The fan box 160 may have a rectangular parallelepiped shape internally defining a predetermined installation space for the centrifugal fan 140 and the fan motor 150. The box frame connector 125 may be located at each corner of the rectangular parallelepiped frame box 160 to interconnect three box frames 120 substantially perpendicular to one another.

With reference to FIG. 20, the box frames 120 may be, for example, formed of iron, have a triangular hollow section 122, and include extensions 121 substantially parallel to respective surfaces of the fan box 160. A portion 126 of the box frame connector 125 may be inserted into the triangular hollow section 122 so as to overlap a portion of the box frame 120. As screws S are fastened through screw fastening holes 124 and 127 formed, respectively, in the portion 126 of the box frame connector 125 and the overlapped portion of the box frame 120, the box frame 120 and the box frame connector 125 may be assembled with each other.

The box frame connector 125 may have an outwardly extending fan box connection end 128 for connection of neighboring fan modules 101 or 401 when a plurality of fan modules 101 or 401 is stacked one above another or arranged side by side in the centrifugal chamber C2. The fan box connection end 128 may have a "¬"-shaped or "└"-shaped form to extend in substantially vertical and horizontal directions. As such, the fan box connection end 128 may be used to interconnect the fan modules 101 or 401 arranged side by side, as well as the fan modules 101 or 401 stacked one above another. The fan box connection end 128 may have a screw fastening hole 129 to allow a screw S to be fastened through the screw fastening holes 129 of neighboring fan box connection ends 128. The fan box connection end 128 may be integrally formed with the box frame connector 125 and may also be prefabricated separately from the box frame connector 125 and then separably connected to the box frame connector 125 or the box frame 120 as needed.

The safety nets 130 may take the form of a mesh formed, for example, by welding a plurality of iron wires, or by weaving the iron wires to make knots. The safety nets 130 may be coupled to the framework formed by the box frames 120 to form surfaces of the fan box 160, as described above.

The safety nets 130 may function to protect rotation of the centrifugal fan 140 installed in the fan box 160 and rotated at high speeds. In addition, the safety nets 130 may serve to pass air to assist the case panels 30 forming surfaces of the centrifugal chamber C2, rather than a fan housing enclosing the centrifugal fan 140, in guiding movement of air by static pressure generated by rotation of the centrifugal fan 140. This is based on the principle that a predetermined static pressure is generated when the centrifugal fan C2 is filled with moving air. As the safety nets 130 pass air suctioned by the centrifugal fan 140 and movement of the air is substantially guided by the case panels 30 of the module forming the centrifugal chamber C2, a separate fan housing is not necessary.

The safety nets 130 may be coupled to the box frames 120 so as to form surfaces of the rectangular parallelepiped fan box 160 except for a surface of the fan box 160 adjacent to the separation partition 107 and a lower surface of the fan box 160. This is because a fan shield 191, which will be described hereinbelow, may be coupled to the surface of the fan box 160 adjacent to the separation partition 107, and the lower surface of the fan box 160 may not be involved in protection of rotation of the centrifugal fan 140.

With reference to FIG. 20, each safety net 130 may include a plurality of outwardly extending connection rings 131 spaced apart from one another by a predetermined distance along the rim of the safety net 130 so as to be inserted into screw holes 123 formed in the extension 121 of the box frame 120. The connection rings 131 may be formed by bending some of the iron wires into a rounded form, and may also be prefabricated as separate members, and then, may be attached to the rim of the safety net 130. The connection rings 131 may assist installation of the safety net 130 to the box frame 120, as screws S are fastened through the screw holes 123 of the box frame 120. After the safety net 130 is installed to the box frame 120, corner-shaped support members 180 may be coupled to support corners of the fan box 160.

The fan module 101 or 401 having the above-described configuration, with reference to FIGS. 17A-17B, may be installed above the lower cover 30*a* disposed on the base 10 and a pair of fan module brackets 110 mounted on the lower cover 30*a* so as to be spaced apart substantially in parallel from each other by a predetermined distance. The fan module brackets 110 may serve to prevent the fan module 101 or 401 from being directly disposed on the lower cover 30*a* so as to come into contact with the lower cover 30*a*. With reference to FIG. 21, the fan module bracket 110 may be coupled to the fan box connection end 128 of each box frame connector 125 located at a lower end of the fan box 160 with a vibration absorbing block 105 interposed therebetween, which may prevent vibration caused by operation of the centrifugal fan 140 of the fan module 101 or 401 from being directly transmitted to the lower cover 30*a*.

Figure 24:
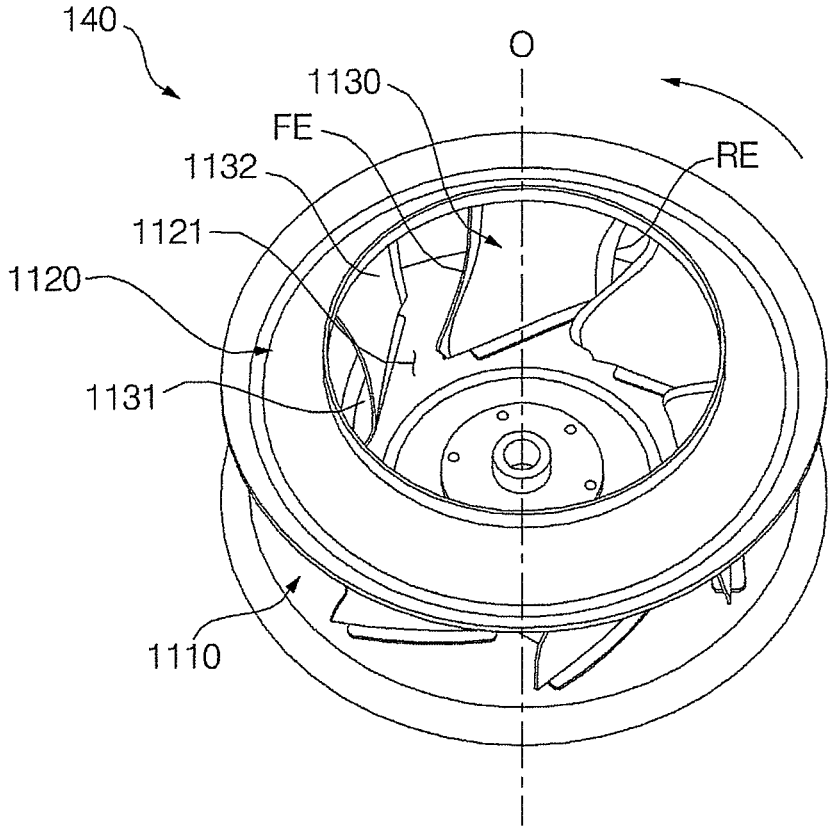
FIG. 24 is a perspective view showing a centrifugal fan of the fan module of FIG. 18.

FIG. 24 is a perspective view showing the centrifugal fan of the fan module of FIG. 18. FIG. 25 is a sectional views showing vertical cross sections of a blade included in the centrifugal fan of FIG. 24.

Generally, the centrifugal fan 140 is a fan that accelerates air introduced in an axial direction through a fan shroud 1120 and discharges the air in a radial direction through gaps between blades 1130 by centrifugal force. Performance of the centrifugal fan 140 may be affected by various shape factors, as well as friction loss, and shock loss, for example.

According to one embodiment of the air handler 1, the centrifugal fan 140, which may be one component of the fan module 101 or 401, may be configured such that an upper portion 1132 of each blade 1130 defines a section that is concave toward a rotational axis O, and a lower portion 1131 of the blade 1130 may define a section that is convex in a direction opposite to the rotational axis O. This shape of the blade 1130 may reinforce airflow at the lower portion 1131 of the blade 1130 and ensure even airflow between the upper and lower portions 1132, 1131 of the blade 1130, which may provide the centrifugal fan 140 with reduced noise generation and greatly enhanced performance in comparison to conventional fans having a same size or volume.

More specifically, the centrifugal fan 140, with reference to FIG. 24, may include a pair of main plates 1110 configured to be rotated about the rotational axis O, the fan shroud 1120 having an air suction hole 1121 and the blades 1130 arranged in a circumferential direction between the main plates 1110 and the fan shroud 1120, such that air suctioned through the suction hole 1121 moves from front edges FE to rear edges RE of the blades 1130.

Figure 25A:
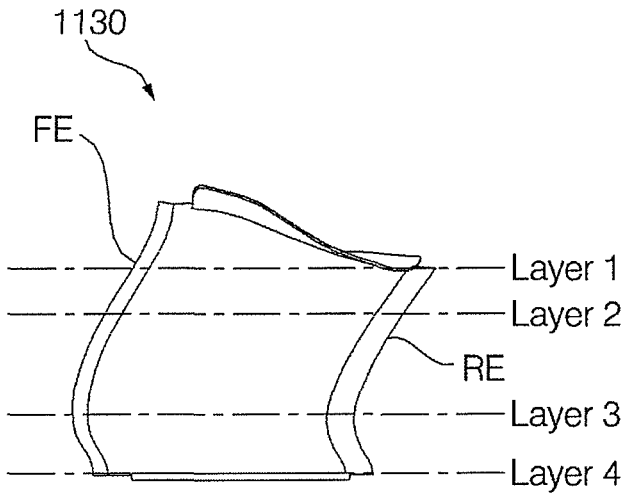
FIG. 25A-25B are sectional views showing vertical cross sections of a blade included in the centrifugal fan of FIG. 24.
Figure 25B:
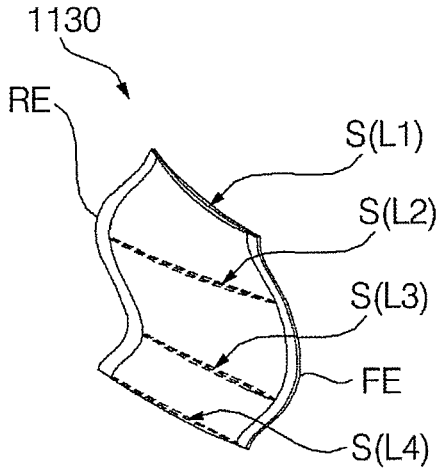

With reference to FIGS. 25A-25B, assume that layers Layer 1 to Layer 4 of each blade 1130, taken in sequence from the fan shroud 1120 to the main plates 1110, have a first cross section S(L1), a second cross section S(L2), a third cross section S(L3), and a fourth cross section S(L4). In this case, a front edge of the first cross section S(L1) may be farther from the rotational axis O than a front edge of the fourth cross section S(L4), a rear edge of the first cross section S(L1) may be closer to the rotational axis O than a rear edge of the fourth cross section S(L4). In addition, among rear edges of the respective cross sections, a rear edge of the second cross section S(l2) may be located farthest away from the rotational axis O, and the rear edge of the third cross section S(L3) may be closest to the rotational axis O.

The blades 1130, with reference to FIG. 24, may have a 3D shape. The 3D shape of the blades 1130 may be defined as a shape in which, when cross sections of the blade 1130 taken at predetermined layers corresponding to predetermined planes substantially perpendicular to the rotational axis O are projected onto a predetermined projection plane in a direction of the rotational axis O, two or more lines among lines interconnecting the front edges FE and the rear edges RE of the respective cross sections in the projection plane do not overlap each other.

It was found from experiment that the centrifugal fan 140 having the 3D shape of the blades 1130 as described above has increased static pressure, as well as efficiency depending on a same air volume in comparison to conventional centrifugal fans. More particularly, the centrifugal fan 140 has maximum efficiency up to approximately 82% in comparison to an efficiency of approximately 70% of the related art based on the same air volume. Such enhancement in performance of the centrifugal fan allows the fan to be driven at a lower speed than the related art with respect to the same air volume. In turn, that this lower driving speed is possible means that the air handler 1 according to embodiments may be sufficiently driven by a lower driving load of the fan motor 150 upon high speed driving under the same conditions.

According to one embodiment of the air handler 1, a single fan module 101 or 401 may be installed in the centrifugal chamber C2 and a plurality of fan modules 101 or 401 may be vertically or horizontally arranged substantially in parallel in the centrifugal fan C2 to suit a continuously variable target load of an air conditioning object space. This is because the fan motor 150 and the centrifugal fan 140 having the 3D shape are reduced in volume, and thus, it is unnecessary to construct a large size fan module having installation and transportation inconvenience.

An assembly structure of the fan module 101 or 401 having a unique modular configuration according to embodiments will be described hereinbelow in detail in consideration of the centrifugal fan 140 having the unique 3D shape employed in the air handler 1 according to embodiments.

The fan module 101 or 401, with reference to in FIGS. 18 and 19, may include the centrifugal fan 140, which may suction in air from the suction chamber C1 into a space between the main plates 1110 vertically oriented and spaced apart from each other in a direction of the rotational axis and radially discharge the air to the centrifugal chamber C2 through gaps between the blades 1130 interconnecting the main plates 1110; the fan motor 150, which may apply torque to the centrifugal fan 140 and which may be linearly coaxial with the rotational axis of the centrifugal fan 140; the fan box 60 having an installation space for the centrifugal fan 140 and the fan motor 150, and a guide 190 installed in the fan box 160 and defining an air introduction passage from the suction chamber C1 to the space between the main plates 1110 of the centrifugal fan 140.

The centrifugal fan 140 has the above-described 3D shape, and thus, requires a relatively small size or small volume for generation of the same air volume. The centrifugal fan 140 may be rotated in the fan box 160, which forms the fan module 101 or 401, thereby creating airflow power for suctioning in air from the suction chamber C1 and for discharging of the air from the centrifugal chamber C2.

The fan module 101 or 401 may further include a motor bracket 170 for the fan motor 150, which may have a smaller vertical height than a vertical height of the centrifugal fan 140, installed in the fan box 160 such that a rotational shaft 150*c* of the fan motor 150 may be horizontally coaxial with the rotational center of the centrifugal fan 140.

With reference to FIG. 19, a pair of the motor brackets 170 may be spaced apart from each other in the fan box 160, and the fan module 101 or 401 may further include a support plate 161 connected at both ends thereof to the respective motor brackets 170 to support the fan motor 150 disposed thereon.

The motor brackets 170 may be installed, respectively, to both surfaces of the fan box 160, adjacent to an air suction surface of the fan box 160, at a same height to extend a predetermined length in a substantially horizontal direction. The support plate 160 may be coupled to the pair of motor brackets 170 such that lower surfaces of first and second ends of the support plate 160 may be supported by upper surfaces of the motor brackets 170.

The fan motor 150 may be firmly mounted on the support plate 160 such that the rotational shaft 150*c* of the fan motor 150 may be linearly coaxial with the rotational center of the centrifugal fan 140. The support plate 160 must be designed to support a weight including a weight of the fan motor 150 and a weight of the centrifugal fan 140 coaxially connected to the fan motor 150.

For easy installation of the fan motor 150, one of the safety nets 130, that is, the safety net 130 adjacent to the fan motor 150 may have a motor fitting hole 135 provided therein for penetration of the fan motor 135. This provides repair convenience by enabling repair or replacement of the fan motor 150 without separation of the safety net 130. However, the motor fitting hole 135 is not absolutely necessary.

The guide 190 may include a bell mouse 193 connected to the fan shroud 1120 formed at a suction portion of the centrifugal fan 140 to guide suction of air into the space between the main plates 1110, and a fan shield 191 connected to an edge of the fan box 160 and having a mouse hole 191*a* in communication with the bell mouse 193. The fan shroud 1120 may be integrally formed with the centrifugal fan 140 and protrude from the suction portion along the rim of the circular suction hole 1121 formed in one of the main plates 1110 through which air may be suctioned.

The bell mouse 193 may not be directly connected to an end of the fan shroud 1120 protruding from the suction portion for rotation of the centrifugal fan 140, but rather, may serve to naturally guide air from the suction chamber C1 to the centrifugal fan 140. The bell mouse 193 may be secured to the fan shield 191 so as to communicate with the mouse hole 191*a*.

The fan shield 191 may be installed to an external surface of the fan box 160 instead of the safety net 130, thereby serving to protect the centrifugal fan 140. In addition, the fan shield 191 may serve to provide an installation space for the bell mouse 193, as described above, and to prevent air suctioned in from the suction chamber C1 from leaking to the centrifugal chamber C2 except for the fan box 160.

The guide 190 may further include an air guide tunnel (not shown) for connection between the communication opening 107*a* of the separation partition 170 and the fan box 160. The air guide tunnel may serve to shield a space between the separation partition 107 and the fan module 101 or 401 (more particularly, the fan shield 191) from the outside to allow air to move to the centrifugal chamber C2 through the communication opening 107*a* of the separation partition 107 due to the centrifugal fan 140 without leakage of the air. In addition, the air guide tunnel may serve to absorb vibration transmitted from the centrifugal fan 140 to the separation partition 107.

According to one embodiment of the air handler 1 having the above-described configuration, a target load of an air conditioning object space in which the air handler 1 is installed may differ in every building. It should be understood that the number of fan modules 101 and 401 installed in the air suction module 100 and the air discharge module 400 may be determined in consideration of a target load, and air conditioning design conditions required by designers, and thus, a plurality of fan modules I, II, III and IV may be provided as shown in FIG. 23. Although FIG. 23 shows an embodiment in which four fan boxes 160 are stacked one above another or arranged side by side by the fan box connection ends 128, embodiments are not limited thereto, and a greater number of fan boxes 160 may be stacked one above another or arranged side by side. In a case in which providing the fan boxes 160 to suit a target load is difficult due to a limited space of the centrifugal chamber C2, as described above, it is possible to increase a volume of the entire module using the middle frames 20B among the module frames 20.

In the related art, a large capacity centrifugal fan and a relatively heavy fan motor to drive the centrifugal fan are used. Belt and pulley driving is adopted as a power transmission to ensure stable installation of the heavy fan motor and stable provision of torque from the fan motor in consideration of a large weight of the fan motor, and a fan housing that encloses the centrifugal fan is required to guide airflow in such a way that air moved by the centrifugal fan is intensively discharged through a given discharge port in order to compensate for power loss caused by the belt and pulley driving. This installation and driving of the centrifugal fan and the fan motor according to the related art are adopted based on uncertainty of fan efficiency including a weight and size of the centrifugal fan. The related art requires a larger installation space for the centrifugal fan and the fan motor, in comparison to a case in which a rotational shaft of the fan motor is directly connected to and driven by the centrifugal fan, and also requires the fan housing because it is difficult to achieve constant static pressure via driving of the centrifugal fan. The fan housing may cause bidirectional air suction or unidirectional air suction according to an air suction structure thereof. In the case of unidirectional air suction, the fan housing may have a complicated interior design. In the case of bidirectional air suction, the fan housing may cause considerable deterioration of fan efficiency because of airflow loss at a coupling region of a belt and a pulley.

According to one embodiment of the air handler 1, through provision of the centrifugal fan 140 having the 3D shape, it is possible to eliminate problems of the related art, such as difficult installation of the heavy fan motor required to drive the large capacity centrifugal fan and provision of the fan housing to discharge air in a given direction based on driving of the centrifugal fan. Therefore, the air handler 1 according to embodiments may achieve various advantages, such as cost reduction and creation of a more pleasant air conditioning environment via flexible management of the fan modules 101 and 401 having a reduced size based on a target load of an air conditioning object space.

According to one embodiment of the air handler 1 having the above-described configuration, an assembly procedure of the fan module 101 or 401 will be described hereinbelow.

A fan module assembly method according to one embodiment may include a separation partition assembly step of assembling the separation partition 107, which divides an inner space of the module into the suction chamber C1 at the first side thereof and the centrifugal chamber C2 at the second side thereof, a fan module assembly step of installing and assembling the fan module 101 or 401, in which the centrifugal fan 140 will be rotatably accommodated, in the centrifugal chamber C2 corresponding to the second side of the separation partition 107 assembled by the separation partition assembly step, a centrifugal fan installation step of installing the centrifugal fan 140 and the fan motor 150 in the fan module 101 or 401 assembled by the fan module assembly step, and a fan module connection step of connecting the fan module 101 or 401 and the separation partition 107 to each other to enable movement of air from the suction chamber C1 to the centrifugal fan 140 without leakage of the air after the centrifugal fan installation step.

The separation partition assembly step may be a step in which both ends of one of the case panels 30 may be vertically slidably inserted into and assembled with the module frames 20 forming the framework of the module to divide the inner space of the module into the suction chamber C1 and the centrifugal chamber C2 arranged in sequence in a flow direction of conditioned air. That is, although the separation partition 107 may be prefabricated as a separate member and then coupled to the module frames 20, the separation partition 107 may be one of the case panels 30.

The fan module assembly step may include a fan module bracket installation process of installing the fan module brackets 110 on an upper surface of the lower cover 30*a* forming a lower surface of the module, a fan box forming process of forming the framework of the fan box 160 using the box frames 120 and the box frame connectors 125 and coupling the safety nets 130 to the framework of the fan box 160 to form the fan box 160 after the fan module bracket installation process, and a fan box installation process of mounting the fan box 160 formed by the fan box forming process on the fan module brackets 110.

In the fan box forming process, the framework of the fan box 160 may be formed by locating the box frame connector 125 at each corner of the fan box 160 and inserting three connection ends 126 of the box frame connector 125 arranged substantially perpendicular to one another into the hollow sections 122 formed in the ends of the respective box frames 120 forming edges of the fan box 160. In the fan box forming process, the safety nets 130 may be secured to the extensions 121 of the box frames 120 extending substantially parallel to the surfaces of the fan box 60.

The centrifugal fan installation step may include a motor bracket installation process of installing the motor brackets 170 inside the fan box 160, a support plate installation process of installing the support plate 161 such that both ends of the support plate 161 may be supported by the motor brackets 170, a fan motor installation process of mounting the fan motor 150 on the support plate 161 after the support plate installation process, and a centrifugal fan installation process of installing the centrifugal fan 140 such that the rotational center of the centrifugal fan 140 is linearly coaxial with the fan motor 150 installed by the fan motor installation process.

The fan module connection step may include a fan shield installation process of installing the fan shield 191 having the mouse hole 191*a* in the suction chamber C1 to form one surface of the fan box 160, a bell mouse installation process of communicating the centrifugal fan 140 with the outside of the fan box 160 using the bell mouse 193 after the fan shield installation process, the bell mouse 193 having a first end coupled to and in communication with the mouse hole 191*a* and a second end that extends toward the fan shroud 1120 of the centrifugal fan 140 protruding into the suction chamber C1, and an air flow forming process of shielding a space between the communication opening 107*a* of the separation partition 107 and the fan shield 191 from the outside using the air guide tunnel.

Figure 26:
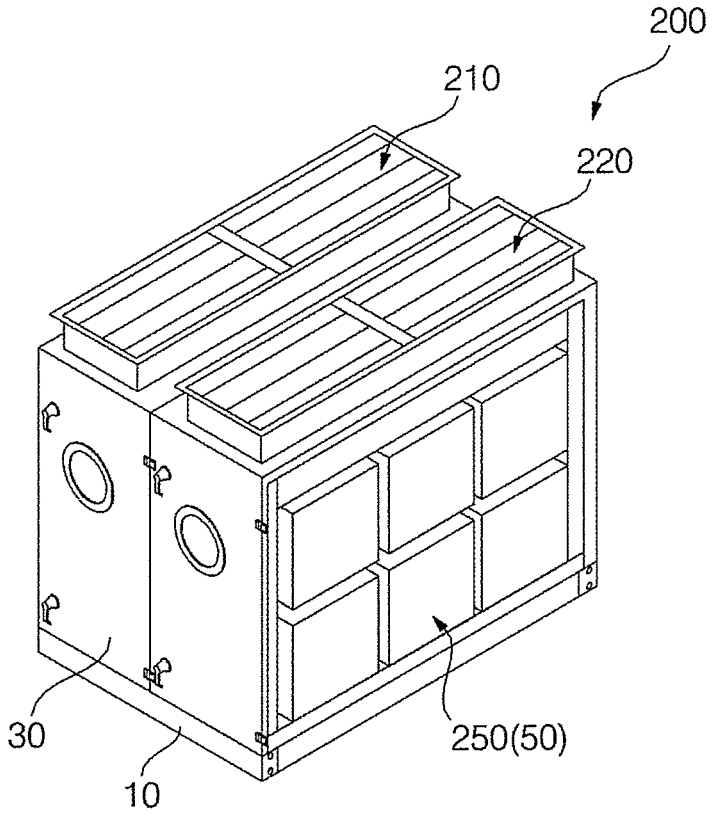
FIG. 26 is a perspective view showing a mixing module of FIG. 1.
Figure 27:
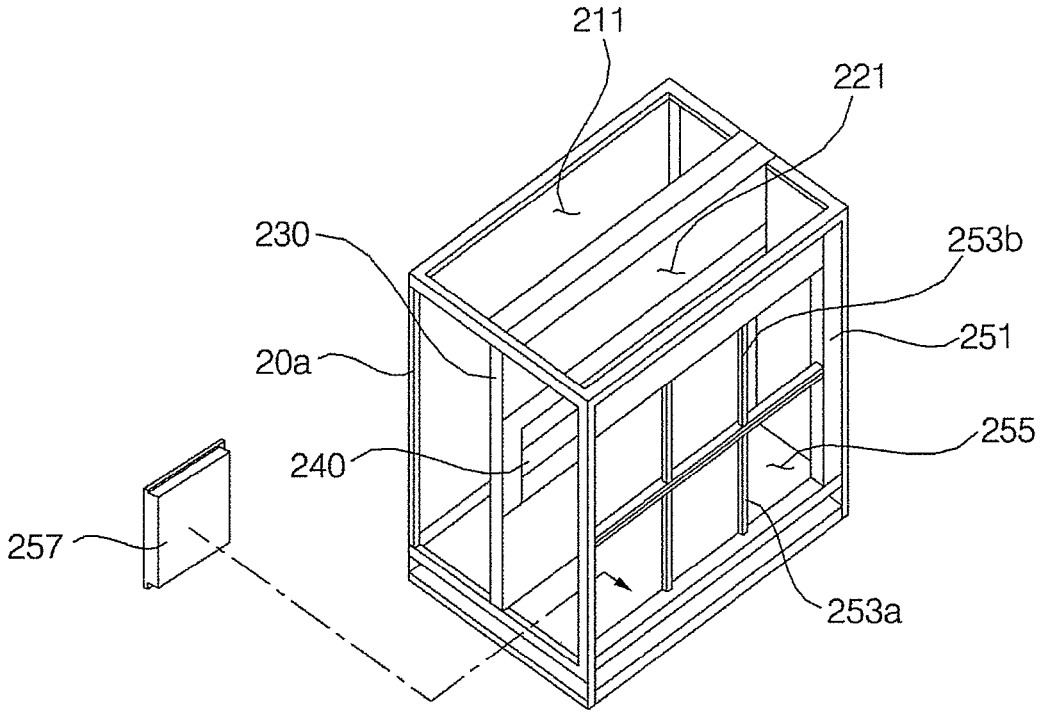
FIG. 27 is an exploded perspective view showing an installed form of a filter to the mixing module of FIG. 26.
Figure 28A:
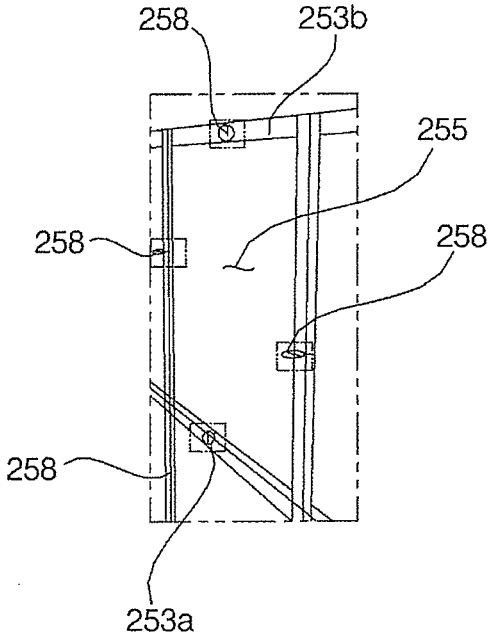
FIGS. 28A-28C are views illustrating securing a filter using a filter clamp.
Figure 28B:
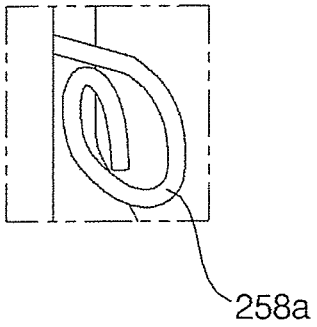
Figure 28C:
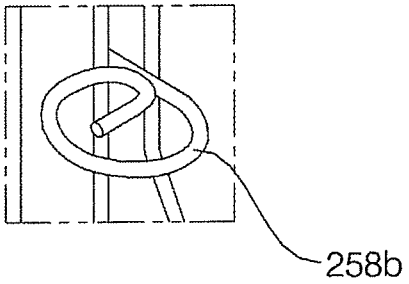

FIG. 26 is a perspective view showing a mixing module of FIG. 1. FIG. 27 is an exploded perspective view showing an installed form of a filter to the mixing module of FIG. 24. FIGS. 28A-28C are views illustrating securing a filter using a filter clamp.

With reference to FIGS. 26 to 28C, according to one embodiment of the air handler 1, the mixing module 200 may include a ventilation chamber 211 that communicates with the air suction module 100, and a compensation chamber 221 separated from the ventilation chamber 211 by a damper shield 230. The compensation chamber 221 may communicate with the heat exchange module 300. The damper shield 230 may be one of the case panels 30 slidably coupled to the middle frame 20*b*, in the same manner as the above-described separation partition 107 of the air suction module 100 or the air discharge module 400.

The mixing module 200 may be sized to enable accurate modular coupling with the air suction module 100 at a first side thereof and the heat exchange module 300 at a second side thereof. As described above, the respective modules may perform differentiated functions by being connected to one another via connection using the bases 10.

Assuming that the first side of the mixing module 200 adjacent to the air suction module 100 is referred to as a suction end, and the second side of the mixing module 200 adjacent to the heat exchange module 300 is referred to as an air discharge end, the mixing module 200 may be provided at the air discharge end thereof with a filter shield 251. The filter shield 251 may be slidably coupled to the edge frames 20*a* in the same manner as the case panels 30.

The filter shield 251 may provide an installation place for filters 257 and filter cartridges 253*a* and 253*b* described hereinbelow. The filters 257 may serve to collect impurities contained in suctioned indoor air and outside air before the air is suctioned into the heat exchange module 300. More specifically, with reference to FIG. 26, the filter shield 251 may be installed to separate the mixing module 200 and the heat exchange module 300 from each other and provided with the filter cartridges 253*a* and 253*b* having a plurality of installation openings 255 for divided installation of the filters 257.

In FIG. 27, two filter cartridges 253*a* and 253*b* having three installation openings 255 for installation of three filters 257 are provided and firmly secured to the filter shield 251 using, for example, screws S so as to be vertically stacked one above another. The filters 257 may be individually installed in the respective installation openings 255 without a gap therebetween.

The filters 257 may be closely fitted into the installation openings 255 and received in the compensation chamber 221 to face the heat exchange module 300. With reference to FIGS. 28A-28C, a plurality of filter clamps 258 may be rotatably arranged on the filter cartridges 253*a* and 253*b* corresponding to rims of the installation openings 255 and serve to secure the filters 257 by grasping the rims of the filters 257 fitted in the installation openings 255 via rotation thereof.

FIG. 28A shows installation positions of the filter clamps 258. FIG. 28B shows a release position of the filter clamp 258 for release of the filter 257. FIG. 28C shows a locking position of the filter clamp 258 for locking of the filter 257.

According to one embodiment of the air handler 1, with reference to FIGS. 26 to 28, the filter cartridges 253*a* and 253*b* for installation of the filters 257 may not be installed in a completed module. Instead, in the same manner as the case panel 30 being installed to the edge frames 20*a*, one of the case panels 30, that is, the case panel 30 adjacent to the heat exchange module 300 may be replaced with the filter shield 251, which may advantageously provide enhanced assembly efficiency.

Meanwhile, the ventilation chamber 211 and the compensation chamber 221 of the mixing module 200 may be, respectively, provided in upper surfaces thereof with a ventilation opening (not designated by a reference numeral) and a compensation opening (not designated by a reference numeral) for communication with the outside. A ventilation damper 210 may be provided in the ventilation opening to adjust an amount of air introduced from the outside, and a compensation damper 220 may be provided in the compensation opening to adjust an amount of air discharged through the compensation opening.

The damper shield 230 may have a communication opening for communication between the ventilation chamber 211 and the compensation chamber 221. A connection damper 240 may be provided in the communication opening to control a flow rate of air between the ventilation chamber 211 and the compensation chamber 221.

The ventilation damper 210, the compensation damper 220, and the connection damper 240 may control the flow rate of air by adjusting opening rates of the ventilation opening, the compensation opening, and the communication opening, thereby improving cleanliness of the air based on a pollution level of a target object space. When a predetermined positive pressure is generated in the ventilation chamber 211 by the fan module 101 of the air suction module 100, an amount of polluted indoor air to be discharged through the ventilation opening may be adjusted as the ventilation damper 210 adjusts an opening rate of the ventilation opening.

In addition, when a predetermined negative pressure is generated in the compensation chamber 221 by the fan module 401 of the air discharge module 400, an amount of outside air to be induced through the compensation opening may be adjusted as the compensation damper 220 adjusts the opening rate of the compensation opening. To compensate for a reduction in air pressure in the mixing module 200 when indoor air is discharged through the ventilation opening, the compensation opening may also serve to allow outside air to be introduced into the mixing module 200.

Mixing of outside air and indoor air is performed to satisfy appropriate conditions, such or a pollution level of indoor air, or a temperature of outside air, where the air handler 1 according to embodiments is one kind of large capacity air conditioner. A main advantage of the air handler 1 according to embodiments is enhanced air conditioning performance due to the mixing of outside air and indoor air. Accordingly, embodiments disclosed herein may advantageously achieve cost reduction due to a simplified modular structure for mixing of outside air.

Figure 29:
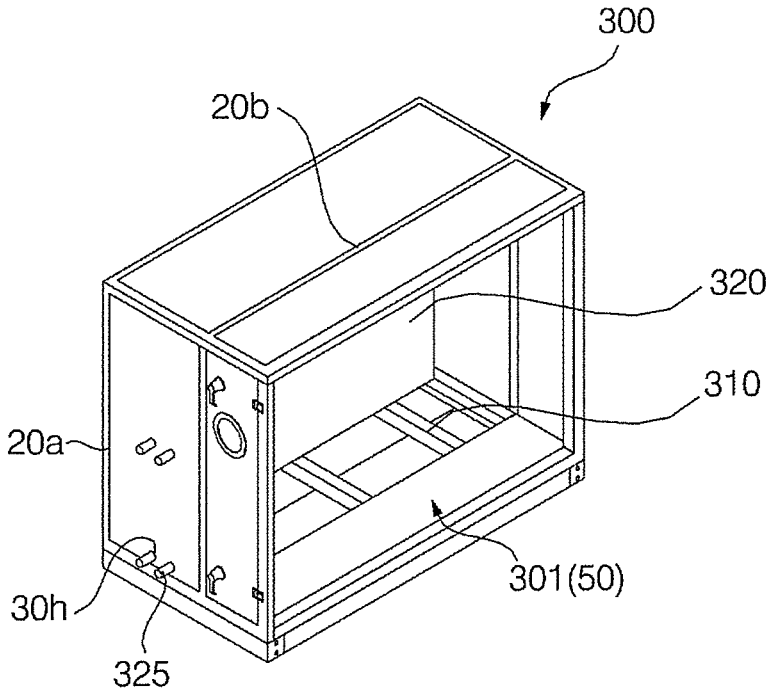
FIG. 29 is a perspective view showing a heat exchange module of FIG. 1.
Figure 30:
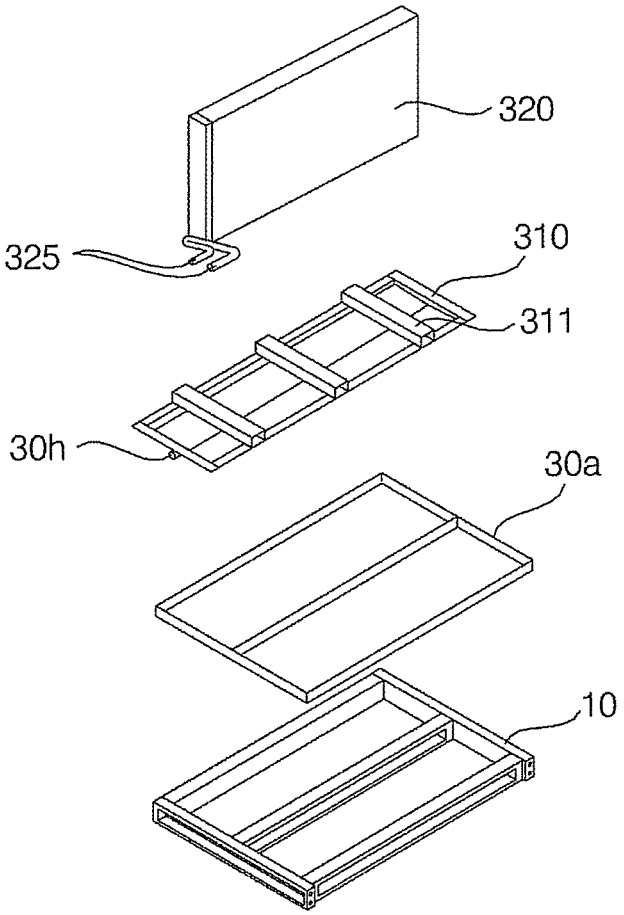
FIG. 30 is an assembly view of the heat exchange module of FIG. 29.
Figure 31A:
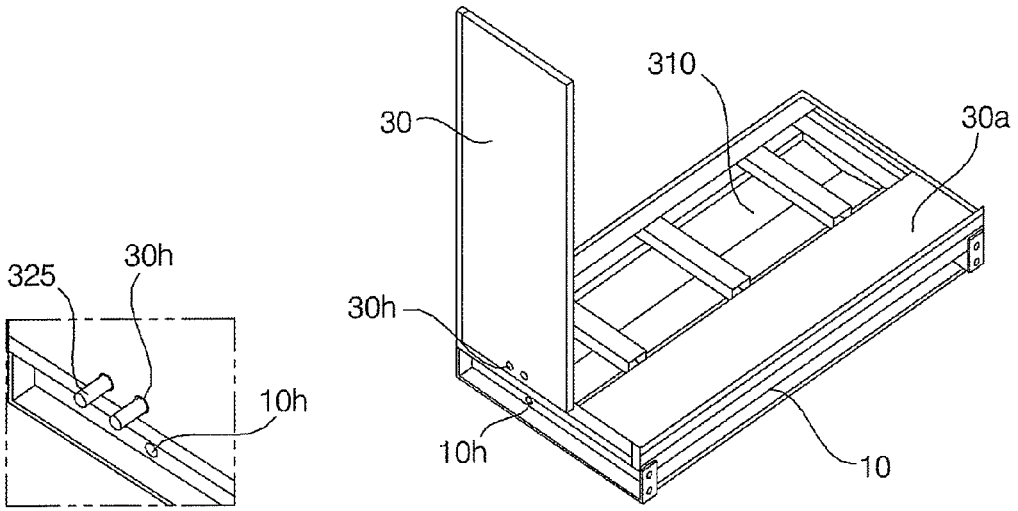
FIGS. 31A-31B are perspective views showing a relationship between a heat exchanger and a drain pan of the heat exchange module of FIG. 29.

FIG. 29 is a perspective view showing the heat exchange module of FIG. 1. FIG. 30 is an assembly view of the heat exchange module of FIG. 29. FIG. 31 is a perspective view showing a relationship between a heat exchanger and a drain pan of the heat exchange module FIG. 29.

With reference to FIGS. 29 to 31B, according to one embodiment of the air handler 1, the heat exchange module 300 may include a drain pan 310 mounted on the base 10, and a heat exchanger 320 disposed on the drain pan 310 for heat exchange of mixed air moved from the mixing module 200. In a state in which a combination of the module frames 20, forming the framework (that is, the rim) of the lower cover 30*a*, is disposed on the base 10 and the above-described lower cover 30*a* is coupled to some of the module frames 20, the drain pan 310 may be coupled to the remaining module frames 20 instead of the lower cover 30*a*.

The drain pan 310 may serve to collect condensed water falling from the heat exchanger 320 and outwardly discharge the condensed water, thereby preventing failure of internal components caused when the internal components sink into the condensed water within the heat exchange module 300 and also preventing scattering of the condensed water. The drain pan 310 may have a length at least longer than an overall length of the heat exchanger 320, and may have a width to prevent the condensed water falling from the heat exchanger 320 from falling to other places except for the drain pan 310.

Support bars 311, on which the heat exchanger 320 may be disposed, may be arranged on the drain pan 310. The support bars 311 may serve to support a weight of the heat exchanger 320.

A condensed water discharge hole 10*h* for discharge of the condensed water collected by the drain pan 310 may be formed in or at one side of the base 10, and a lower surface of the drain pan 310 may be inclined to allow the condensed water falling from the heat exchanger 320 to fall down due to gravity in a given direction toward the condensed water discharge hole 10*h*. A drainpipe 30*h* may be provided at one side of the drain pan 310 to penetrate the condensed water discharge hole 10*h* for discharge of the condensed water through the condensed water discharge hole 10*h*. The drainpipe 30*h* may penetrate the condensed water discharge hole 10*h* so as to be exposed outward when the drain pan 310 is installed on the base 10.

In operation according to one embodiment of the air handler 1, a predetermined pressure difference may occur between an interior of the heat exchange module 300 and the outside, thus disadvantageously causing introduction of outside air through the drainpipe 30*h*. To prevent this problem, a trap device (not shown) may be provided in the drainpipe 30*h* to open the drainpipe 30*h* so as to outwardly discharge the condensed water only when the pressure difference is low or does not cause introduction of outside air.

The heat exchanger 320 may function to exchange heat between refrigerant from a compressor (not shown) and air from the air suction module 100 or the mixing module 200. The heat exchanger 320 may be located in the heat exchange module 300 to allow passage therethrough or thereby of all air moved from the air suction module 100 or the mixing module 200.

The heat exchanger 320 may include a refrigerant circulation pipe 325 to supply refrigerant to an outdoor unit or device or a chiller (not shown) provided outside of the air handler 1 or to collect the refrigerant from the outdoor unit or device or the chiller. The refrigerant circulation pipe 325 may penetrate a refrigerant pipe penetration hole formed in or at one side of the case panel 30 to communicate with the outside.

Figure 31B:
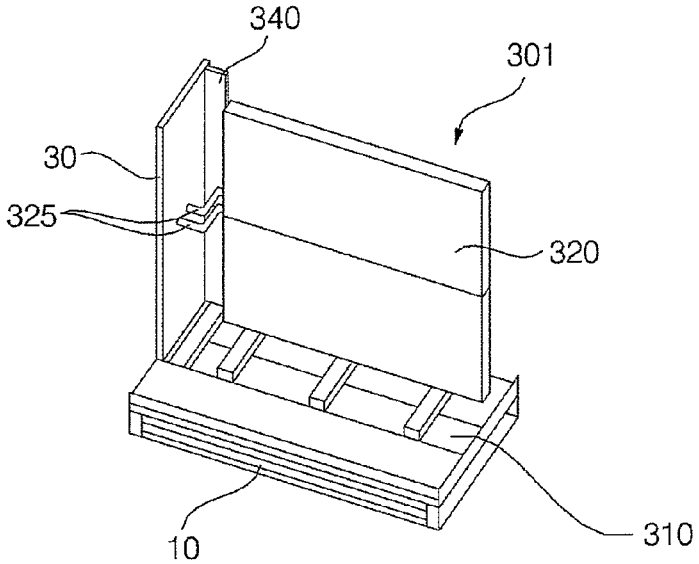

With reference to FIG. 31B, the heat exchange module 300 may include a wind shield 340 to divide an inner space of the heat exchange module 300 into two spaces, in the same manner as the separation partition 107 of the air suction module 100 or the air discharge module 400, or the damper shield 230 of the mixing module 200, which divides the module into at least two spaces. The wind shield 340 may be one of the case panels 30 slidably coupled to the middle frame 20*b*, in the same manner as the separation partition 107 and the damper shield 230. However, the wind shield 340 is not absolutely one of the case panels 30 and any other component to guide air to the heat exchanger 320 may be defined as the wind shield 340.

The wind shield 340 may be located at one side of the heat exchanger 320, and serve to prevent air from leaking through a gap between the heat exchanger 320 and an inner surface of the heat exchange module 300 and to guide movement of all air to the heat exchanger 320. The wind shield 340 may have a communication opening (not shown) in the same manner as the communication opening 107*a* of the separation partition 107 and the communication opening of the damper shield 230. In addition, the communication opening of the wind shield 340 may have a size approximately corresponding to a size of the heat exchanger 320 located at one side thereof, and one or more heat exchangers 320 may be vertically stacked one above another.

A plurality of heat exchangers 320 may be arranged in series for sequential heat exchange of air moving in the heat exchange module 300. When the plurality of heat exchangers 320 is arranged in series, the air moving in the heat exchange module 300 may be subjected to heat exchange with any one of the plurality of heat exchangers 320.

Although serial connection is advantageous for rapid adjustment of a temperature of air, parallel connection may be advantageous for rapid adjustment of an amount of air to be heat-exchanged. Accordingly, the plurality of heat exchangers 320 may be arranged substantially in parallel to allow the air moving in the heat exchange module 300 to selectively exchange heat with the heat exchangers 320.

Meanwhile, according to one embodiment, the air handler 1, with reference to FIGS. 1 and 2, may further include a main control kit 500, which may be coupled to an outer surface of any one of the air suction module 100, the mixing module 200, the heat exchange module 300, and the air discharge module 400 and control operation of internal components 50 arranged in inner spaces of the respective modules. The main control kit 500 may include a kit box main body that defines an installation space for installation of a plurality of control components (not shown), and an interface 510, for example, a Human Machine Interface (HMI) detachably attached to an outer surface of the kit box main body.

The interface 510 may be separably coupled to the kit box main body to control the control components via wireless communication. That is, the interface 510 may be spaced from the kit box main body and function as a remote controller that allows a user to control operation of the control components via wireless communication at a remote distance.

The interface 510 may include a display for indication of a plurality of control menus and a touch panel (not shown) to allow the user to operate the indicated control menus via touch action. The control menus may be based on user focused display providing easy user operation.

According to one embodiment of the air handler 1, enhanced user convenience may be accomplished through provision of the interface 510, and the interface 510 may further allow overall operations of the air handler 1 to be controlled at a remote distance from the respective modules, resulting in enhanced convenience and higher product quality.

Further, according to one embodiment, the air handler 1 may further include an inverter drive controller (not shown) to drive the fan motor 150, disposed in the inner space of the air suction module 100 or the air discharge module 100, in response to a control signal applied from the main control kit 500.

Figure 32:
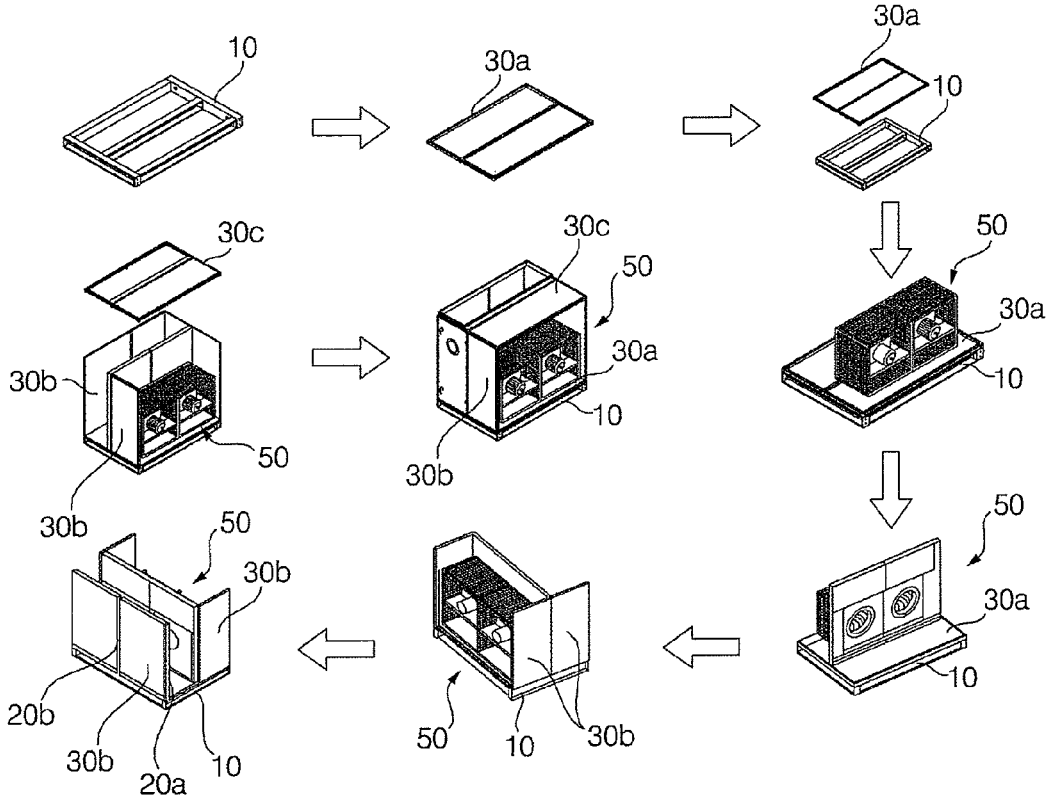
FIG. 32 is a diagram illustrating a method for assembling an air handler according to an embodiment.

FIG. 32 is a diagram illustrating a method for assembling the air handler according to an embodiment. With reference to FIG. 32, the method for assembling the air handler 1 according to an embodiment may include a base forming step of forming the base 10 by assembling the base frames 11*a*, 11*b*, and 15 with one another, a frame assembly step of assembling the module frames 20 with one another on the base 10 formed by the base forming step to form a framework of a module, and a case panel assembly step of slidably inserting the case panels 30 to the framework of the module formed by the frame assembly step to form surfaces of the module.

Although internal components 50, located in each module to provide a differentiated function of the module, may be assembled after the aforementioned frame assembly step, to minimize interference in assembly operation, the internal components 50 may be assembled before the frame assembly step. According to one embodiment of the method for assembling the air handler 1, this assembly may be referred to as an internal component assembly step, and the internal component assembly step may be performed to previously assemble the internal components 50 to be mounted in the module before the frame assembly step.

The case panel assembly step may be a step of coupling one end or both ends of each case panel 30 to the module frames 20, assembled into the rectangular framework having at least one open side, and sliding the case panel toward a closed opposite side of the framework. However, it will be appreciated that the case panels 30 are not absolutely assembled to the previously built module frames 20, and the module frames 20 may be assembled to each case panel 30 to form a rim of the case panel 30 and then the resulting assemblies may be combined with one another. The latter assembly method problematically requires a lot of assemblers due to a relatively large weight of the resulting assembly, and therefore, the former assembly method that allows one or two assemblers to sufficiently assemble the air handler 1 may be advantageous.

Although different internal components 50 may be installed in the respective modules to perform differentiated functions of the modules, the internal component assembly step may be a step of coupling at least the internal components 50, which may fully divide the interior of the module, for example, the separation partition 107 of the air suction module 100 or the air discharge module 400, the damper shield 230 of the mixing module 200 and the wind shield 340 of the heat exchange module 300, to the middle frame 20*b* among the module frames 20 in the same manner as sliding coupling between the case panels 30 and the module frames 20.

The assembly method of the air handler 1 having the above-described configuration according to embodiments will be described below in brief with reference to the accompanying drawing, in particular, FIG. 32.

First, the base 10 to support a weight of each module may be assembled using the base frames 11*a*, 11*b*, and 15. In this case, the open side 12 of each base frame of the base 10 may be oriented outward for simplified coupling of neighboring modules.

Next, the lower cover 30*a*, which has been previously assembled by the module frames 20 and the case panels 30, may be firmly fixed on the base 10. Then, the internal components 50 to be disposed in each module may be assembled before a frame assembly step of forming the framework of the module using the module frames 20. More specifically, with reference to FIG. 32, the fan module 101 or 401, which is the internal component 50 provided in the air suction module 100 and the air discharge module 400, may be first assembled at a position corresponding to the centrifugal chamber C2.

Next, after at least two module frames 20 are vertically connected to both ends of the middle frame 20*b* via the middle connectors 40*b*, as described above, the internal component 50 to divide the interior of the module into at least two spaces, that is, the separation partition 107, the damper shield 230, or the wind shield 340, may be slidably coupled such that both ends thereof are fitted into the two module frames 20, that is, the middle frames 20*b* in the same coupling manner as coupling of the case panels 30.

Then, after the remaining framework of the module is formed using the module frames 20, one end or both ends of each case panel 30 may be coupled to the module frames 20, assembled into the rectangular framework having at least one open side such that the case panel 30 slides toward a closed opposite side of the framework. Thereby, the surface of the module may be completed.

The completed modules as described above, with reference to FIGS. 1 and 2, may be arranged in sequence of the air suction module 100, the mixing module 200, the heat exchange module 300, and the air discharge module 400. Thereafter, as the respective modules are firmly secured to one another so as to prevent leakage of air from the modules using the anti-leakage clamps 60 and coupling portions of the bases 10, assembly of the air handler 1 may be completed.

As is apparent from the above description, an air handler having the above-described configuration and a method for assembling an air handler according to embodiments may achieve various effects, including following.

First, modular assembly on a per function basis may be possible at a place of manufacture or a factory for manufacture of respective parts or components forming the air handler, and modular logistics and transportation to a building or a machine room where the air handler will be installed or constructed are possible. This has the effect of providing easy management of parts or components.

Second, as a manufacturer who manufactures respective parts or components of the air handler may perform modular assembly at a place of manufacture or a factory using sufficient information on products, the manufacturer need not visit a building or a machine room where the air handler will be installed or constructed for assembly of the air handler. This has the effect of considerably reducing an assembly time.

Third, modular assembly and transportation of the air handler on a per function basis enables easy transportation of the air handler using short distance transportation, such as a forklift, and also allow the entire air handler to be divided to a size for transportation by, for example, an elevator of a building. This has the effect of ensuring easy vertical transportation of the air handler in a building.

Fourth, a plurality of module frames forming a framework of a module and case panels forming surfaces of the module may be assembled with each other via sliding coupling. This has the effect of considerably reducing an assembly time.

Fifth, upon sliding coupling of the case panels to the module frames, a heat transfer barrier and sealing portions may function to prevent leakage of heat and air. This has the effect of improving hermetic sealing between an interior of the module and the outside.

Sixth, sliding assembly between the module frames and the case panels may sufficiently prevent leakage of air and heat from the interior of the module without requiring an additional sealing operation. This has the effect of improving working efficiency.

Seventh, different from the related art in which a lot of screws are used to achieve hermetic sealing between the interior of the module in which movement of conditioned air occurs and the outside, a number of screws used in the module according to embodiments may be minimized. This has the effect of reducing an assembly time and manufacturing costs of the entire module.

Embodiments disclosed herein provide an air handling unit or air handler which may allow modular assembly and transportation from a place of manufacture to a site, that is, from the outside of a machine room of a building to the machine room where a completed product of the air handling unit will be installed, and may allow a plurality of modules transported respectively into the machine room to be completely assembled in a simplified manner within the machine room, thereby reducing overall installation and construction time.

Embodiments disclosed herein further provide an air handling unit or air handler which may allow simplified modular assembly at a place of manufacture or outside of a machine room by a few low-skill assemblers with a considerably reduced number of assembly operations.

Embodiments disclosed herein further provide an air handling unit or air handler which may prevent heat exchange between an interior of a module and the outside by a process of assembling the module via a combination of a plurality of module frames and case panels, and may also prevent conditioned air for an air conditioning cycle from leaking from the interior of the air handling unit to the outside upon completion of modular assembly in a machine room.

Embodiments disclosed herein provide an air handling unit or air handler that may include an air suction module, a mixing module, a heat exchange module, and an air discharge module arranged in sequence in a flow direction of conditioned air so as to form flow paths of the conditioned air for an air conditioning cycle on a per function basis, wherein, after the modules are individually assembled, at least two modules may be selected such that edge frames, included respectively in the at least two modules to form the framework of each module, may be connected to each other, thereby forming flow paths of the conditioned air for at least two functions.

Embodiments disclosed herein provide an air handling unit or air handler that may include an air suction module, a mixing module, a heat exchange module, and an air discharge module arranged in sequence in a flow direction of conditioned air so as to form flow paths of the conditioned air for an air conditioning cycle on a per function basis, each module being assembled by coupling a plurality of case panels forming surfaces of the module to a framework of the module formed by a plurality of module frames and a plurality of connecting members that interconnect the module frames, wherein, after the modules are individually assembled, at least two modules may be selected such that the neighboring module frames of the at least two modules may be connected to each other, thereby forming flow paths of the conditioned air for at least two functions.

Each of the air suction module, the mixing module, the heat exchange module, and the air discharge module may include the module frames forming the framework of the module and the case panels coupled to the module frames to form surfaces of the module while shielding an inner space of the module from an external space except for the flow paths of the conditioned air, and edge frames may be frames forming edges of each module among the module frames.

The air handling unit may further include at least one connecting clamp configured to couple one edge frame of a first module among the at least two modules, the module being a first module, and one edge frame of a second module next to the edge frame of the first module to each other. The connecting clamp may be simultaneously connected to the first module and the second module next or adjacent to each other to prevent a gap between the first module and the second module.

Each of the first module and the second module may include an inlet end for introduction of conditioned air, and an outlet end for discharge of conditioned air, and the connecting clamp may interconnect the edge frames, respectively, forming an outlet end of the first module and an inlet end of the second module. The connecting clamp may includes a first module connection end portion or end having one or a first end secured to the edge frame of the first module and the other or a second end provided with male threads, a second module connection end portion or end having one or a first end secured to the edge frame of the second module and the other or a second end provided with male threads, and an adjusting nut located between the other end of the first module connection end portion and the other end of the second module connection end portion. The adjusting nut may have axial connection holes formed in one or a first side and the other or a second side thereof for insertion of the other end of the first module connection end portion and the other end of the second module connection end portion.

The connection holes formed in the adjusting nut may be provided with female threads corresponding to the male threads formed, respectively, at the other end of the first module connection end portion and the other end of the second module connection end portion. The female threads may have a given helical direction to allow the first module connection end portion and the second module connection end portion to approach each other when the adjusting nut is rotated in a given or first direction and to move away from each other when the adjusting nut is rotated in an opposite or second direction.

The first module connection end portion and the second module connection end portion may be flat to come into surface contact with the edge frame of the first module and the edge frame of the second module. The first module connection end portion and the second module connection end portion may be secured, respectively, to the edge frame of the first module and the edge frame of the second module by bolting.

The adjusting nut may have a hexagonal cross sectional shape. The at least one connecting clamp may include a plurality of connecting clamps spaced apart from one another along the edge frame of the first module and the edge frame of the second module coupled to each other.

Embodiments disclosed herein may further provide an air handling unit or air handler that may include an air suction module configured to accommodate a fan module configured to suction indoor air and discharge the air from one side thereof, a mixing module configured to mix the indoor air supplied from the air suction module with outside air suctioned in from the outside and to discharge the mixed air from one side thereof, a heat exchange module configured to perform heat exchange of the mixed air supplied from the mixing module and to discharge the heat-exchanged air from one side thereof, and an air discharge module configured to suction the heat-exchanged air supplied from the heat exchange module to a room. All of the modules may be arranged in sequence in a flow direction of conditioned air so as to form flow paths of the conditioned air for an air conditioning cycle on a per function basis. At least two modules may be individually assembled and then individually transported to a machine room of a building for air conditioning so as to form flow paths of conditioned air for at least two functions via interconnection of edge frames, respectively, included in the two modules to form the framework of the module. Further, each of the modules may include a lower cover that forms a lower surface of the module, a side cover that forms a side surface of the module, and an upper cover that forms an upper surface of the module, and each of the cover may be a combination of at least one edge frame that forms a rim of the module and at least one case panel slidably coupled to the edge frame.

The air suction module may accommodate a fan module configured to suction in indoor air and discharge the air from one side thereof. The mixing module may mix the indoor air supplied from the air suction module with outside air suctioned from the outside and discharge the mixed air from one side thereof. The heat exchange module may perform heat exchange of the mixed air supplied from the mixing module and discharge the heat-exchanged air from one side thereof. The air discharge module may discharge the heat-exchanged air supplied from the heat exchange module to a room.

The air handling unit may further include a plurality of bases arranged below the respective modules to support lower surfaces of the respective modules, and after the modules, each including the lower cover, the side cover, and the upper cover, are individually mounted on the base, neighboring bases may be interconnected to couple at least two modules to each other. Each of the bases, arranged below each module to support the lower surface of the module, may include a plurality of base frames combined into a size and shape corresponding to a size and shape of a lower end rim portion or rim of the module, and the base may be coupled to the lower cover of the module.

The base frames may have an elongated form having a "⊏"-shaped cross section and may be oriented such that an open side of the "⊏"-shaped base frame faces outward. Further, each of the bases may be provided at an upper end rim portion or rim thereof with a plurality of mounting brackets to assist the base in screwing with the rim of the lower cover. The edge frame forming the rim of the lower cover may be provided with a slope such that an edge of the module has an obtuse angle, and upper ends of the mounting brackets may be bent to come into surface contact with the slope of the edge frame.

Each of the base frames may be provided at both ends thereof with connection flanges. Each connection flange may have a bolt fastening hole that communicates with the open side of the base frame, such that the base frames of neighboring modules come into surface contact with each other by, for example, bolting.

The module frames may, respectively, have at least one sliding rib formed in a substantially longitudinal direction thereof, and the case panels coupled to the module frames may, respectively, have a sliding rail groove for insertion of the sliding rib.

Each of the case panels may include an inner plate that forms an inner surface of the module, an outer plate outwardly spaced substantially in parallel from the inner plate by a predetermined distance, the outer plate forming an outer surface of the module, a heat insulating material filled between the inner plate and the outer plate, and a joint member arranged along rim portions or rims of the inner plate and the outer plate for finishing of ends. The sliding rail groove may be formed in the joint member, such that the joint member may be supported by the module frame. The joint member may prevent transfer of heat from the interior of the module to the outside.

The module frames may include a plurality of edge frames that forms edges of the module, and a middle frame connected at one end and the other end thereof to the edge frames, the middle frame being not connected to an angular point of the module. The connecting members may include one or more corner connectors each having three inserting ends arranged substantially perpendicular to one another, the inserting ends being connected, respectively, to three edge frames to form an angular point of the module, and at least one middle connector having two linearly arranged inserting ends connected to two edge frames and at least one inserting end substantially perpendicular to the two linearly arranged inserting ends and connected to the middle frame in a direction substantially perpendicular to the two edge frames.

The lower cover forming the lower surface of the module may be assembled by arranging the corner connectors at respective angular points of a rectangle, connecting lower edge frames among the edge frames to the respective corner connectors to form the rectangle having one open side, slidably coupling a lower case panel among the case panels to the connected lower edge frames before a last lower edge frame is connected to the open side, and finally coupling the last lower edge frame. The side cover forming the side surface of the module may be assembled by vertically connecting side edge frames among the edge frames to upper surfaces of the respective corner connectors, and slidably coupling a side case panel among the case panels between two neighboring ones of the side edge frames.

The upper cover forming the upper surface of the module may be assembled by arranging the corner connectors at upper ends of the respective side edge frames so as to be located at respective angular points of a rectangle, connecting upper edge frames among the edge frames to the respective corner connectors via insertion of the sliding rib of each upper edge frame into the sliding rail groove of the side case panel to form the rectangle having one open side, slidably coupling an upper case panel among the case panels to the connected upper edge frames before a last upper edge frame is connected to the open side, and finally coupling the last upper edge frame.

At least one middle connector may be located between the neighboring corner connectors so as to be coupled to two edge frames and at least one middle frame. At least one of the lower cover, the side cover, and the upper cover may be divided into two case panels by the middle frame. One of the two case panels forming the upper cover may be replaced with an air suction opening panel or an air discharge opening panel forming a suction opening of conditioned air or a discharge opening of conditioned air.

Each of the air suction module and the air discharge module may accommodate a fan module installed in an inner space thereof, and the fan module may include at least one fan box to receive a fan motor, and a centrifugal fan configured to generate flow power of the conditioned air. The middle frame and the middle connector may be coupled to expand the inner space of each of the air suction module and the air discharge module so as to correspond to a volume of the fan module.

The inner space of each of the air suction module and the air discharge module may be divided by a separation partition into one side suction chamber and the other side centrifugal chamber. The fan module may be placed in the centrifugal chamber. The middle connector and the middle frame may be coupled to expand an inner space of the centrifugal chamber.

The air handling unit may further include a main control kit coupled to an outer surface of any one module among the air suction module, the mixing module, the heat exchange module, and the air discharge module. The main control kit may control operations of an internal components placed in an inner space of each module.

The main control kit may include a kit box main body having an installation space for installation of a plurality of control components, and an interface unit or interface detachably attached to an outer surface of the kit box main body. The interface unit may be configured to control the control components via wireless communication.

The air handling unit may further include an inverter drive control unit or controller configured to drive the fan motor installed in the inner space of each of the air suction module and the air discharge module in response to a control signal applied from the main control kit.

Effects are not limited to the aforementioned effects and other not-mentioned effects will be clearly understood by those skilled in the art from the claims.

An air handler and an assembly method according to embodiments has been described in detail with reference to the accompanying drawings. However, embodiments should not be limited by the above-described exemplary embodiments, and various modifications and equivalent implementations may be made by those skilled in the art. Hence, the scope should be defined by the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled, edge frames of at least two of the plurality of modules, included, respectively, in the at least two modules to form a framework of each module, are connected to each other, thereby forming flow paths of the air for at least two functions, wherein the air suction module accommodates a fan module to suction in indoor air and discharge the air from a side thereof, wherein the mixing module mixes the indoor air supplied from the air suction module with outside air suctioned in from outside of the air handler and discharges the mixed air from a side thereof, wherein the heat exchange module performs heat exchange on the mixed air supplied from the mixing module and discharges the heat-exchanged air from a side thereof, wherein the air discharge module discharges the heat-exchanged air supplied from the heat exchange module to an object space, wherein each of the air suction module, the mixing module, the heat exchange module, and the air discharge module comprises:

a plurality of module frames that forms a framework of the respective module; and a plurality of case panels coupled to the plurality of module frames to form surfaces of the respective module while shielding an inner space of the respective module from an external space except for the flow paths of the air, wherein the edge frames are modules frames of the plurality of module frames that form edges of the respective module; and at least one connecting clamp configured to couple to each other one edge frame of a first module of the at least two modules, and one edge frame of a second module disposed next to the edge frame of the first module, wherein the at least one connecting clamp includes:

a first module connection end having a first end secured to the edge frame of the first module and a second end provided with male threads;

a second module connection end having a first end secured to the edge frame of the second module and a second end provided with male threads; and an adjusting nut located between the second end of the first module connection end and the second end of the second module connection end, wherein the adjusting nut has axial connection holes formed in first and second sides thereof for insertion of the second end of the first module connection end and the second end of the second module connection end.

2. The air handler according to claim 1, wherein the at least one connecting clamp is simultaneously connected to the first module and the second module to prevent a gap between the first module and the second module.

3. The air handler according to claim 1, wherein each of the first module and the second module includes an inlet end for introduction of air and an outlet end for discharge of air, and wherein the connecting clamp interconnects the edge frames, respectively, that form the outlet end of the first module and the inlet end of the second module.

4. The air handler according to claim 1, wherein the connection holes formed in the adjusting nut are provided with female threads corresponding to the male threads formed, respectively, in the second end of the first module connection end and the second end of the second module connection end, and wherein the female threads have a given helical direction to allow the first module connection end and the second module connection end to approach each other when the adjusting nut is rotated in a first direction and to move away from each other when the adjusting nut is rotated in a second direction, opposite to the first direction.

5. The air handler according to claim 1, wherein the first module connection end and the second module connection end are flat so as to come into surface contact with the edge frame of the first module and the edge frame of the second module.

6. The air handler according to claim 1, wherein the first module connection end and the second module connection end are secured, respectively, to the edge frame of the first module and the edge frame of the second module by bolting.

7. The air handler according to claim 1, wherein the adjusting nut has a hexagonal cross sectional shape.

8. The air handler according to claim 1, wherein the at least one connecting clamp comprises a plurality of connecting clamps spaced apart from one another along the edge frame of the first module and the edge frame of the second module.

9. The air handler according to claim 1, wherein each of the plurality of modules comprises:

a lower cover that forms a lower surface of the respective module;

at least one side cover that forms at least one side surface of the respective module; and an upper covet that forms an upper surface of the respective module, and wherein each of the lower, side, and upper covers is a combination of at least one edge frame that forms a rim of the module and at least one case panel slidably coupled to the edge frame.

10. The air handler according to claim 9, further comprising a plurality of bases arranged below the plurality of modules, respectively, to support the lower surfaces of the plurality of modules, wherein, after the plurality of modules, each including the lower cover, the at least one side cover, and the upper cover, is individually mounted on the respective base, neighboring bases are interconnected to couple the at least two modules to each other.

11. The air handler according to claim 1, wherein the plurality of module frames each have at least one sliding rib formed in a longitudinal direction thereof, and wherein the plurality of case panels coupled to the plurality of module frames, respectively, have at least one sliding rail groove for insertion of the at least one sliding rib thereinto.

12. The air handler according to claim 1, wherein each of the plurality of module frames comprises:

a plurality of edge frames that forms edges of the respective module; and a middle frame connected at a first end and a second end thereof to the plurality of edge frames, wherein the middle frame is not connected to a corner of the respective module.

13. The air handler according to claim 12, further comprising a plurality of connectors that connect the plurality of module frames to form the framework of each module.

14. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled, edge frames of at least two of the plurality of modules, included, respectively, in the at least two modules to form a framework of each module, are connected to each other, thereby forming flow paths of the air for at least two functions, wherein each of the plurality of modules comprises:

a lower cover tat forms a lower surface of the respective module;

at least one side cover that forms at least one side surface of the respective module; and an upper cover that forms an upper surface of the respective module, and wherein each of the lower, side, and upper covers is a combination of at least one edge frame that forms a rim of the module and at least one case panel slidably coupled to the edge frame; and a plurality of bases arranged below the plurality of modules, respectively, to support the lower surfaces of the plurality of modules, wherein, after the plurality of modules, each including the lower cover, the at least one side cover, and the upper cover, is individually mounted on the respective base, neighboring bases are interconnected to couple the at least two modules to each other, wherein each of the plurality of bases, arranged below each module to support the lower surface of the respective module, includes a plurality of base frames coupled into a size and shape corresponding to a size and shape of a lower end rim of the respective module, and wherein the respective base is coupled to the lower cover of the respective module.

15. The air handler according to claim 14, wherein the plurality of base frames each has an elongated form having a "ㄷ"-shaped cross section and is oriented such that an open side of the "ㄷ"-shaped base frame faces in an outward direction with respect to a central longitudinal axis of the respective module.

16. The air handler according to claim 14, wherein each of the plurality of base frames is provided at both ends thereof with connection flanges, and each connection flange has a bolt fastening hole that communicates with an open side of the base frame such that base frames of neighboring modules come into surface contact with each other by bolting.

17. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled, edge frames of at least two of the plurality of modules, included, respectively, in the at least two modules to form a framework of each module, are connected to each other, thereby forming flow paths of the air for at least two functions, wherein each of the plurality of modules comprises:

a lower cover that forms a lower surface of the respective module;

at least one side cover that forms at least one side surface of the respective module; and an upper cover that forms an upper surface of the respective module, and wherein each of the lower, side, and upper covers is a combination of at least one edge frame that forms a rim of the module and at least one case panel slidably coupled to the edge frame; and a plurality of bases arranged below the plurality of modules, respectively, to support the lower surfaces of the plurality of modules, wherein, after the plurality of modules, each including the lower cover, the at least one side cover, and the upper cover, is individually mounted on the respective base, neighboring bases are interconnected to couple the at least two modules to each other, wherein each of the plurality of bases is provided at an upper end rim thereof with a plurality of mounting brackets to assist the respective base in coupling with the respective rim of the respective lower cover.

18. The air handler according to claim 17, wherein each edge frame that forms the rim of the lower cover is provided with a slope such that an edge of the respective module has an obtuse angle, and wherein upper ends of the plurality of mounting brackets are bent to come into surface contact with the slope of the edge frame.

19. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled, edge frames of at least two of the plurality of modules, included, respectively, in the at least two modules to form a framework of each module, are connected to each other, thereby forming flow paths of the air for at least two functions, wherein the air suction module accommodates a fan module to suction in indoor air and discharge the air from a side thereof, wherein the mixing module mixes the indoor air supplied from the air suction module with outside air suctioned in from outside of the air handler and discharges the mixed air from a side thereof, wherein the heat exchange module performs heat exchange on the mixed air supplied from the mixing module and discharges the heat-exchanged air from a side thereof, wherein the air discharge module discharges the heat-exchanged air supplied from the heat exchange module to an object space, wherein the plurality of module frames each have at least one sliding rib formed in a longitudinal direction thereof, wherein the plurality of case panels coupled to the plurality of module frames, respectively, have at least one sliding rail groove for insertion of the at least one sliding rib thereinto, wherein each of the plurality of case panels includes:

an inner plate that forms an inner surface of the module;

an outer plate outwardly spaced substantially in parallel from the inner plate by a predetermined distance, wherein the outer plate forms an outer surface of the module;

a heat insulating material filled between the inner plate and the outer plate; and a joint member arranged along rims of the inner plate and the outer plate to finish ends thereof, wherein the at least one sliding rail groove is formed in the joint member such that the joint member is supported by the plurality of module frames, and wherein the joint member prevents transfer of heat from an interior of the respective module outside of the module.

20. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled, edge frames of at least two of the plurality of modules, included, respectively, in the at two modules to form a framework of each module, are connected to each other, thereby forming flow paths of the air for at least two functions, wherein the air suction module accommodates a fan module to suction in indoor air and discharge the air from a side thereof, wherein the mixing module mixes the indoor air supplied from the air suction module with outside air suctioned in from outside of the air handler and discharges the mixed air from a side thereof, wherein the heat exchange module performs heat exchange on the mixed air supplied from the mixing module and discharges the heat-exchanged air from a side thereof, wherein the air discharge module discharges the heat-exchanged air supplied from the heat exchange module to an object space, wherein each of the air suction module, the mixing module, the heat exchange module, and the air discharge module comprises:

a plurality of module frames that form a framework of the respective module; and a plurality of case panels coupled to the plurality of module frames to form surfaces of the respective module while shielding an inner space of the respective module from an external space except for the flow paths of the air, and wherein the edge frames are modules frames of the plurality of module frames that form edges of the respective module, wherein each of the plurality of module frames comprises:

a plurality of edge frames that forms edges of the respective module; and a middle frame connected at a first end and a second end thereof to the plurality of edge frames, wherein the middle frame is not connected to a corner of the respective module; and a plurality of connectors that connect the plurality of module frames to form the framework of each module, wherein the plurality of connectors comprises:

one or more corner connectors, each having three inserting ends arranged substantially perpendicular to one another, wherein the three inserting ends are connected, respectively, to three edge frames to form a corner of the respective module; and at least one middle connector having two linearly arranged inserting ends connected to two edge frames and at least one inserting end substantially perpendicular to the two linearly arranged inserting ends and connected to the middle frame in a direction substantially perpendicular to the two edge frames.

21. The air handler according to claim 20, wherein a lower cover that forms a lower surface of the respective module is assembled by arranging corner connectors at respective corners of a rectangle, connecting lower edge frames of the plurality of edge frames to the respective corner connectors to form the rectangle having one open side, slidably coupling a lower case panel of the plurality of case panels to the connected lower edge frames before a last lower edge frame is connected to the open side, and finally coupling the last lower edge frame.

22. The air handler according to claim 21, wherein at least one side cover that forms at least one side surface of the respective module is assembled by vertically connecting side edge frames of the plurality of edge frames to upper surfaces of the respective corner connectors, and slidably coupling at least one side case panel of the plurality of case panels between two neighboring ones of the side edge frames.

23. The air handler according to claim 22, wherein an upper cover that forms an upper surface of the respective module is assembled by arranging the corner connectors at upper ends of the respective side edge frames so as to be located at respective corners of a rectangle, connecting upper edge frames of the plurality of edge frames to the respective corner connectors via insertion of the sliding rib of each upper edge frame into the sliding rail groove of the at least one side case panel to form the rectangle having one open side, slidably coupling an upper case panel of the plurality of case panels to the connected upper edge frames before a last upper edge frame is connected to the open side, and finally coupling the last upper edge frame.

24. The air handler according to claim 23, wherein at least one middle connector is located between neighboring corner connectors so as to be coupled to two edge frames and at least one middle frame, and wherein at least one of the lower cover, the side cover, or the upper cover is divided into two case panels by the middle frame.

25. The air handler according to claim 22, wherein one of the two case panels forming the upper cover is replaced with an air suction opening panel or an air discharge opening panel that forms a suction opening for air or a discharge opening for air.

26. The air handler according to claim 22, wherein each of the air suction module and the air discharge module accommodates a fan module installed in an inner space thereof, wherein the fan module includes at least one fan box to receive a fan motor, and a centrifugal fan to generate a flow of air, and wherein the middle frame and the middle connector are coupled to expand the inner space of each of the air suction module and the air discharge module so as to correspond to a volume of the fan module.

27. The air handler according to claim 26, wherein the inner space of each of the air suction module and the air discharge module is divided by a separation partition into a suction chamber at a first side of the separation partition and a centrifugal chamber at a second side of the separation partition, and wherein the fan module is placed in the centrifugal chamber, and the middle connector and the middle frame are coupled to expand an inner space of the centrifugal chamber.

28. An air handler, comprising:

a plurality of modules including an air suction module, a mixing module, a heat exchange module, and an air discharge module arranged in sequence in a flow direction of air so as to form flow paths of air for an air conditioning cycle on a per function basis, wherein, after the plurality of modules is individually assembled edge frames of at least two of the plurality of modules, included, respectively, in the at least two modules to form a framework of each module, are connected to each other, thereby forming flow paths of the air for at least two functions, wherein the air suction module accommodates a fan module to suction in indoor air and discharge the air from a side thereof, wherein the mixing module mixes the indoor air supplied from the air suction module with outside air suctioned in from outside of the air handler and discharges the mixed air from a side thereof, wherein the heat exchange module performs heat exchange on the mixed air supplied from the mixing module and discharges the heat-exchanged air from a side thereof, wherein the air discharge module discharges the heat-exchanged air supplied from the heat exchange module to an object space; and a main controller coupled to an outer surface of any one of the air suction module, the mixing module, the heat exchange module, or the air discharge module, wherein the main controller controls operation of internal components placed in an inner space of each module of the plurality of modules.

29. The air handler according to claim 28, wherein the main controller includes:

a main body having an installation space for installation of a plurality of control components; and an interface detachably attached to an outer surface of the main body.

30. The air handler according to claim 29, wherein the interface controls the control components via wireless communication.

31. The air handler according to claim 28, further comprising an inverter drive controller configured to drive a fan motor installed in an inner space of each of the air suction module and the air discharge module in response to a control signal applied from the main controller.

* * * * *